US011674322B2

(12) United States Patent
Richardson et al.

(10) Patent No.: US 11,674,322 B2
(45) Date of Patent: Jun. 13, 2023

(54) RETAINERS FOR RESTORING, REPAIRING, REINFORCING, PROTECTING, INSULATING AND/OR CLADDING STRUCTURES

(71) Applicant: CFS Concrete Forming Systems Inc., Vancouver (CA)

(72) Inventors: George David Richardson, Vancouver (CA); Semion Krivulin, Richmond (CA); Marc Daniel Kean Zinman, Vancouver (CA)

(73) Assignee: CFS Concrete Forming Systems Inc., Vancouver (CA)

( * ) Notice: Subject to any disclaimer, the term of this patent is extended or adjusted under 35 U.S.C. 154(b) by 73 days.

(21) Appl. No.: 17/390,724

(22) Filed: Jul. 30, 2021

(65) Prior Publication Data

US 2021/0355697 A1 Nov. 18, 2021

Related U.S. Application Data

(63) Continuation of application No. PCT/CA2020/050172, filed on Feb. 7, 2020.
(Continued)

(51) Int. Cl.
*E04G 23/02* (2006.01)

(52) U.S. Cl.
CPC ..... *E04G 23/0218* (2013.01)

(58) Field of Classification Search
CPC ..... E04G 23/0218; E04G 17/02; E04G 17/04; E04G 17/001; E04B 1/02; E04B 1/04;
(Continued)

(56) References Cited

U.S. PATENT DOCUMENTS 1,035,206 A 8/1912 Lewen
1,080,221 A 12/1913 Jester
(Continued)

FOREIGN PATENT DOCUMENTS

CA 574720 A 4/1959
CA 957816 A 11/1974
(Continued)

OTHER PUBLICATIONS

Vector Corrosion Technologies Marketing Materials, 2005.
(Continued)

*Primary Examiner* — Theodore V Adamos
(74) *Attorney, Agent, or Firm* — Todd A. Rattray; Oyen Wiggs Green & Mutala LLP

(57) ABSTRACT

A method for repairing a multi-sided structure protruding from a first surface. The method comprises mounting a retainer to the first surface, coupling a first brace connector component of a first brace to a first panel, coupling the first panel to a primary retainer connector component of the retainer, coupling a second brace connector component of the first brace to a secondary retainer connector component of the retainer, and introducing a curable material into the space between the first panel and the multi-sided structure, the first panel acting as at least a portion of a framework for containing the curable material until the curable material cures to provide a repair structure cladded, at least in part, by the first panel.

17 Claims, 25 Drawing Sheets

Related U.S. Application Data

(60) Provisional application No. 62/803,301, filed on Feb. 8, 2019.

(58) Field of Classification Search
CPC ..... E04B 1/16; E04B 1/63; E04B 2/64; E04B 2/68; E04B 2/84; E04B 2/86; E04B 2/28611; E04B 2/8623; E04B 2/8635; E04B 2/8652; E04B 2/8641; E04B 2002/867
See application file for complete search history.

(56) References Cited

U.S. PATENT DOCUMENTS 1,175,168 A 3/1916 Moulton
1,244,608 A 10/1917 Hicks
1,276,147 A 8/1918 White
1,345,156 A 6/1920 Dennis
1,423,879 A 7/1922 Potter
1,540,570 A 6/1925 Roberts
1,541,790 A 6/1925 Cheley et al.
1,547,190 A 7/1925 Zabinski
1,637,410 A 8/1927 Coryell
1,653,197 A 12/1927 Barnes
1,715,466 A 6/1929 Miller
1,820,897 A 8/1931 White et al.
1,875,242 A 8/1932 Hathaway
1,915,611 A 6/1933 Miller
1,963,153 A 6/1934 Schmieder
2,008,162 A 7/1935 Waddell
2,050,258 A 8/1936 Bemis
2,059,483 A 11/1936 Parsons
2,073,278 A 3/1937 Hohl
2,076,472 A 4/1937 London
2,164,681 A 7/1939 Fould
2,172,052 A 9/1939 Robbins
2,314,448 A 3/1943 Hoggatt
2,326,361 A 8/1943 Jacobsen
2,354,485 A 7/1944 Slaughter
2,845,685 A 8/1958 Lovgren et al.
2,861,277 A 11/1958 Hermann
2,871,619 A 2/1959 Walters
2,892,340 A 6/1959 Fort
2,928,115 A 3/1960 Hill
3,043,407 A 7/1962 Marryatt
3,063,122 A 11/1962 Katz
3,100,677 A 8/1963 Frank et al.
3,128,851 A 4/1964 Deridder et al.
3,152,354 A 10/1964 Diack
3,184,013 A 5/1965 Pavlecka
3,196,990 A 7/1965 Handley
3,199,258 A 8/1965 Jentoft et al.
3,220,151 A 11/1965 Goldman
3,242,834 A 3/1966 Sondheim
3,288,427 A 11/1966 Pluckebaum
3,291,437 A 12/1966 Bowden et al.
3,301,147 A 1/1967 Clayton et al.
3,321,884 A 5/1967 Klaue
3,385,182 A 5/1968 Harvey
3,385,183 A 5/1968 Kortz
3,468,088 A 9/1969 Miller
3,545,152 A 12/1970 Knohl
3,555,751 A 1/1971 Fhorgusen
3,555,762 A 1/1971 Costanzo, Jr.
3,588,027 A 6/1971 Bowden
3,667,177 A 6/1972 Biela
3,682,434 A 8/1972 Boenig
3,688,460 A 9/1972 Loghem et al.
3,748,260 A 7/1973 Hayes
3,760,544 A 9/1973 Hawes et al.
3,769,769 A 11/1973 Kohl
3,788,020 A 1/1974 Gregori
3,813,839 A 6/1974 Simpson et al.
3,822,557 A 7/1974 Frederick
3,886,705 A 6/1975 Cornland
3,951,294 A 4/1976 Wilson
3,959,940 A 6/1976 Ramberg
3,991,636 A 11/1976 Devillers
4,023,374 A 5/1977 Colbert et al.
4,060,945 A 12/1977 Wilson
4,067,155 A 1/1978 Ruff et al.
4,104,837 A 8/1978 Naito
4,106,233 A 8/1978 Horowitz
4,114,388 A 9/1978 Straub
4,162,640 A 7/1979 Arnold
4,180,956 A 1/1980 Gross
4,182,087 A 1/1980 Schall et al.
4,193,243 A 3/1980 Tiner
4,276,730 A 7/1981 Lewis
4,299,070 A 11/1981 Oltmanns et al.
4,315,309 A 2/1982 Coli
4,332,119 A 6/1982 Toews
4,351,870 A 9/1982 English
4,383,674 A 5/1983 Fricker
4,385,850 A 5/1983 Bobath
4,386,543 A 6/1983 Walker
4,430,831 A 2/1984 Kemp
4,433,522 A 2/1984 Yerushalmi
4,434,597 A 3/1984 Fischer
4,508,310 A 4/1985 Schultz
4,532,745 A 8/1985 Kinard
4,543,764 A 10/1985 Kozikowski
4,550,539 A 11/1985 Foster
4,553,875 A 11/1985 Casey
4,575,985 A 3/1986 Eckenrodt
4,581,864 A 4/1986 Shvakhman et al.
4,601,149 A 7/1986 Dokan
4,606,167 A 8/1986 Thorne
4,633,558 A 1/1987 Spaulding
4,664,560 A 5/1987 Cortlever
4,695,033 A 9/1987 Imaeda et al.
4,703,602 A 11/1987 Pardo
4,731,964 A 3/1988 Phillips
4,731,971 A 3/1988 Terkl
4,736,563 A 4/1988 Bilhorn
4,742,665 A 5/1988 Baierl
4,754,668 A 7/1988 Oetiker
4,808,039 A 2/1989 Fischer
4,856,754 A 8/1989 Yokota et al.
4,866,891 A 9/1989 Young
4,892,052 A 1/1990 Zook et al.
4,912,900 A 4/1990 Yeamans
4,913,576 A 4/1990 Grant
4,930,282 A 6/1990 Meadows
4,936,065 A 6/1990 Hutchinson
4,946,056 A 8/1990 Stannard
4,951,992 A 8/1990 Hockney
4,995,191 A 2/1991 Davis
5,014,480 A 5/1991 Guarriello et al.
5,028,368 A 7/1991 Grau
5,050,362 A 9/1991 Tai et al.
5,058,855 A 10/1991 Ward
5,078,360 A 1/1992 Spera
5,106,233 A 4/1992 Breaux
5,107,200 A 4/1992 Dohnal et al.
5,124,102 A 6/1992 Serafini
5,155,952 A 10/1992 Herwegh et al.
5,170,605 A 12/1992 Huddle
5,185,193 A 2/1993 Phenicie et al.
5,187,843 A 2/1993 Lynch
5,216,863 A 6/1993 Nessa et al.
5,243,805 A 9/1993 Fricker
5,247,773 A 9/1993 Weir
5,265,750 A 11/1993 Whiteley et al.
5,292,208 A 3/1994 Berger
5,311,718 A 5/1994 Trousilek
5,392,576 A 2/1995 Yeamans
5,465,545 A 11/1995 Trousilek
5,489,468 A 2/1996 Davidson
5,491,947 A 2/1996 Kim
5,513,474 A 5/1996 Scharkowski
5,516,863 A 5/1996 Abusleme et al.
5,553,430 A 9/1996 Majnaric et al.
5,591,265 A 1/1997 Tusch

(56) References Cited

U.S. PATENT DOCUMENTS 5,608,999 A 3/1997 McNamara
5,625,989 A 5/1997 Brubaker et al.
5,678,383 A 10/1997 Danielewicz
5,714,045 A 2/1998 Lasa et al.
5,729,944 A 3/1998 De Zen
5,735,097 A 4/1998 Cheyne
5,740,648 A 4/1998 Piccone
5,747,134 A 5/1998 Mohammed et al.
5,758,467 A 6/1998 Snear et al.
5,791,103 A 8/1998 Coolman et al.
5,816,010 A 10/1998 Conn
5,824,347 A 10/1998 Serafini
5,860,262 A 1/1999 Johnson
5,860,267 A 1/1999 Pervan
5,876,810 A 3/1999 Bodine et al.
5,953,880 A 9/1999 De Zen
5,987,830 A 11/1999 Worley
6,053,666 A 4/2000 Irvine et al.
6,151,856 A 11/2000 Shimonohara
6,161,989 A 12/2000 Kotani et al.
6,167,669 B1 1/2001 Lanc
6,167,672 B1 1/2001 Okitomo
6,178,711 B1 1/2001 Laird et al.
6,185,884 B1 2/2001 Myers et al.
6,189,269 B1 2/2001 De Zen
6,199,340 B1 3/2001 Davis
6,205,733 B1 3/2001 LaLonde
6,209,278 B1 4/2001 Tychsen
6,212,845 B1 4/2001 De Zen
6,219,984 B1 4/2001 Piccone
6,220,779 B1 4/2001 Warner et al.
6,226,950 B1 5/2001 Davis
6,247,280 B1 6/2001 Grinshpun et al.
6,286,281 B1 9/2001 Johnson
6,293,067 B1 9/2001 Meendering
6,357,196 B1 3/2002 McCombs
6,378,261 B1 4/2002 Agsten
6,387,309 B1 5/2002 Kojima et al.
6,405,508 B1 6/2002 Janesky
6,430,885 B1 8/2002 Ito
6,435,470 B1 8/2002 Lahham et al.
6,435,471 B1 8/2002 Piccone
6,438,918 B2 8/2002 Moore, Jr. et al.
6,467,136 B1 10/2002 Graham
6,530,185 B1 3/2003 Scott et al.
6,539,643 B1 4/2003 Gleeson
6,550,194 B2 4/2003 Jackson et al.
6,584,748 B2 7/2003 Bresnahan
6,588,165 B1 7/2003 Wright
6,622,452 B2 9/2003 Alvaro
6,647,689 B2 11/2003 Pletzer et al.
6,691,976 B2 2/2004 Myers et al.
6,694,692 B2 2/2004 Piccone
6,711,870 B1 3/2004 Richardson
6,832,456 B1 12/2004 Bilowol
6,866,445 B2 3/2005 Semler
6,935,081 B2 8/2005 Dunn et al.
7,007,433 B2 3/2006 Boyer
7,188,576 B2 3/2007 Bogard et al.
7,320,201 B2 1/2008 Kitchen et al.
7,406,801 B2 8/2008 Zeng et al.
7,415,801 B2 8/2008 Zeng et al.
7,444,788 B2 11/2008 Morin et al.
7,584,583 B2 9/2009 Bergelin et al.
7,763,345 B2 7/2010 Chen et al.
7,765,762 B2 8/2010 Gulbrandsen et al.
7,818,936 B2 10/2010 Morin et al.
7,900,416 B1 3/2011 Yokubison et al.
7,901,537 B2 3/2011 Jones et al.
8,071,193 B2 12/2011 Windmöller
8,074,418 B2 12/2011 Thiagarajan et al.
8,099,921 B2 1/2012 Muehlebach
8,202,460 B2 6/2012 Koburger, III et al.
8,316,598 B2 11/2012 Flynn et al.
8,322,102 B2 12/2012 Krieger
8,485,493 B2 7/2013 Wells et al.
8,544,232 B2 10/2013 Wybo et al.
8,555,590 B2 10/2013 Richardson et al.
8,646,237 B1 2/2014 Takagi
8,707,648 B2 4/2014 Timko et al.
8,769,904 B1 7/2014 Brandt et al.
8,793,953 B2 8/2014 Richardson et al.
8,806,839 B2 8/2014 Zhou et al.
8,859,898 B2 10/2014 Frye
8,881,483 B2 11/2014 Caboni
8,925,275 B2 1/2015 Meersseman et al.
8,959,871 B2 2/2015 Parenti et al.
8,985,888 B2 3/2015 Kawasaki
8,992,131 B2 3/2015 Castonguay et al.
9,003,737 B2 4/2015 Solomon et al.
9,156,233 B2 10/2015 Dossche et al.
9,206,614 B2 12/2015 Richardson et al.
9,328,517 B2 5/2016 Bilge
9,328,518 B2 5/2016 Bilge
9,347,226 B2 5/2016 Ouellet
9,441,365 B2 9/2016 Richardson et al.
9,453,345 B2 9/2016 Richardson et al.
9,745,758 B2 8/2017 Baert et al.
9,850,658 B2 12/2017 Ordaz
9,913,083 B2 3/2018 Rosendahl
9,993,340 B2 6/2018 Foroni et al.
10,246,883 B2 4/2019 Derelov
10,287,777 B2 5/2019 Boo
10,400,457 B2 9/2019 Simon
10,480,186 B2 11/2019 Tanguay et al.
10,563,410 B2 2/2020 Horton et al.
10,619,357 B2 4/2020 Segaert et al.
10,731,333 B2 8/2020 Richardson et al.
2002/0095895 A1 7/2002 Daly et al.
2003/0005659 A1 1/2003 Moore
2003/0085482 A1 5/2003 Sincock et al.
2003/0155683 A1 8/2003 Pietrobon
2004/0010994 A1 1/2004 Piccone
2004/0020149 A1 2/2004 Messiqua
2004/0093817 A1 5/2004 Barcons
2004/0216408 A1 11/2004 Hohmann
2005/0016083 A1 1/2005 Morin et al.
2005/0016103 A1* 1/2005 Piccone ..... E04B 2/8641 52/489.1
2005/0055938 A1 3/2005 Secondino
2005/0204661 A1 9/2005 Showers et al.
2006/0179762 A1 8/2006 Thome et al.
2006/0185270 A1 8/2006 Handley et al.
2006/0185291 A1 8/2006 Mathe
2006/0213140 A1 9/2006 Morin et al.
2006/0251865 A1 11/2006 Hintemeder
2007/0028544 A1 2/2007 Messiqua et al.
2007/0044416 A1 3/2007 Dijk
2007/0107341 A1 5/2007 Zhu
2007/0193169 A1 8/2007 Emblin
2008/0163664 A1 7/2008 Battenfeld
2008/0168734 A1 7/2008 Degen et al.
2009/0120027 A1 5/2009 Amend
2009/0229214 A1 9/2009 Nelson
2009/0269130 A1 10/2009 Williams
2010/0011695 A1 1/2010 Cheng et al.
2010/0047608 A1 2/2010 Seccombe
2010/0050552 A1 3/2010 Richardson et al.
2010/0071304 A1 3/2010 Richardson et al.
2010/0212241 A1 8/2010 Holroyd
2010/0251657 A1 10/2010 Richardson et al.
2010/0275547 A1 11/2010 Kamata
2010/0325984 A1 12/2010 Richardson et al.
2011/0000161 A1 1/2011 Aube et al.
2011/0099932 A1 5/2011 Saulce
2011/0131914 A1 6/2011 Richardson et al.
2011/0146189 A1 6/2011 Courey
2011/0277410 A1* 11/2011 Richardson ..... E04G 23/0218 52/426
2012/0014745 A1 1/2012 Rosendahl
2012/0056344 A1* 3/2012 Richardson ..... E04G 17/02 264/35
2012/0121337 A1 5/2012 Richardson et al.
2012/0192515 A1 8/2012 Petta

(56) References Cited

U.S. PATENT DOCUMENTS

| | | | |
|---|---|---|---|
| 2013/0081345 | A1 | 4/2013 | Sheehy |
| 2014/0013563 | A1 | 1/2014 | Richardson et al. |
| 2014/0305063 | A1 | 10/2014 | Kim |
| 2015/0082724 | A1 | 3/2015 | Amend |
| 2015/0135635 | A1* | 5/2015 | Richardson ..... E04G 23/0218 52/750 |
| 2016/0289960 | A1 | 10/2016 | Darwell |
| 2016/0340899 | A1 | 11/2016 | Piccone |
| 2016/0376799 | A1 | 12/2016 | Richardson et al. |
| 2017/0218627 | A1 | 8/2017 | Neil |
| 2017/0226740 | A1 | 8/2017 | Boettcher |
| 2019/0032341 | A1 | 1/2019 | Fleet |
| 2020/0080306 | A1 | 3/2020 | Richardson et al. |
| 2020/0131780 | A1 | 4/2020 | De Rick |
| 2020/0340254 | A1 | 10/2020 | De Rick |
| 2022/0025656 | A1 | 1/2022 | Carpentier et al. |

FOREIGN PATENT DOCUMENTS

| | | | |
|---|---|---|---|
| CA | 1316366 | C | 4/1993 |
| CA | 2070079 | C | 11/1993 |
| CA | 2097226 | C | 11/1994 |
| CA | 2141463 | C | 8/1996 |
| CA | 2215939 | C | 11/1996 |
| CA | 2170681 | A1 | 8/1997 |
| CA | 2226497 | C | 11/1997 |
| CA | 2218600 | C | 6/1998 |
| CA | 2243905 | C | 1/2000 |
| CA | 2255256 | C | 1/2000 |
| CA | 2244537 | C | 2/2000 |
| CA | 2418885 | A1 | 8/2003 |
| CA | 2502343 | C | 5/2004 |
| CA | 2502392 | C | 5/2004 |
| CA | 2499450 | A1 | 9/2005 |
| CA | 2577217 | A1 | 1/2006 |
| CA | 2629202 | A1 | 4/2008 |
| CA | 2716118 | A1 | 8/2008 |
| CA | 2681963 | C | 10/2008 |
| CA | 2654992 | | 8/2010 |
| CA | 2751134 | A1 | 12/2011 |
| CA | 2855742 | C | 5/2013 |
| CA | 2810538 | A1 | 9/2014 |
| CA | 2979918 | A1 | 3/2018 |
| CH | 317758 | A | 1/1957 |
| CH | 401422 | A | 10/1965 |
| CH | 669235 | A5 | 2/1989 |
| CN | 2272915 | Y | 1/1998 |
| CN | 2529936 | Y | 1/2003 |
| CN | 105781053 | A | 7/2016 |
| DE | 1812590 | A | 6/1970 |
| DE | 1684357 | B2 | 4/1971 |
| DE | 2062723 | A | 8/1972 |
| DE | 3003446 | C1 | 8/1981 |
| DE | 3202385 | A1 | 8/1983 |
| DE | 3234489 | C2 | 3/1984 |
| DE | 3727956 | A1 | 5/1988 |
| DE | 3918676 | A1 | 8/1990 |
| DE | 19503948 | A1 | 8/1996 |
| DE | 29803155 | U1 | 6/1998 |
| DE | 20017114 | U1 | 1/2001 |
| DE | 202014006376 | U1 | 12/2014 |
| DE | 202018104844 | U1 | 11/2018 |
| DE | 202018107451 | U1 | 4/2019 |
| EP | 25420 | B1 | 3/1981 |
| EP | 55504 | B1 | 7/1982 |
| EP | 141782 | B1 | 5/1985 |
| EP | 179046 | A2 | 4/1986 |
| EP | 381339 | A2 | 8/1990 |
| EP | 0328228 | B1 | 6/1991 |
| EP | 757137 | A1 | 2/1997 |
| EP | 735226 | B1 | 8/1999 |
| EP | 1854937 | A1 | 11/2007 |
| EP | 2169133 | A2 | 3/2010 |
| EP | 2799643 | A2 | 11/2014 |
| FR | 507787 | A | 9/1920 |
| FR | 1381945 | A | 12/1964 |
| FR | 1603005 | A | 3/1971 |
| FR | 2364314 | A1 | 4/1978 |
| FR | 2535417 | B1 | 5/1984 |
| FR | 2669364 | A1 | 5/1992 |
| FR | 2717848 | B1 | 9/1995 |
| FR | 2721054 | B1 | 12/1995 |
| FR | 2733264 | A1 | 10/1996 |
| GB | 137221 | A | 1/1920 |
| GB | 779916 | A | 7/1957 |
| GB | 1243173 | A | 8/1971 |
| GB | 1253447 | A | 11/1971 |
| GB | 1408868 | A | 10/1975 |
| GB | 2141661 | A1 | 1/1985 |
| GB | 2205624 | A | 12/1988 |
| JP | 9041612 | A | 2/1997 |
| JP | 2008223335 | A | 9/2008 |
| JP | 5133028 | B2 | 5/2009 |
| NL | 2013486 | B1 | 9/2016 |
| SE | 206538 | C | 8/1966 |
| WO | 8204088 | A1 | 11/1982 |
| WO | 9500724 | A1 | 1/1995 |
| WO | 9607799 | A1 | 3/1996 |
| WO | 9635845 | A1 | 11/1996 |
| WO | 9743496 | A1 | 11/1997 |
| WO | 163066 | A1 | 8/2001 |
| WO | 173240 | A1 | 10/2001 |
| WO | 3006760 | | 1/2003 |
| WO | 2004083558 | A1 | 9/2004 |
| WO | 2004088064 | A1 | 10/2004 |
| WO | 2005040526 | A1 | 5/2005 |
| WO | 2008074926 | A1 | 6/2008 |
| WO | 2008119178 | A1 | 10/2008 |
| WO | 2009059410 | A1 | 5/2009 |
| WO | 2009092158 | A1 | 7/2009 |
| WO | 2010012061 | A1 | 2/2010 |
| WO | 2010037211 | A1 | 4/2010 |
| WO | 2010078645 | A1 | 7/2010 |
| WO | 2010094111 | A1 | 8/2010 |
| WO | 2012003587 | A1 | 1/2012 |
| WO | 2013075250 | A1 | 5/2013 |
| WO | 2013075251 | A1 | 5/2013 |
| WO | 2013102274 | A1 | 7/2013 |
| WO | 2013102275 | A1 | 7/2013 |
| WO | 2013177715 | A1 | 12/2013 |
| WO | 2013188980 | A1 | 12/2013 |
| WO | 2014121337 | A1 | 8/2014 |
| WO | 2015081445 | A1 | 6/2015 |
| WO | 2015149187 | A1 | 10/2015 |
| WO | 2017113016 | A1 | 7/2017 |
| WO | 2017/132477 | A1 | 8/2017 |
| WO | 2018009126 | A1 | 1/2018 |
| WO | 2018184103 | A1 | 10/2018 |
| WO | 2019119159 | A1 | 6/2019 |
| WO | 2019/197393 | A1 | 10/2019 |
| WO | 2020160684 | A1 | 8/2020 |

OTHER PUBLICATIONS

Vector Corrosion Technologies Marketing Materials, 2007.
Vector Corrosion Technologies Marketing Materials, 2008.
The Digigraph System, http://www.digigraph-housing.com/web/system.ht, accessed online Jan. 2012.
Digigraph Brochure, Building Systems using PVC extrusions and concrete, accessed online Jan. 2012.
Digigraph Guide, Digigraph Systems Inc., Installation Guide for the Digigraph Construction System Composed of PVC Extrusions and Concrete, accessed online Jan. 2012.

* cited by examiner

RETAINERS FOR RESTORING, REPAIRING, REINFORCING, PROTECTING, INSULATING AND/OR CLADDING STRUCTURES

RELATED APPLICATIONS

This application is a continuation of Patent Cooperation Treaty (PCT) application No. PCT/CA2020/050172 filed 7 Feb. 2020 which in turn claims the benefit of the priority of U.S. patent application No. 62/803,301 filed 8 Feb. 2019 which is hereby incorporated herein by reference. Both of the applications referred to in the paragraph are herein incorporated herein by reference.

TECHNICAL FIELD

This application relates to methods and apparatus (systems) for restoring, repairing, reinforcing, protecting, insulating and/or cladding a variety of structures. Some embodiments provide stay-in-place liners (or portions thereof) for containing concrete or other curable material(s). Some embodiments provide stay-in-place liners (or portions thereof) which line interior surfaces of supportive formworks and which are anchored to curable materials as they are permitted to cure.

BACKGROUND

Concrete is used to construct a variety of structures, such as building walls and floors, bridge supports, dams, structures, raised platforms and the like. Typically, concrete structures are formed using embedded reinforcement bars (often referred to as rebar) or similar steel reinforcement material, which provides the resultant structure with increased strength. Over time, corrosion of the embedded reinforcement material can impair the integrity of the embedded reinforcement material, the surrounding concrete and the overall structure. Similar degradation of structural integrity can occur with or without corrosion over sufficiently long periods of time, in structures subject to large forces, in structures deployed in harsh environments, in structures coming into contact with destructive materials or the like.

FIGS. 1A, 1B and 1C show partial cross-sectional views of an exemplary damaged structure 10. Exemplary structure 10 includes a first portion (e.g. a wall) 12A having a surface 14A and a multi-sided structure 12B protruding in inward-outward direction 123 from surface 14A of first portion 12A. Multi-sided structure 12B may be, for example, a pilaster, a column or the like. Multi-sided structure 12B may be structural or may be ornamental. Multi-sided structure 12B may have two sides, three sides or more sides. Multi-sided structure 12B may be rounded (e.g. it could have a semi-circle cross-section in the FIG. 1C view), relatively squared as depicted in FIGS. 1A, 1B and 1C or of any suitable shape. In the illustrated embodiment, three-sided structure 12B has a first surface 14B-1 extending non-parallel from surface 14A of first portion 12A, a second surface 14B-2 extending non-parallel from first surface 14B-1 of multi-sided structure 12B and a third surface 14B-3 extending non-parallel from and between surface 14A and second surface 14B-2 (surfaces 14B-1, 14B-2, 14B-3 are collectively referred to herein as surface(s) 14B). Surfaces 14B of three-sided structure 12B are damaged in regions 16A, 16B, 16C, 16D. In the illustrated example of FIGS. 1A, 1B and 1C, damaged regions 16A, 16B, 16C, 16D represent regions where surface 14B is indented—i.e. the damage to structure 10 has changed the cross-sectional shape of multi-sided structure 12B in damaged regions 16A, 16B, 16C, 16D.

There is a desire for methods and apparatus for repairing and/or restoring existing structures which have been degraded or which are otherwise in need of repair and/or restoration.

There is a desire for methods and apparatus for repairing and/or restoring existing multi-sided structures such as pilasters and columns which extend from a surface where the multi-sided structure has been degraded or which are otherwise in need of repair and/or restoration.

In some situations, multi-sided structure 12B may not have sufficient structural rigidity to support a repair structure mounted directly to structure 12B (e.g. in the case that multi-sided structure 12B is ornamental). In some situations, surfaces 14B may be sufficiently damaged that it would be undesirable to mount a repair structure directly to any of surfaces 14B.

There is a desire for methods and apparatus for repairing and/or restoring existing multi-sided structures such as pilasters and columns which extend from a surface where the multi-sided structure has been degraded or which are otherwise in need of repair and/or restoration and where the multi-sided structure is not sufficiently strong or has sufficient degradation that a repair structure cannot be directly mounted to the multi-sided structure itself.

Portions 12A of structure 10 respectively form inside corners 20A, 20B with multi-sided structure 12B. Portion 12A may constrain the ability to work in a vicinity of multi-sided structure 12B and, in particular, in a vicinity of surface 14B which is in need of repair and/or restoration.

Exemplary structure 10 also includes portions 18A, 18B on opposing sides of portions 12A, 12B. In the case where portions 12A, 12B are walls, portions 18A, 18B may represent a floor and ceiling, for example. Portions 18A, 18B of structure 10 respectively form inside corners 22A, 22B with portions 12A, 12B. Portions 18A, 18B constrain the ability to work in a vicinity of portions 12A, 12B and, in particular, in a vicinity of surface 14B which is in need of repair and/or restoration. For example, it may not be possible to access surface 14B of multi-sided structure 12B by moving in one or more directions parallel with surface 14B from one side of portion 18A (or 18B) to the opposing side of portion 18A (or 18B). Instead, it may be necessary or desirable to access surface 14A from a direction normal to surface 14B (e.g. in directions 21 or 23 (FIG. 1A)).

There is a general desire to repair and/or restore existing structures wherein there are constraints on the ability to access the portion(s) and/or surface(s) of the existing structures.

Constraints on access to existing structures (and/or portion(s) and/or surface(s) thereof) in need of repair and/or restoration are not limited to constraints imposed by other portions of the same structure, as is the case of exemplary structure 10 of FIGS. 1A and 1B. Access to existing structures may be limited by other constraints, such as, by way of non-limiting example, the ground, a body of water, other structures and/or the like.

Some structures have been fabricated with inferior or sub-standard structural integrity. By way of non-limiting example, some older structures may have been fabricated in accordance with seismic engineering specifications that are lower than, or otherwise lack conformity with, current seismic engineering standards. There is a desire to reinforce existing structures to upgrade their structural integrity or other aspects thereof. There is a corresponding desire to reinforce existing structures wherein there are constraints on the ability to access portion(s) and/or surface(s) of the existing structures.

There is also a desire to protect existing structures from damage which may be caused by, or related to, the environments in which the existing structures are deployed and/or the materials which come into contact with the existing structures. By way of non-limiting example, structures fabricated from metal or concrete can be damaged when they are deployed in environments that are in or near salt water or in environments where the structures are exposed to salt or other chemicals (and/or biochemicals) used to de-ice roads. There is a corresponding desire to protect existing structures wherein there are constraints on the ability to access portion(s) and/or surface(s) of the existing structures.

Previously known techniques for repairing, restoring, reinforcing, protecting, insulating and/or cladding existing structures often are difficult and time-consuming to implement. There is a general desire to repair, restore, reinforce, protect, insulate and/or clad existing structures in a simple and time-efficient manner.

The desire to repair, restore, reinforce and/or protect existing structures is not limited to concrete structures. There are similar desires for existing structures fabricated from other materials.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides a method for repairing a multi-sided structure protruding from a first surface to cover at least a portion of the multi-sided structure with a repair structure. The method comprises mounting a retainer to the first surface, coupling a first brace connector component of a first brace to a first panel, the first brace extending non-parallel and non-orthogonal to the first panel, coupling the first panel to a primary retainer connector component of the retainer, the first panel extending generally non-parallel to the first surface such that a tangential plane of the first panel is facing, and spaced apart from, a second surface of the multi-sided structure to provide a space between the first panel and the multi-sided structure, coupling a second brace connector component of the first brace to a secondary retainer connector component of the retainer, the first brace extending non-parallel and non-orthogonal to the retainer and introducing a curable material into the space between the first panel and the multi-sided structure, the first panel acting as at least a portion of a framework for containing the curable material until the curable material cures to provide a repair structure cladded, at least in part, by the first panel.

In some embodiments, the method comprises coupling the first brace connector component of the first brace to the first panel before coupling the first panel to the retainer. In some embodiments, the method comprises coupling the first panel to the retainer and concurrently coupling the second brace connector component of the first brace to the retainer. In some embodiments, the method comprises comprising coupling the first panel to the retainer after coupling the second brace connector component of the first brace to the retainer. In some embodiments, the method comprises coupling the first panel to the retainer before coupling the second brace connector component of the first brace to the retainer.

In some embodiments, coupling the first panel to the retainer comprises forcing the first panel in an inward direction toward the primary retainer connector of the retainer to form a panel-retainer connection.

In some embodiments, forming the panel-retainer connection comprises extending a protrusion of the primary retainer connector component of the retainer into a receptacle of a first panel connector component of the first panel, the receptacle shaped to prevent removal of the protrusion from the receptacle and the receptacle resiliently deformed by the extension of the protrusion into the receptacle to thereby apply a restorative force to the protrusion to maintain the panel-retainer connection. In some embodiments, forming the panel-retainer connection comprises extending a protrusion of a first panel connector component of the first panel into a receptacle of the primary retainer connector component of the retainer, the receptacle shaped to prevent removal of the protrusion from the receptacle and the receptacle resiliently deformed by the extension of the protrusion into the receptacle to thereby apply a restorative force to the protrusion to maintain the panel-retainer connection.

In some embodiments, coupling the first brace to the retainer comprises forcing the first brace in an inward direction toward the secondary retainer connector of the retainer to form a brace-retainer connection.

In some embodiments, forming the brace-retainer connection comprises extending a protrusion of the second brace connector component of the first brace into a receptacle of the secondary retainer connector component of the retainer, the receptacle shaped to prevent removal of the protrusion from the receptacle and the receptacle resiliently deformed by the extension of the protrusion into the receptacle to thereby apply a restorative force to the protrusion to maintain the brace-retainer connection.

In some embodiments, forming the panel-retainer connection comprises extending a protrusion of the secondary retainer connector component of the retainer into a receptacle of the second brace connector component of the first brace, the receptacle shaped to prevent removal of the protrusion from the receptacle and the receptacle resiliently deformed by the extension of the protrusion into the receptacle to thereby apply a restorative force to the protrusion to maintain the brace-retainer connection.

In some embodiments, forcing the first brace in the inward direction toward the secondary retainer connector of the retainer to form the brace-retainer connection comprises applying force to a shoulder or surface of the second retainer connector component with a tool (e.g. a crowbar, hammer, block of wood, etc.) and wherein the second retainer connector component comprises one or more sidewalls for aligning the tool with the shoulder or surface.

In some embodiments, coupling the first brace connector component of the first brace to the first panel comprises sliding the first brace connector in a longitudinal direction relative to a third panel connector component to form a panel-brace connection.

In some embodiments, forming the panel-brace connection comprises sliding a projection of the third panel connector component into a channel of the first brace connector in the longitudinal direction.

In some embodiments, forming the panel-brace connection comprises sliding a projection of the first brace connector into a channel of the third panel connector component in the longitudinal direction.

In some embodiments, the retainer comprises a base and the primary and secondary retainer connector components each extend in an outward direction, opposite the inward direction, from the base. In some embodiments, the primary retainer connector component is separated from the secondary retainer connector component in a transverse direction by a spacing. In some embodiments, the primary and secondary retainer connector components are integral to the base.

In some embodiments, the base of the retainer comprises one or more mounting features located in the spacing and mounting the retainer to the first surface comprises mounting the retainer to the first surface of using the one or more mounting features. In some embodiments, the one or more mounting features comprises one or more apertures and mounting the retainer to the first surface comprises passing one or more fasteners through the one or more apertures and into the first surface.

In some embodiments, the first brace extends from the first panel at an angle between 20° and 70°. In some embodiments, the first brace extends from the first panel at an angle between 40° and 50°. In some embodiments, the first brace extends from the first panel at an angle of approximately 45°. In some embodiments, the first brace extends from the retainer at an angle between 20° and 70°. In some embodiments, the first brace extends from the retainer at an angle between 40° and 50°. In some embodiments, the first brace extends from the retainer at an angle of approximately 45°.

In some embodiments, the first panel extending generally non-parallel to the first surface such that the tangential plane of the first panel is facing, and spaced apart from, the second surface of the multi-sided structure comprises the first panel extending generally normal to the first surface such that the tangential plane of the first panel is generally parallel to, and spaced apart from, the second surface of the multi-sided structure.

In some embodiments, the space between the first panel and the multi-sided structure comprises a space between the first panel and the second surface of the multi-sided structure. In some embodiments, the first panel extending generally non-parallel to the first surface comprises the first panel extending generally normal to the first surface.

In some embodiments, the multi-sided structure comprises a pilaster. In some embodiments, the multi-sided structure comprises a column. In some embodiments, the multi-sided structure is ornamental.

In some embodiments, the method comprises connecting a second panel to the first panel by forcing a first panel connector component of the second panel in an inward direction toward a second panel connector of the first panel to form a panel-panel connection.

In some embodiments, the method comprises connecting a number, n, of panels to the first panel by forcing a first panel connector component of an $i^{th}$ panel in an inward direction toward a second panel connector of an $(i-1)^{th}$ panel to form a panel-panel connection, where n is any positive integer and i is a count from two to n+1. In some embodiments, the method comprises connecting a second retainer to a second panel connector of the $n+1^{th}$ panel. In some embodiments, connecting the $n+1^{th}$ panel to the second retainer comprises forcing the $n+1^{th}$ panel in an inward direction toward a primary retainer connector of the second retainer to form a second panel-retainer connection. In some embodiments, forming the second panel-retainer connection comprises extending a protrusion of the second panel connector component of the $n+1^{th}$ panel into a receptacle of the primary retainer connector component of the second retainer, the receptacle shaped to prevent removal of the protrusion from the receptacle and the receptacle resiliently deformed by the extension of the protrusion into the receptacle to thereby apply a restorative force to the protrusion to maintain the second panel-retainer connection. In some embodiments, forming the panel-retainer connection comprises extending a protrusion of the primary retainer connector component of the second retainer into a receptacle of the second panel connector component of the $n+1^{th}$ panel, the receptacle shaped to prevent removal of the protrusion from the receptacle and the receptacle resiliently deformed by the extension of the protrusion into the receptacle to thereby apply a restorative force to the protrusion to maintain the second panel-retainer connection.

In some embodiments, the method comprises mounting the second retainer to the first surface.

In some embodiments, the method comprises coupling a first brace connector component of a second brace to the $n+1^{th}$ panel, the second brace extending non-parallel and non-orthogonal to the $n+1^{th}$ panel and coupling a second brace connector component of the second brace to a secondary connector component of the second retainer, the second brace extending non-parallel and non-orthogonal to the second retainer.

In some embodiments, the method comprises connecting a standoff to the $i^{th}$ panel by connecting a first standoff connector component to a third connector of the $i^{th}$ panel, deforming the standoff such that a transverse spacing between the first standoff connector component of the standoff and a second standoff connector component of the standoff is approximately equal to a transverse spacing between the third connector of the $i^{th}$ panel and a fourth connector of the $i^{th}$ panel and connecting the second standoff connector component to the fourth connector of the $i^{th}$ panel.

In some embodiments, coupling the first standoff connector component to the third connector component of the $i^{th}$ panel comprises sliding the first standoff connector component in a longitudinal direction relative to the third panel connector component of the $i^{th}$ panel to form a first panel-standoff connection. In some embodiments, forming the first panel-standoff connection comprises sliding a projection of the third panel connector component of the $i^{th}$ panel into a channel of the first standoff connector component in the longitudinal direction. In some embodiments, forming the first panel-standoff connection comprises sliding a projection of the first standoff connector component into a channel of the third panel connector component of the $i^{th}$ panel in the longitudinal direction. In some embodiments, coupling the second standoff connector component to the fourth connector component of the $i^{th}$ panel comprises sliding the second standoff connector component in a longitudinal direction relative to the fourth panel connector component of the $i^{th}$ panel to form a second panel-standoff connection. In some embodiments, forming the second panel-standoff connection comprises sliding a projection of the fourth panel connector component of the $i^{th}$ panel into a channel of the second standoff connector component in the longitudinal direction. In some embodiments, forming the second panel-standoff connection comprises sliding a projection of the second standoff connector component into a channel of the fourth panel connector component of the $i^{th}$ panel in the longitudinal direction.

In some embodiments, when the panel-retainer connection is formed, the primary retainer connector of the retainer and the first and second panel connectors of the first panel are each offset from the tangential plane of the first panel.

Another aspect of the invention provides an apparatus for repairing a multi-sided structure protruding from a first surface to cover at least a portion of a surface of the multi-sided structure with a repair structure. The apparatus comprises a retainer mounted to the first surface, a first brace connector component of a first brace coupled to a first panel, the first brace extending non-parallel and non-orthogonal to the first panel, the first panel coupled to a primary retainer connector component of the retainer. The first panel extending generally non-parallel to the first surface such that a tangential plane of the first panel is generally facing, and spaced apart from, a second surface of the multi-sided structure to provide a space between the first panel and the multi-sided structure. A second brace connector component of the first brace is coupled to a secondary retainer connector component of the retainer, the first brace extending non-parallel and non-orthogonal to the retainer. A curable material is provided in the space between the first panel and the multi-sided structure, the first panel acting as at least a portion of a framework for containing the curable material until the curable material cures to provide a repair structure cladded, at least in part, by the first panel.

In some embodiments, the first brace connector component of the first brace is coupled to the first panel before coupling the first panel to the retainer. In some embodiments, the first panel is concurrently coupled to the retainer and the second brace connector component of the first brace. In some embodiments, the first panel is coupled to the retainer after the second brace connector component of the first brace is coupled to the retainer. In some embodiments, the first panel is coupled to the retainer before the second brace connector component of the first brace is coupled to the retainer.

In some embodiments, the first panel is coupled to the retainer by forcing the first panel in an upward direction toward the primary retainer connector of the retainer to form a panel-retainer connection.

In some embodiments, the panel-retainer connection comprises a protrusion of the primary retainer connector component of the retainer extended into a receptacle of a first panel connector component of the first panel, the receptacle shaped to prevent removal of the protrusion from the receptacle and the receptacle resiliently deformed by the extension of the protrusion into the receptacle to thereby apply a restorative force to the protrusion to maintain the panel-retainer connection.

In some embodiments, the panel-retainer connection comprises a protrusion of the primary retainer connector component of the first panel extended into a receptacle of the primary retainer connector component of the retainer, the receptacle shaped to prevent removal of the protrusion from the receptacle and the receptacle resiliently deformed by the extension of the protrusion into the receptacle to thereby apply a restorative force to the protrusion to maintain the panel-retainer connection.

In some embodiments, the first brace is coupled to the retainer by the first brace being forced in an inward direction toward the secondary retainer connector of the retainer to form a brace-retainer connection.

In some embodiments, the brace-retainer connection comprises a protrusion of the second brace connector component of the first brace extended into a receptacle of the secondary retainer connector component of the retainer, the receptacle shaped to prevent removal of the protrusion from the receptacle and the receptacle resiliently deformed by the extension of the protrusion into the receptacle to thereby apply a restorative force to the protrusion to maintain the brace-retainer connection.

In some embodiments, the panel-retainer connection comprises a protrusion of the secondary retainer connector component of the retainer extended into a receptacle of the second brace connector component of the first brace, the receptacle shaped to prevent removal of the protrusion from the receptacle and the receptacle resiliently deformed by the extension of the protrusion into the receptacle to thereby apply a restorative force to the protrusion to maintain the brace-retainer connection.

In some embodiments, the second retainer connector component comprises a shoulder or surface and one or more sidewalls for aligning a tool (e.g. a crowbar, hammer, block of wood, etc.) with the shoulder or surface, the first brace being forced in an inward direction toward the secondary retainer connector of the retainer to form a brace-retainer connection comprises applying force to the shoulder or surface of the second retainer connector component with the tool.

In some embodiments, the first brace connector component of the first brace being coupled to a first panel comprises the first brace connector the first brace connector being slid in a longitudinal direction relative to a third panel connector component to form a panel-brace connection.

In some embodiments, the panel-brace connection comprises a projection of the third panel connector component being slid into a channel of the first brace connector in the longitudinal direction. In some embodiments, the panel-brace connection comprises a projection of the first brace connect being slid into a channel of the third panel connector component in the longitudinal direction.

In some embodiments, wherein the retainer comprises a base and the primary and secondary retainer connector components each extend in an outward direction, opposite the inward direction, from the base. In some embodiments, the primary retainer connector component is separated from the secondary retainer connector component in a transverse direction by a spacing. In some embodiments, the primary and secondary retainer connector components are integral to the base.

In some embodiments, the base of the retainer comprises one or more mounting features located in the spacing and the retainer is mounted to the first surface through the one or more mounting features. In some embodiments, the one or more mounting features comprises one or more apertures and the retainer is mounted to the first surface by passing one or more fasteners through the one or more apertures and into the first surface.

In some embodiments, the first brace extends from the first panel at an angle between 20° and 70°. In some embodiments, the first brace extends from the first panel at an angle between 40° and 50°. In some embodiments, the first brace extends from the first panel at an angle of approximately 45°. In some embodiments, the first brace extends from the retainer at an angle between 20° and 70°. In some embodiments, the first brace extends from the retainer at an angle between 40° and 50°. In some embodiments, the first brace extends from the retainer at an angle of approximately 45°.

In some embodiments, the first panel extends generally non-parallel to the first surface such that the tangential plane of the first panel is facing, and spaced apart from, the second surface of the multi-sided structure comprises the first panel extending generally normal to the first surface such that the tangential plane of the first panel is generally parallel to, and spaced apart from, the second surface of the multi-sided structure.

In some embodiments, the space between the first panel and the multi-sided structure comprises a space between the first panel and the second surface of the multi-sided structure. In some embodiments, the first panel extends generally non-parallel to the first surface comprises the first panel extending generally normal to the first surface.

In some embodiments, wherein the multi-sided structure comprises a pilaster. In some embodiments, the multi-sided structure comprises a column. In some embodiments, the multi-sided structure is ornamental.

In some embodiments, the apparatus comprises a second panel connected to the first panel by forcing a first panel connector component of the second panel in an inward direction toward a second panel connector of the first panel to form a panel-panel connection.

In some embodiments, the apparatus comprises a number, n, of panels connected to the first panel by forcing a first panel connector component of an $i^{th}$ panel in an inward direction toward a second panel connector of an $(i-1)^{th}$ panel to form a panel-panel connection, where n is any positive integer and i is a count from two to n+1. In some embodiments, the apparatus comprises a second retainer connected to a second panel connector of the $n+1^{th}$ panel. In some embodiments, the $n+1^{th}$ panel is connected to the second retainer comprises forcing the $n+1^{th}$ panel in an inward direction toward a primary retainer connector of the second retainer to form a second panel-retainer connection.

In some embodiments, the second panel-retainer connection comprises a protrusion of the second panel connector component of the $n+1^{th}$ panel extended into a receptacle of the primary retainer connector component of the second retainer, the receptacle shaped to prevent removal of the protrusion from the receptacle and the receptacle resiliently deformed by the extension of the protrusion into the receptacle to thereby apply a restorative force to the protrusion to maintain the second panel-retainer connection.

In some embodiments, the panel-retainer connection comprises a protrusion of the primary retainer connector component of the second retainer extended into a receptacle of the second panel connector component of the $n+1^{th}$ panel, the receptacle shaped to prevent removal of the protrusion from the receptacle and the receptacle resiliently deformed by the extension of the protrusion into the receptacle to thereby apply a restorative force to the protrusion to maintain the second panel-retainer connection.

In some embodiments, the second retainer is mounted to the first surface.

In some embodiments, a first brace connector component of a second brace is coupled to the $n+1^{th}$ panel, the second brace extending non-parallel and non-orthogonal to the $n+1^{th}$ panel and a second brace connector component of the second brace is coupled to a secondary connector component of the second retainer, the second brace extending non-parallel and non-orthogonal to the second retainer.

In some embodiments, a standoff is connected to the $i^{th}$ panel by, connecting a first standoff connector component to a third connector of the $i^{th}$ panel, deforming the standoff such that a transverse spacing between the first standoff connector component of the standoff and a second standoff connector component of the standoff is approximately equal to a transverse spacing between the third connector of the $i^{th}$ panel and a fourth connector of the $i^{th}$ panel and connecting the second standoff connector component to the fourth connector of the $i^{th}$ panel.

In some embodiments, the first standoff connector component being coupled to the third connector component of the $i^{th}$ panel comprises sliding the first standoff connector component in a longitudinal direction relative to the third panel connector component of the $i^{th}$ panel to form a first panel-standoff connection.

In some embodiments, the first panel-standoff connection comprises a projection of the third panel connector component of the $i^{th}$ panel slid into a channel of the first standoff connector component in the longitudinal direction.

In some embodiments, the first panel-standoff connection comprises a projection of the first standoff connector component slid into a channel of the third panel connector In some embodiments, coupling the second standoff connector component to the fourth connector component of the $i^{th}$ panel comprises sliding the second standoff connector component in a longitudinal direction relative to the fourth panel connector component of the $i^{th}$ panel to form a second panel-standoff connection.

In some embodiments, the second panel-standoff connection comprises a projection of the fourth panel connector component of the $i^{th}$ panel slid into a channel of the second standoff connector component in the longitudinal direction.

In some embodiments, the second panel-standoff connection comprises a projection of the second standoff connector component slid into a channel of the fourth panel connector component of the $i^{th}$ panel in the longitudinal direction.

In some embodiments, the primary retainer connector of the retainer and the first and second panel connectors of the first panel are each offset from the tangential plane of the first panel.

Another aspect of the invention provides an apparatus for repairing a multi-sided structure protruding from a first surface to cover at least a portion of a surface of the multi-sided structure with a repair structure. The apparatus comprises a retainer mountable to the first surface, a first brace connector component of a first brace coupleable to a first panel to extend non-parallel and non-orthogonal to the first panel. The first panel is coupleable to a primary retainer connector component of the retainer to extend generally non-parallel to the first surface such that a tangential plane of the first panel is generally facing, and spaced apart from, a second surface of the multi-sided structure to provide a space between the first panel and the multi-sided structure. A second brace connector component of the first brace is coupleable to a secondary retainer connector component of the retainer to extend non-parallel and non-orthogonal to the retainer. The first panel acts as at least a portion of a framework for containing a curable material in the space between the first panel and the multi-sided structure until the curable material cures to provide a repair structure cladded, at least in part, by the first panel.

Another aspect of the invention provides a method for interconnecting edge-adjacent panels of an apparatus for repairing a multi-sided structure protruding from a first surface. The method comprises providing a retainer comprising a first edge component and a panel comprising a second edge component, orienting the retainer and the panel in an edge-to-edge relationship and thereby aligning the first and second edge components with one another, providing a tool comprising: a first arm having a first handle, the first arm terminating at a first tool head comprising a first roller; and a second arm having a second handle, the second arm terminating at a second tool head comprising a second roller, the second arm pivotally coupled to the first arm by a pivot joint, positioning the tool at a first location relative to the retainer and the panel and configuring the first and second tool faces to respectively engage the first and second edge components, moving the tool in a longitudinal direction to thereby cause the first roller to roll along the first edge component and the second roller to roll along the second edge component thereby forcing the first edge component into a locked configuration with the second edge component.

In some embodiments, the method comprises moving the first and second handles toward each other by movement of the pivot joint to cause corresponding movement of the first and second tool faces toward one another other before moving the tool in the longitudinal direction. In some embodiments, the method comprises pivoting the first and second arms relative to the first and second tool heads.

In some embodiments, the method comprises disengaging the tool from the first and second edge components and the locked configuration of the first and second edge components is maintained after the tool is disengaged from the first and second edge components.

Another aspect of the invention provides a tool for assembling at least a portion of an apparatus for repairing a multi-sided structure protruding from a first surface, the apparatus comprising a retainer and a panel having first and second edge components and connectable in an edge-to-edge relationship wherein the first and second edge components engage one another. The tool comprises a first arm having a first handle, the first arm terminating at a first tool head comprising a first roller, a portion of which is shaped to be complimentary to at least a portion of the first edge component for engaging the portion of the first edge component a second arm having a second handle, the second arm terminating at a second tool head comprising a second roller, a portion of which is shaped to be complimentary to at least a portion of the second edge component for engaging the second edge component, the second arm pivotally coupled to the first arm by a pivot joint. The first and second handles are moveable toward one another by movement of the pivot joint causing corresponding movement of the first and second rollers toward one another and thereby forcing the first and second edge components into a locked configuration.

In some embodiments, the first and second tool heads are pivotally mounted to the first and second arms respectively.

In some embodiments, the tool comprises a bias mechanism between the first and second handles to bias the first and second tool heads into a spaced apart relationship. In some embodiments, the tool comprises a locking mechanism for overcoming the bias mechanism and securing the first and second tool faces in abutment with one another.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Figure 1A:
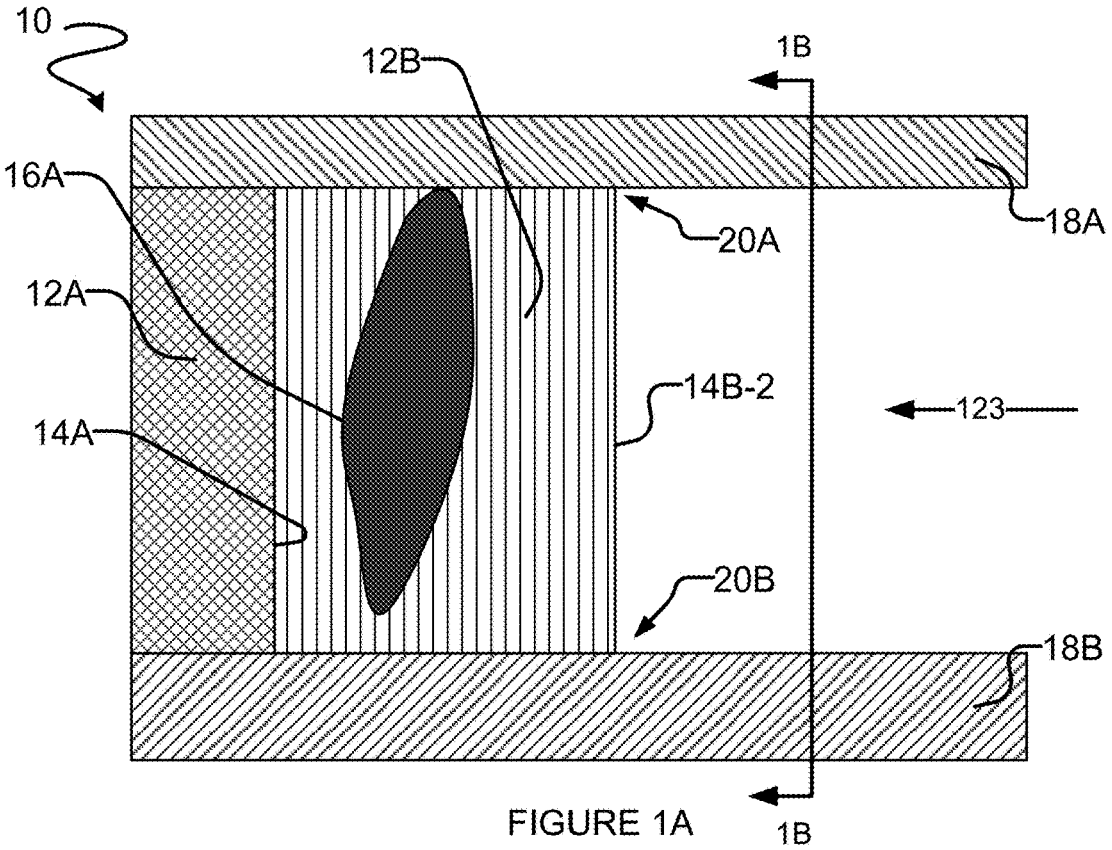
FIGS. 1A, 1B and 1C (collectively, FIG. 1) respectively depict partial cross-sectional views of an existing structure along the lines 1A-1A, 1B-1B and 1C-1C.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

One aspect of the invention provides a method for repairing a multi-sided structure protruding from a first surface to cover at least a portion of the multi-sided structure with a repair structure. A retainer is mounted to the first surface. A first brace connector component of a first brace is coupled to a first panel such that the first brace extends non-parallel and non-orthogonal to the first panel. The first panel is coupled to a primary retainer connector component of the retainer such that the first panel extends generally non-parallel to the first surface such that a plane (or tangential plane) of the first panel is facing, and spaced apart from, a second surface of the multi-sided structure to provide a space between the first panel and the multi-sided structure. A second brace connector component of the first brace is coupled to a secondary retainer connector component of the retainer, such that the first brace extends non-parallel and non-orthogonal to the retainer. A curable material is introduced into the space between the first panel and the multi-sided structure, the first panel acting as at least a portion of a framework for containing the curable material until the curable material cures to provide a repair structure cladded, at least in part, by the first panel.

Another aspect of the invention provides an apparatus for repairing a multi-sided structure protruding from a first surface to cover at least a portion of the multi-sided structure with a repair structure. A retainer is mounted to the first surface. A first brace connector component of a first brace is coupled to a first panel such that the first brace extends non-parallel and non-orthogonal to the first panel. The first panel is coupled to a primary retainer connector component of the retainer such that the first panel extends generally non-parallel to the first surface such that a plane (or tangential plane) of the first panel is facing, and spaced apart from, a second surface of the multi-sided structure to provide a space between the first panel and the multi-sided structure. A second brace connector component of the first brace is coupled to a secondary retainer connector component of the retainer, such that the first brace extends non-parallel and non-orthogonal to the retainer. A curable material is introduced into the space between the first panel and the multi-sided structure, the first panel acting as at least a portion of a framework for containing the curable material until the curable material cures to provide a repair structure cladded, at least in part, by the first panel.

Aspects of the invention also provide repair structures fabricated using the methods and formwork apparatus described herein. Kits may also be provided in accordance with some aspects of the invention. Such kits may comprise portions of the apparatus according to various embodiments and may facilitate effecting one or more methods according to various embodiments.

Figure 1B:
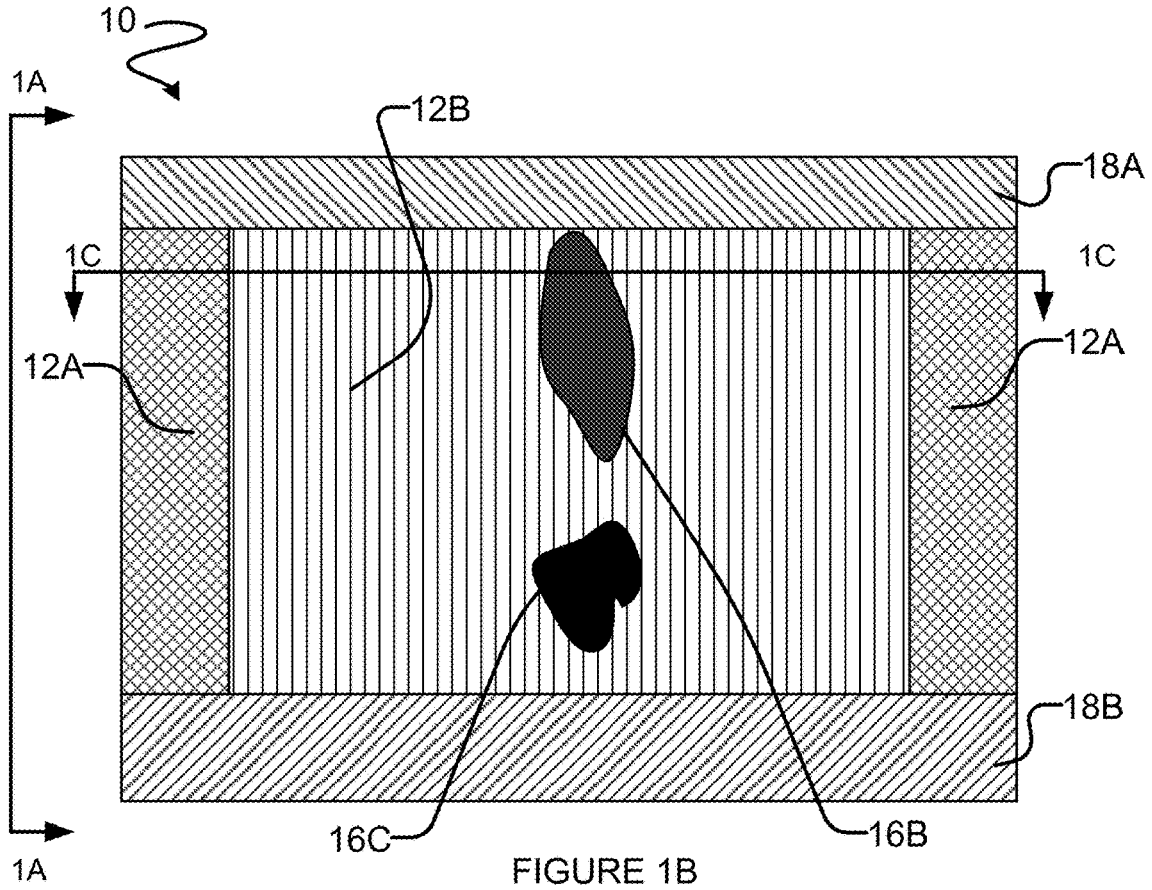
Figure 1C:
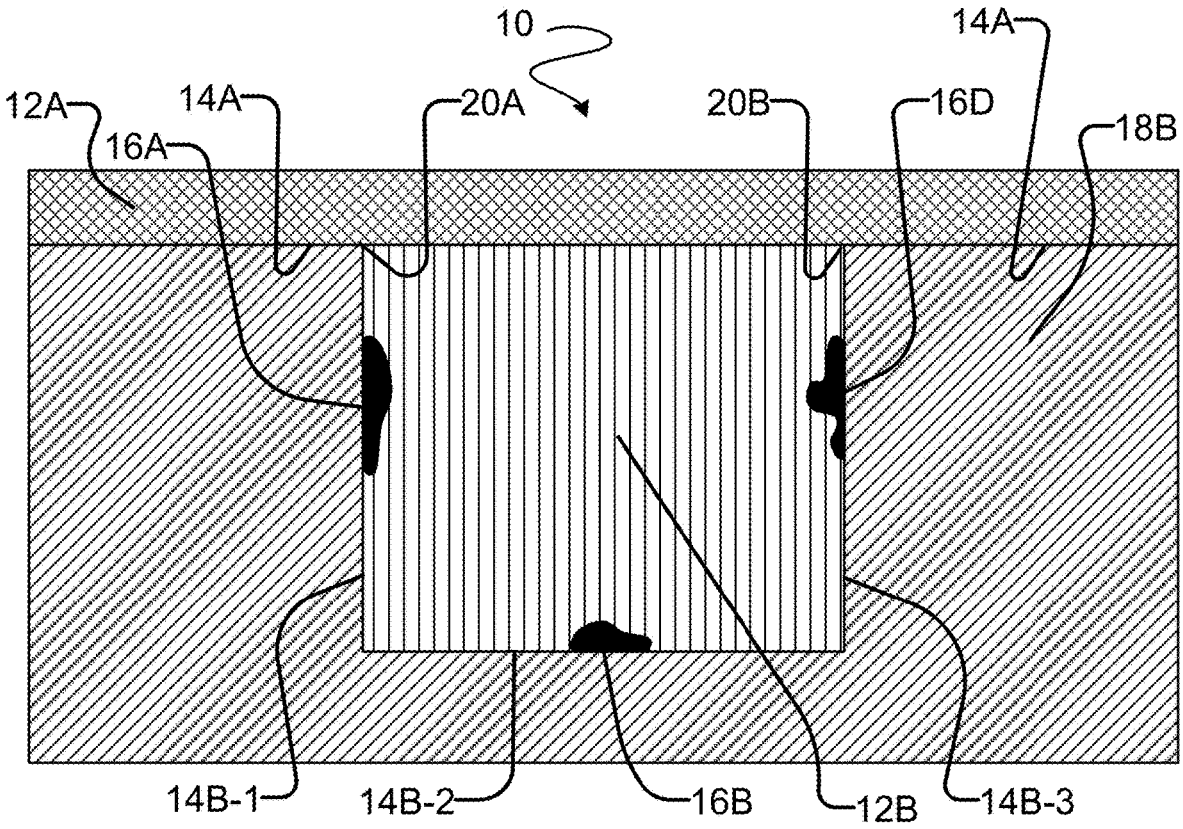
Figure 2:
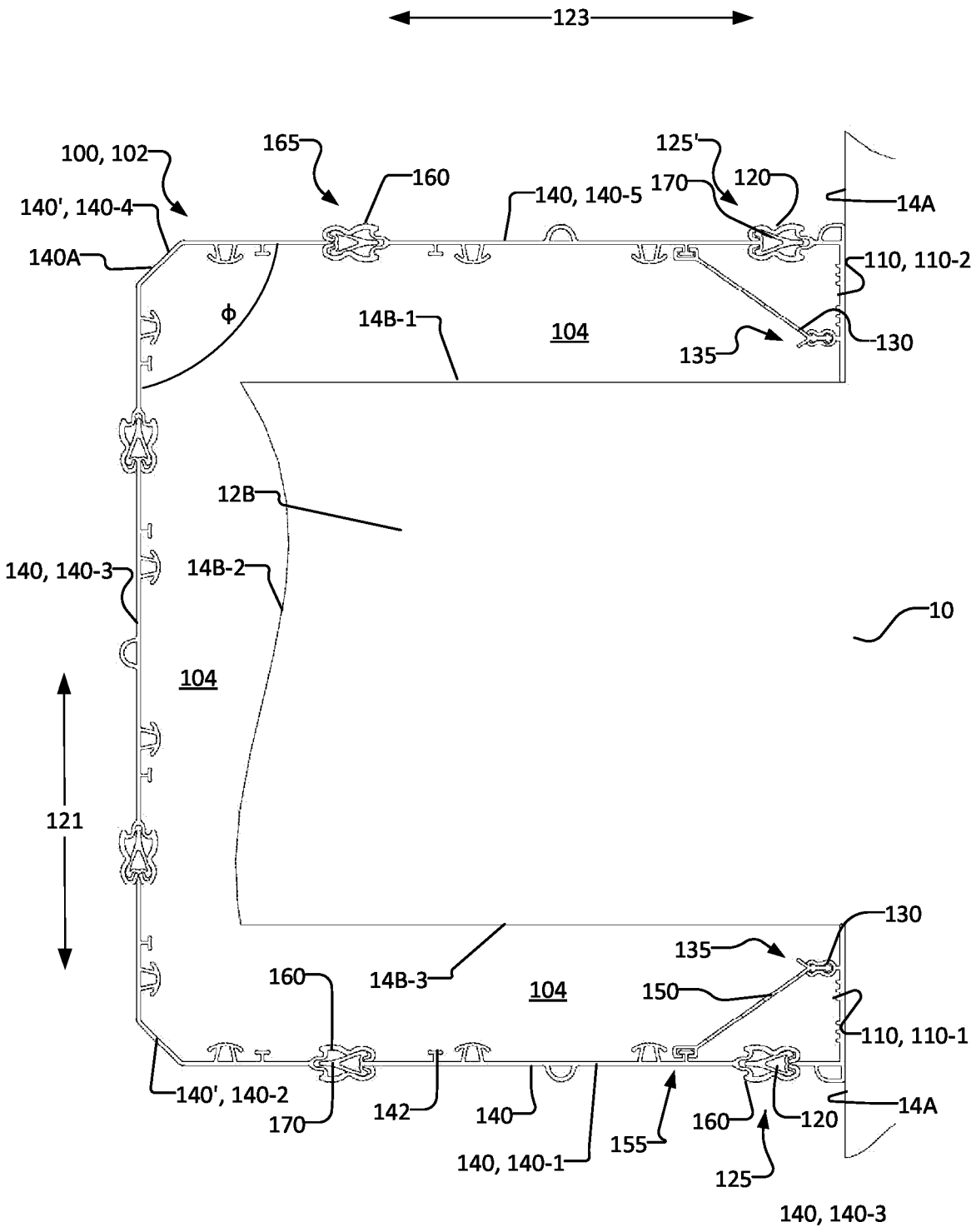
FIG. 2 depicts a top plan view of a repair structure and formwork apparatus for repairing the FIG. 1 existing structure.
Figure 3:
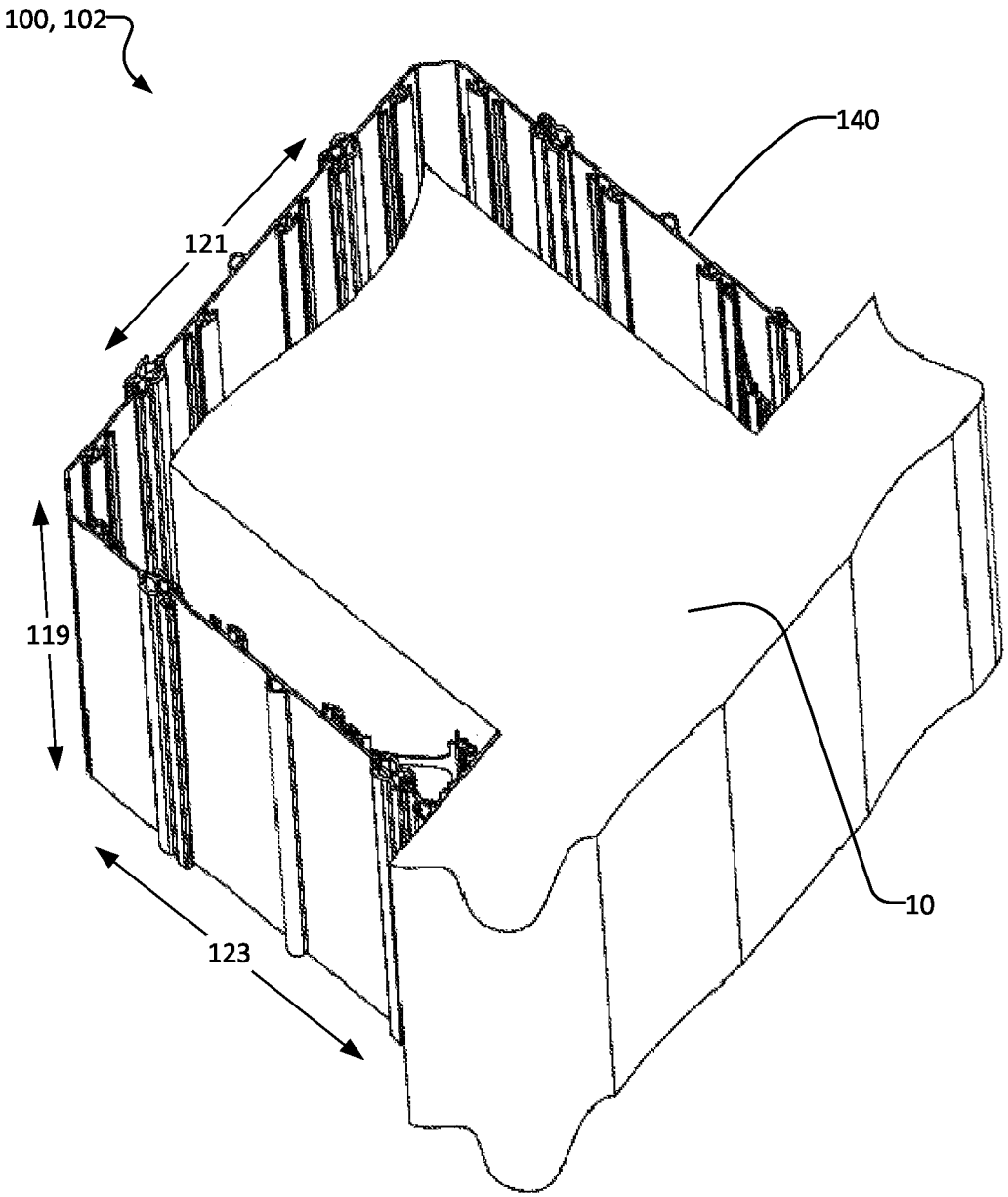
FIG. 3 depicts a perspective view of the repair structure and formwork apparatus of FIG. 2.

FIGS. 2 and 3 depict various views of a formwork apparatus 100 which may be used to build a repair structure 102 and to thereby repair the FIG. 1 existing structure 10 according to a particular embodiment. As can be best seen from FIG. 2, formwork 100 of the illustrated embodiment comprises a plurality of retainers 110, one or more braces 150 and one or more panels 140. Retainers 110 may be mounted to surface 14A such that a repair apparatus 102 may be formed without necessarily mounting any components of formwork apparatus 100 to multi-sided structure 12B. To form repair structure 102, concrete (or other curable material) may be introduced into space 104 between panels 140 and existing structure 10 and cured so that braces 150 are embedded in the concrete and lining system (together with the cured concrete in space 104) forms a lined (or cladded) repair structure 102 around at least a portion of existing structure 10.

In some embodiments, formwork apparatus 100 may be used with an external formwork (or external bracing (not shown) which supports the formwork apparatus 100 while concrete or other curable material cures in space 104. The external formwork may be removed and optionally re-used after the curable material cures. In some embodiments, formwork apparatus 100 may be used (with or without external formwork or bracing) to fabricate independent structures (i.e. structures that do not line existing structures and are otherwise independent of existing structures).

In currently preferred embodiments, retainers 110, braces 150 and panels 140 are fabricated from suitable plastic (e.g. polyvinyl chloride (PVC)) using an extrusion process. It will be understood, however, that retainers 110, braces 150 and/or panels 140 could be fabricated from other suitable materials, such as, by way of non-limiting example, other suitable plastics, other suitable metals or metal alloys, polymeric materials, fiberglass, carbon fiber material or the like and that retainers 110, braces 150 and/or panels 140 could be fabricated using any other suitable fabrication techniques.

Generally, formwork apparatus 100 components may be formed of a resiliently (e.g. elastically) deformable material such as appropriate plastics described above. The resiliently deformable nature of these components allow formwork apparatus 100 components to be deformed as connections, such as edge-to-edge connections between panels 140, are formed. As a result, formwork apparatus 100 components (or portions thereof) may apply restorative deformation forces on other formwork apparatus 100 components (or portions thereof) and may allow for components to resiliently "snap" back to a less deformed state. This may allow for more secure connections or connections that may withstand deformation while minimizing leaking and the creation of gaps in the connection.

Retainers 110 are coupled to existing structure 10 such that at least a portion of retainers 110 extend away from surface 14A thereof. Retainers 110 are elongated in longitudinal direction 119.

Figure 4A:
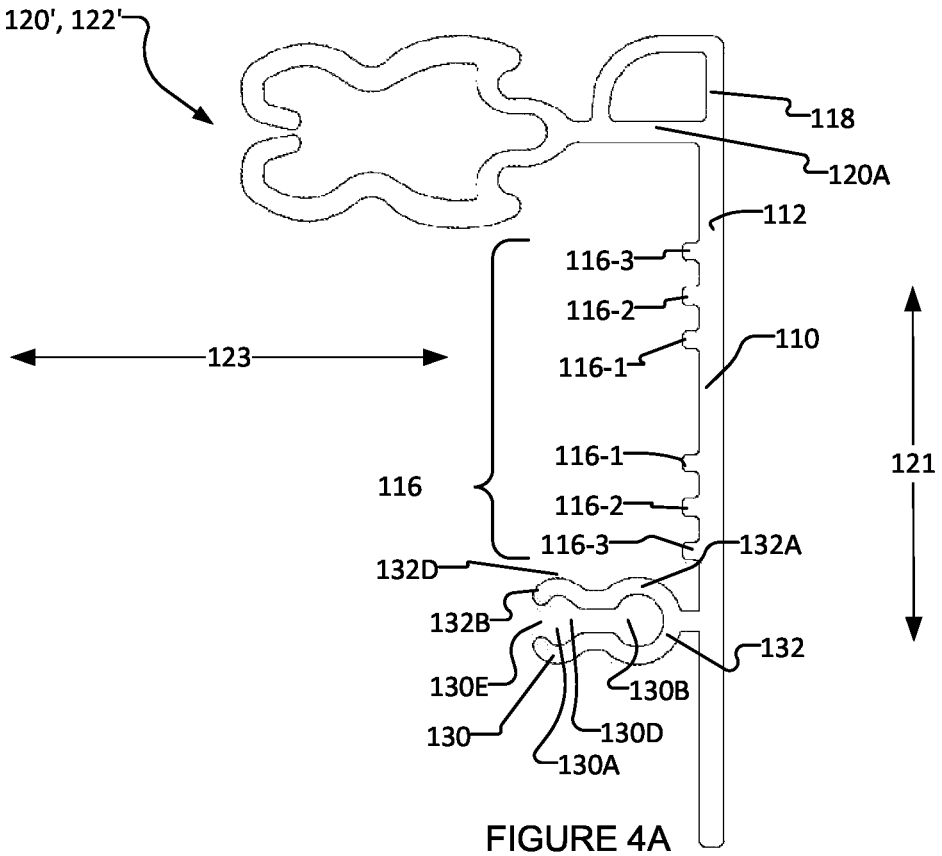
FIGS. 4A and 4B depict top plan views of the retainers for the repair structure and formwork apparatus of FIG. 2.
Figure 4B:
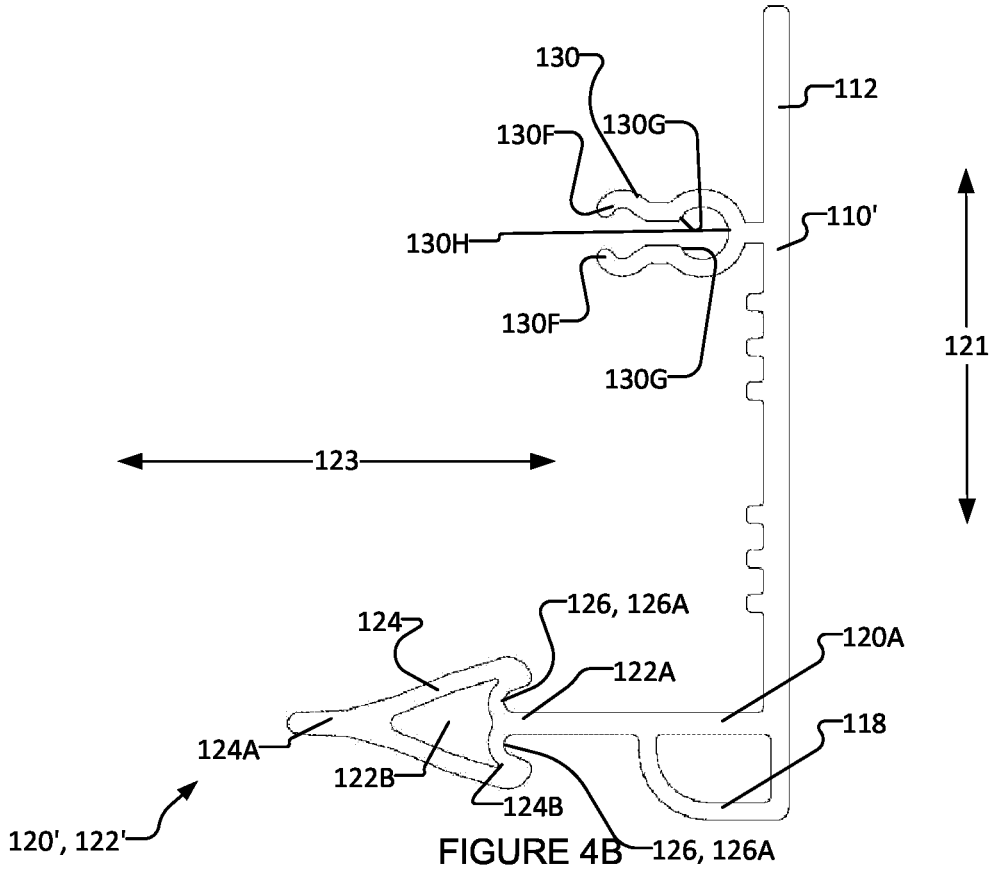
Figure 4C:
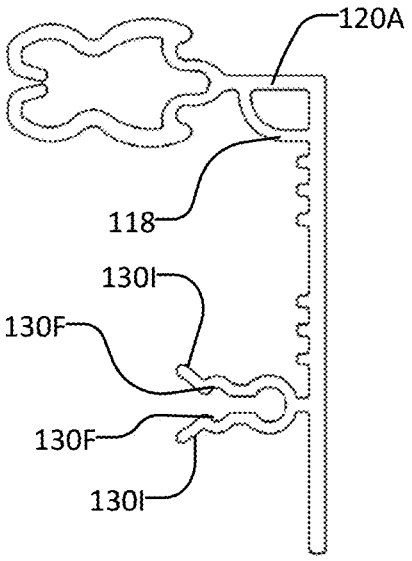
FIGS. 4C and 4D depict top plan views of the retainers according to a particular embodiment of the invention.
Figure 4D:
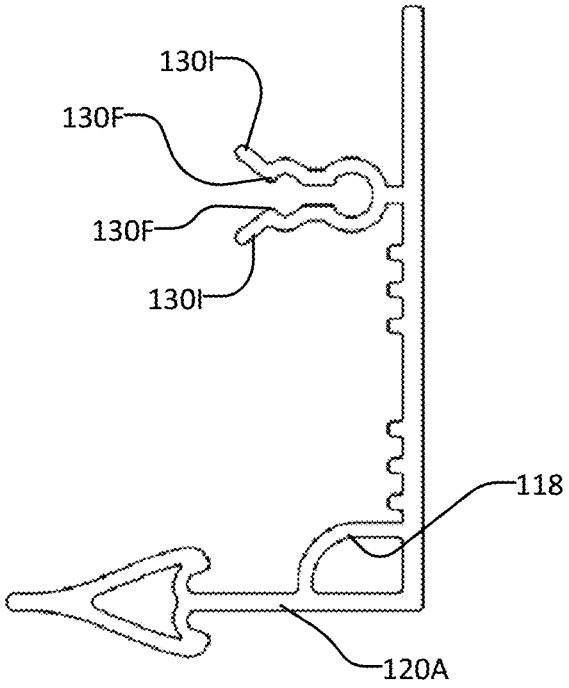
Figure 5:
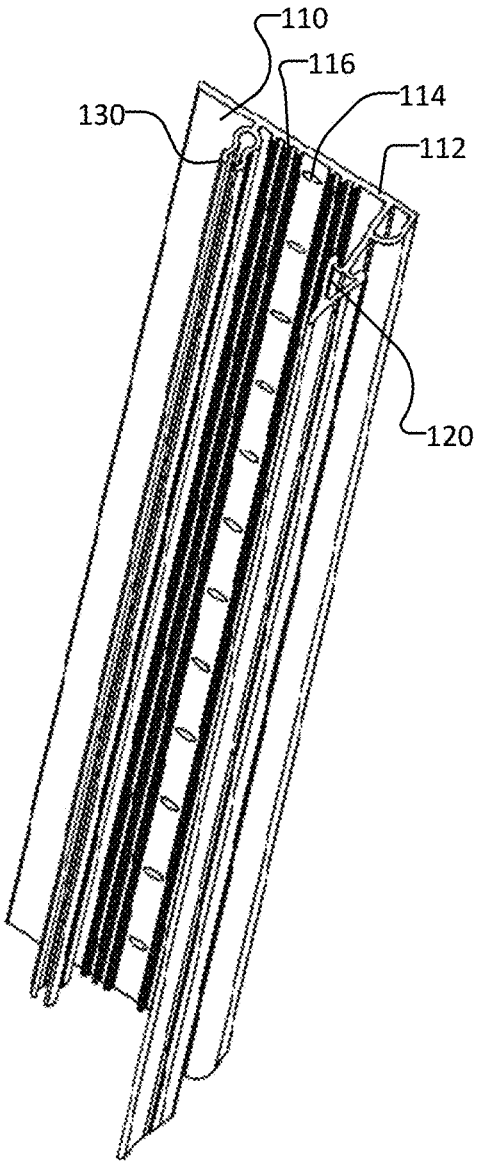
FIG. 5 depicts a perspective view of the retainer for a repair structure and formwork apparatus of FIG. 2.

As shown in FIGS. 4A to 4D and 5, retainers 110 comprise a base 112, a primary retainer connector component 120 and a secondary retainer connector component 130. Base 112 extends in longitudinal direction 119 and transverse direction 121 and may be mountable to existing structure 10 by one or more mounting features such as apertures 114, as best shown in FIG. 5. Apertures 114 may receive fasteners 50 (see FIG. 12C) for mounting retainers 110 to existing structure 10. Fasteners 50 may comprise any suitable fasteners such as, for example, concrete screws, nuts and bolts, concrete anchors, rebar or the like.

Retainers 110 may be mounted to existing structure 10 such that base 112 contacts or abuts surface 14A of existing structure 10. However, surface 14A of existing structure 10 may be uneven (e.g. surface 14A may vary in inward-outward direction 123) along longitudinal direction 119. Spacers may therefore be employed to accommodate such unevenness along longitudinal direction 119. For example, the inward-outward direction 123 dimension of each spacer may be chosen such that a distal end of each spacer (e.g. the end of spacer that is furthest from surface 14A) may define a portion of a hypothetical plane as desired. In this way, when base 112 of a retainer 110 is mounted against the spacers, retainer 110 is parallel with the hypothetical plane. The hypothetical plane may be a vertical plane. This is not mandatory. The hypothetical plane could be sloped, if desired. In this way, retainers 110 remain straight in longitudinal direction 119 which in turn facilitates coupling of panels 140 to retainers 110.

In some embodiments, the spacers are complementarily threaded to the fasteners 50. For example, the spacers may comprise a threaded nut. By rotating the spacers clockwise or counter-clockwise, the inward-outward direction 123 distance of the distal end of each spacer to surface 14A of existing structure 10 may be adjusted without requiring multiple spacers or spacers of different lengths. In some embodiments, each spacer comprises a pair of threaded nuts to prevent unwanted movement of spacer. In some embodiments, the spacers comprise one or more wedges that may be interleaved to space apart retainer 110 from surface 14A of existing structure 10.

In some embodiments, to prevent fastener 50 from pulling through aperture 114, one or more washers may be employed between the fastener 50 and base 112. Such washers may be flat washers or curved washers. Such washers may, for example, comprise metal, polymer or composite materials. In some embodiments, to prevent fastener 50 and/or washer from crushing base 112 or a portion of base 112, one or more ridges 116 may be provided on base 112. Ridges 116 may extend in inward-outward direction 123 from base 112. Ridges 116 may extend along longitudinal direction 119 continuously or may be discontinuous (e.g. ridges 116 may only be present near apertures 114). Ridges 116 may serve to reinforce base 112 near apertures 114 and may serve to prevent overtightening of fasteners 50. Ridges 116 may also serve to help center washers around apertures 114.

Base 112 may comprise one or more pairs of ridges 116 such that each washer contacts at least one pair of ridges 116. In the FIGS. 4A and 4B embodiments, base 112 comprises three pairs of ridges 116-1, 116-2 and 116-3. In some embodiments (although not depicted), ridges 116-2 are spaced apart further than ridges 116-1 (in transverse direction 121) and are taller (in inward-outward direction 123) than ridges 116-1 and ridges 116-3 are spaced apart further than ridges 116-2 (in transverse direction 121) and are taller (in inward-outward direction 123) than ridges 116-2. In this way, if a relatively large washer is employed, it may sit on ridges 116-3 and, if fastener 50 is overtightened, the washer will bend or bow prior to base 112 being crushed. Relatively smaller washers may instead sit on ridges 116-2 or ridges 116-1 and may possibly abut sides of ridges 116-3 to prevent unwanted movement of the washer in transverse direction 121.

In some embodiments, primary retainer connector component 120 and secondary retainer connector component 130 are spaced apart in transverse direction 121. For example, in the illustrated embodiment, apertures 114 and ridges 116 are located in the transverse direction 121 space between primary retainer connector component 120 and secondary retainer connector component 130. When base 112 is mounted to surface 14A of existing structure 10, primary retainer connector component 120 and secondary retainer connector component 130 extend in inward-outward direction 123 from base 112 and from surface 14A.

Primary retainer connector component 120 may be attached to base 112 by a stem 120A. Stem 120A may protrude from base 112 at an angle φ such that a panel 140 mounted to primary retainer connector component 120 extends at angle φ to base 112 of retainer 110. In some embodiments, angle φ is equal to approximately 90°. This is not mandatory. Angle φ may be any angle desired and may be chosen based on a shape of multi-sided structure 12B. Stem 120A may be supported by one or more reinforcements 118. In some embodiments, reinforcement 118 may be located on an outer side of stem 120A, such as is depicted in FIGS. 4A and 4B while in other embodiments, reinforcement 118 may be located on an inner side of stem 120A, such as is depicted in FIGS. 4C and 4D. In some embodiments, reinforcements 118 may be located on both the inner and outer sides of stem 120A. Reinforcements 118 may serve to reduce deformation of stem 120A and thereby to improve alignment of panels 140 relative to existing structure 10 and/or multi-sided structure 12B and prevent deformation of formwork apparatus 100 due to, for example, gravity and/or forces associated with curable material poured into space 104.

Primary retainer connector component 120 may comprise any suitable connector component complementary to a connector component of panel 140. In some embodiments, primary retainer connector component 120 comprises any suitable connector component capable of being connected to a panel 140 by forcing a connector component of panel 140 in inward-outward direction 123 toward primary retainer connector component 120 to form an edge-to-edge connection 125.

In some embodiments, primary retainer connector component 120 may comprise a protrusion 122 that is connectable to a receptacle 162 of a first panel connector component 160 of a panel 140 to form a connection 125. Panel 140 may also comprise a second panel connector component 170 that comprises a protrusion 172 that is substantially similar to protrusion 122 of primary retainer connector component 120. Protrusion 172 of a first panel 140-1 may be connectable to a first panel connector component 160 of a second panel 140-2 to form a connection 165 and protrusion 172 of second panel 140-2 may be connectable to a first panel connector component 160 of a third panel 140-3 and so on. In the illustrated embodiment panels 140 (including corner panels 140') are connected to one another in edge-to-edge connections until a final panel 140 connects to a second retainer 110' at connection 125'. Second retainer 110' may comprise a primary retainer connector component 120' comprising a receptacle 122' substantially similar to receptacle 162 of panel 140. Connections 125, 125', 165 are substantially similar and may each be formed in a substantially similar manner. For convenience and to avoid repetition, only the formation of connection 125 is described herein in detail. However, it should be understood that connections 125' and 165 are substantially similar and may each be formed in a substantially similar manner.

Figure 6:
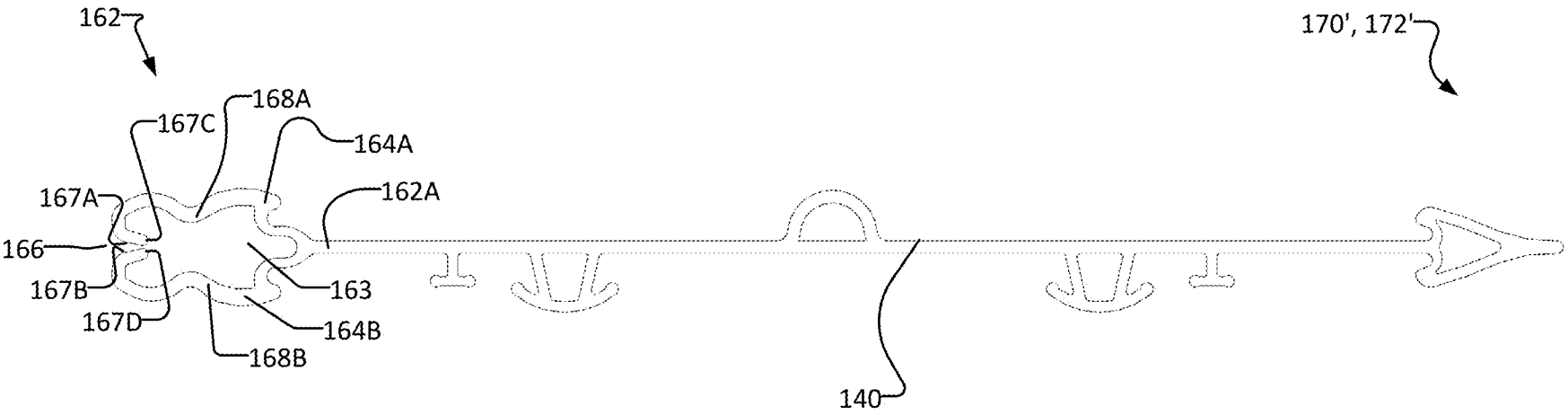
FIG. 6 depicts a top plan view of a panel for the repair structure and formwork apparatus of FIG. 2.

FIG. 6 is a top plan view of a panel 140 of formwork apparatus 100. As discussed above, panel 140 is connectable to additional panels 140 by edge-to-edge connections 165 and to retainers by edge to edge connections 125. Each panel 140 comprises a first panel connector component 160 and a second panel connector component 170 located along opposing longitudinally extending edges of panel 140. Connection 165 between edge-adjacent panels 140 is formed by inserting first panel connector component 160 of a first panel 140 into second panel connector component 170 of a second panel 140 as described in more detail below. Edge-to-edge connections 125, 165, along with retainers 110 and panels 140, keeps the concrete or other curable material within the formwork apparatus 100 and, in some embodiments, maintains a liquid-tight seal to help reduce contamination or deterioration of the existing structure 10 and/or the repair structure formed using formwork apparatus 100.

Figure 7A:
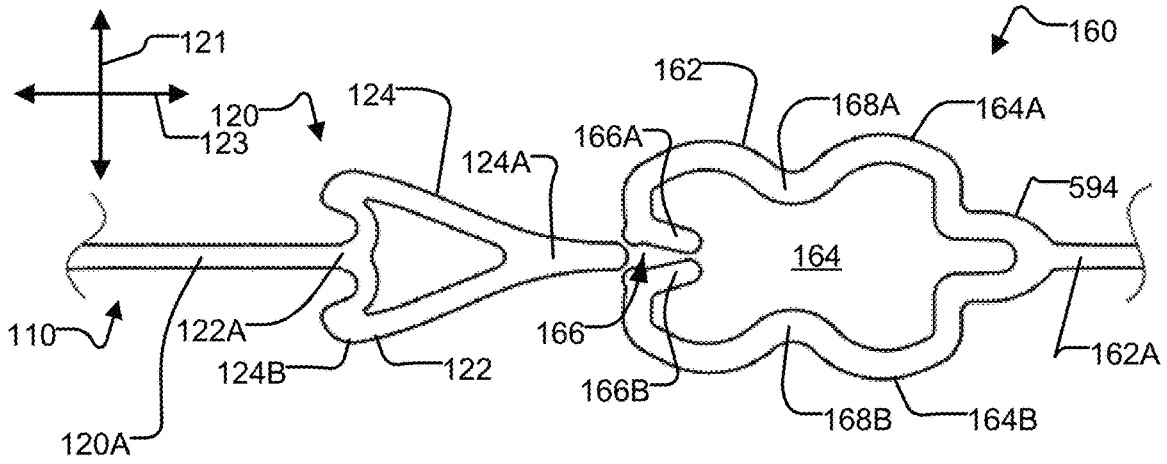
FIGS. 7A-7F depict top plan views of the formation of a connection between a retainer and a panel or two panels of the repair structure and formwork apparatus of FIG. 2.

FIG. 7A shows a primary retainer connector component 120 of retainer 110 and a first panel connector component 160 of panel 140 prior to the formation of edge-to-edge connection 125. In the illustrated embodiment, primary retainer connector component 120 comprises a protrusion 122 having a tapered head 124 with a narrow end 124A at the tip and a wide end 1248 near the base 122A of protrusion 122. In the FIG. 7 embodiment, protrusion 122 is generally arrowhead shaped and is hollow with a space 1228 formed therein. Space 122B is not necessary.

First panel connector component 160 comprises a receptacle 162 shaped to complement and receive protrusion 122. Receptacle 162 comprises a base 162A with a pair of walls 164A, 1648 extending from base 162A to form a space 164 therebetween. Walls 164A, 164B comprise a pair of hooked arms 166A, 166B forming an opening 166 therebetween.

Receptacle 162 may also comprise one or more optional protrusions 1 (in the illustrated embodiment there are two protrusions 168A, 168B) which extend into space 164. In the illustrated embodiment, protrusions 168A, 168B comprise shaped indentations formed in walls 164A, 164B. In other embodiments, protrusions 168A, 168B may comprise convexities that extend from walls 164A, 164B into space 164 (e.g. thickened regions of walls 164A, 164B). As discussed in more detail below, protrusions 168A, 168B of first panel connector component 160 engage protrusion 122 of primary retainer connector component 120 when connection 125 is formed.

Figure 7B:
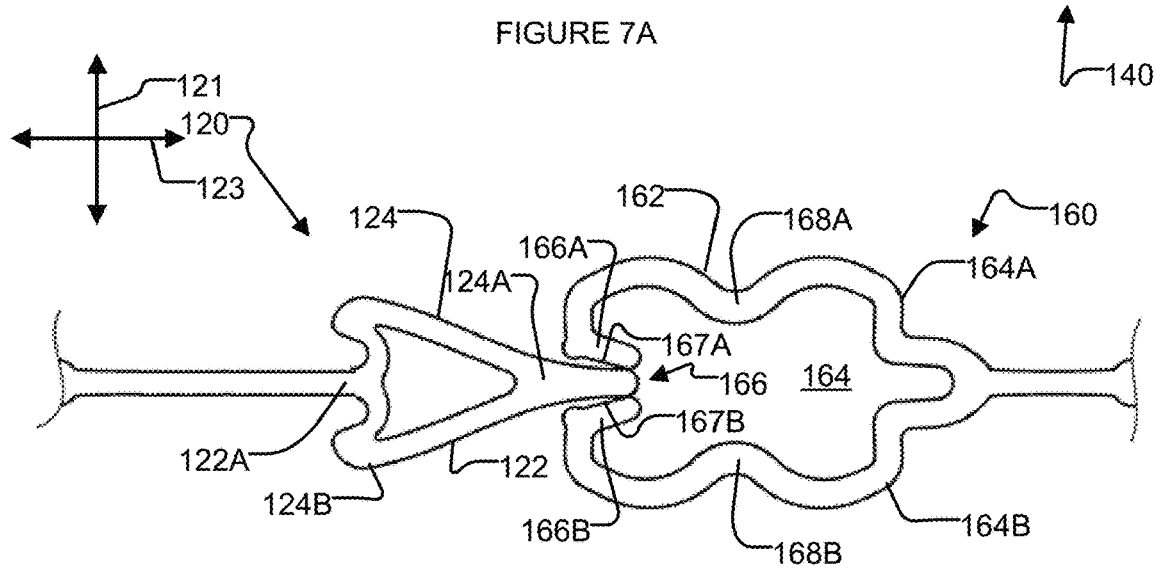

FIGS. 7B to 7F show various further stages in the process of forming connection 125 between primary retainer connector component 120 and first panel connector component 160. FIG. 7B shows primary retainer connector component 120 as it begins to engage first panel connector component 160. Narrow end 124A of tapered head 124 enters into opening 166 of receptacle 162 between hooked arms 166A, 166B. As a result, hooked arms 166A, 166B and/or walls 164A, 164B begin to resiliently deform inwardly and outwardly (e.g. in positive and negative transverse directions 121) due to the force applied by protrusion 122. This deformation results in opening 166 being widened. In the illustrated embodiment, beveled surfaces 167A, 167B (FIG. 7B) of hooked arms 166A, 166B are shaped to complement similarly beveled surfaces of tapered head 124, thereby facilitating the insertion of protrusion 122 into opening 166 of receptacle 162 and the corresponding widening of opening 166 due to deformation of arms 166A, 166B and/or walls 164A, 164B.

Figure 7C:
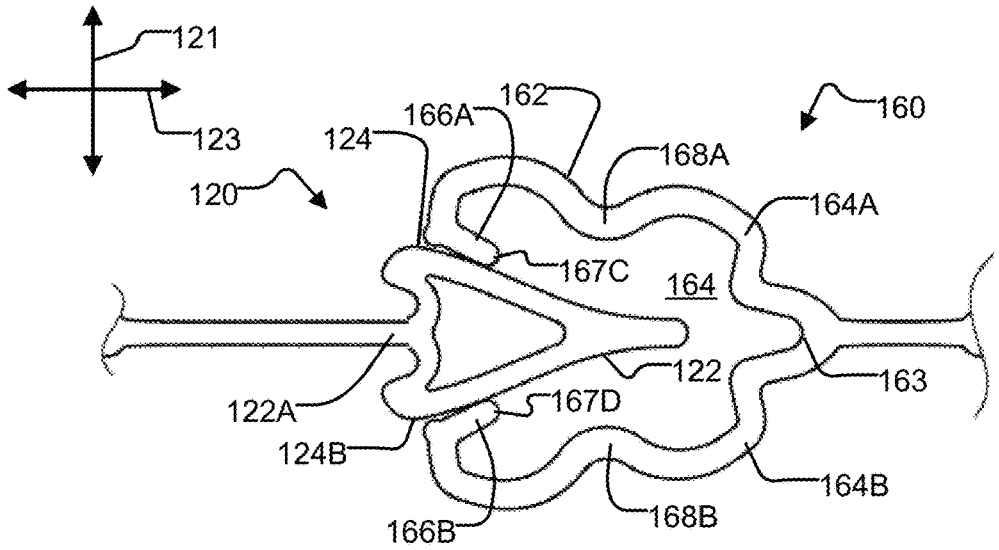

FIG. 7C shows protrusion 122 further inserted into receptacle 162 and space 164 to near the maximum width of wide end 124B of protrusion 122. This further insertion of protrusion 122 deforms walls 164A, 164B and hooked arms 166A, 166B even further as beveled surfaces 167A, 167B slide against corresponding beveled surfaces of tapered head 124 and are displaced by the widening of tapered head 124. Hooked arms 166A, 166B continue to be forced apart from one another until wide end 124B of protrusion 122 has passed by the tips 167C, 167D of hooked arms 166A, 166B and into space 164.

Figure 7D:
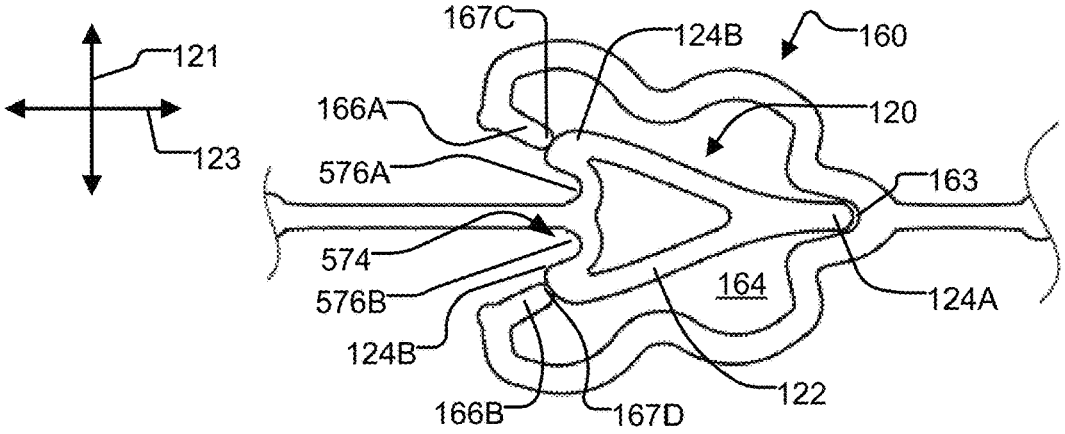

As shown in FIG. 7D, as protrusion 122 extends further into space 164, tip 124A of protrusion 122 enters concavity 163 of space 164 (which may be defined by walls 164A, 164B). The walls of concavity 163 may act to guide tip 124A such that primary retainer connector component 120 remains properly aligned with first panel connector component 160 (e.g. such that their respective axes of bilateral symmetry are generally collinear).

Figure 7E:
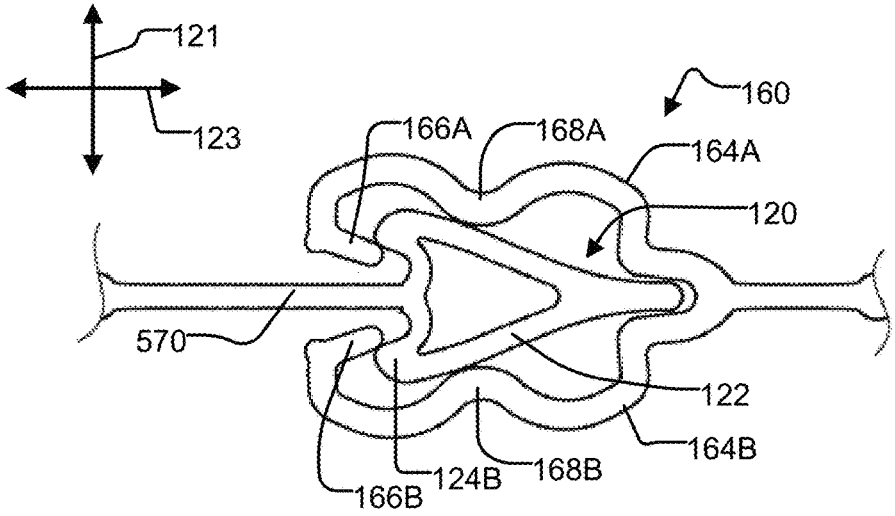

As is also shown in FIGS. 7D and 7E, hooked arms 166A, 166B begin to resiliently snap back around protrusion 122 into a locked position once tips 167C, 167D of hooked arms 166A, 1666 pass wide end 1246 of protrusion 122.

As shown in FIG. 7E, once hooked arms 166A, 166B have passed over the maximum width of wide end 1246, walls 164A, 1646 begin to resiliently snap back such that protrusions 168A, 1686 of first panel connector component 160 contact protrusion 122 of primary retainer connector component 120. Through this contact, protrusions 168A, 1686 apply restorative deformation force against protrusion 122 and, because of the shape of protrusion 122, this force is oriented in transverse direction 121 (e.g. parallel to the transversely extending edges of panels 140 which are generally orthogonal to the longitudinally extending edges extending into and out of the page in the FIG. 7 views). This force helps to secure the connection 125 by forcing wide end 1246 of protrusion 122 against hooked arms 166A, 1666 as described in more detail below.

Figure 7F:
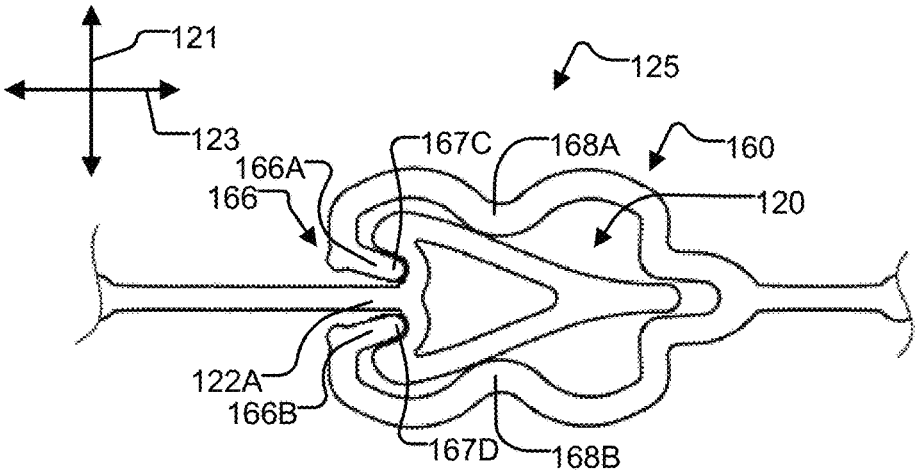

In the locked position of some embodiments, hooked arms 166A, 166B engage a locking portion 126 of primary retainer connector component 120. In the FIG. 7 embodiment, locking portion 126 comprises concavities 126A, 126B (FIG. 7D) that are shaped to receive tips 167C, 167D (see FIG. 7D) of hooked arms 166A, 166B. As shown in FIGS. 7E and 7F, the extension of tips 167C, 167D into concavities 126A, 1266 secures, or locks, connection 125 by providing an obstacle that hinders hooked arms 166A, 1666 from being moved away from one another and releasing protrusion 122 and hinders primary retainer connector component 120 from being withdrawn from first panel connector component 160 (e.g. by relative movement of panel 140 and retainer 110 in inward-outward direction 123).

Once hooked arms 166A, 166B reach the locked configuration, they may abut base 122A to plug opening 166, as shown in FIG. 7F and described in more detail below. The abutment of hooked arms 166A, 1666 with base 122A provides further sealing engagements for completing connection 125 between primary retainer connector component 120 and first panel connector component 160. In the FIG. 7F embodiment, hooked arms 166A, 1666 may not return to their original shapes once edge-to-edge connection 125 is formed—i.e. hooked arms 166A, 1666 may remain partially deformed when connection 125 is made. Due to the width of protrusion base 122A, opening 166 between hooked arms 166A, 1666 may be larger when connection 125 is complete than before connection 125 is made (this can be seen by comparing FIGS. 7A and 7F). Because hooked arms 166A, 166B remain partially deformed, hooked arms 166A, 166B may apply restorative deformation forces to protrusion 122, in effect squeezing base 122A.

The locked configuration of connection 125 is supplemented by restorative deformation forces applied to protrusion 122 by optional protrusions 168A, 168B. Optional protrusions 168A, 168B may be formed by bends in the shape of walls 164A, 164B, as shown in the FIG. 7 embodiment. Optional indentations 168A, 168B may additionally or alternatively be formed by bulges, convexities, protrusions or the like in walls 164A, 164B—e.g. regions of walls 164A, 164B with relatively greater thickness.

In some cases, tips 167C, 167D of hooked arms 166A, 166B may become caught on protrusion 122 as wide end 124B passes by hooked arms 166A, 166B, hindering the completion of connection 125. The resilient deformation forces caused by the interaction of protrusions 168A, 168B with the tapered body of protrusion 122 may remedy this situation by forcing protrusion 122 back in transverse direction 121 against tips 167C, 167D. Because, in the illustrated embodiment, wide end 124B has already passed tips 167C, 167D, the force caused by protrusions 168A, 168B will tend to force tips 167C, 167D to slide into concavities 126A, 126B and complete connection 125.

While primary retainer connector component 120 is described as comprising a protrusion 122, this is not mandatory. Instead, a primary retainer connector component 120' of a retainer 110' may, for example, comprise a receptacle similar to receptacle 162 of first panel connector component 160 as shown in FIG. 4B. In that case, a second panel connector component 170 of panel 140, which comprises a protrusion 172, may connect to connector component 120' to form a connection 125'.

Connections 125, 125' and 165, and in particular connector components 120, 120', 160, 170, of the illustrated embodiment are symmetrical about and/or aligned with the plane of panels 140. The alignment and/or (at least) outer symmetry of connections 125, 125', 165 with the plane of panels 140 may provide a strong connection by minimizing potential moments applied to connections 125, 125', 165. That is, forces applied to panels 140 in plane cause minimal moments on connections 125,125', 165, reducing any twisting which could tend to release or weaken connections 125, 125', 165. In some embodiments, this in-line symmetry of connections 125, 125', 165 and connector components 120, 120', 160, 170 is not necessary. In some embodiments, it may be desirable to provide an exterior surface of panels 140 with a flush appearance. Consequently, connections 125, 125', 165 and connector components 120, 120', 160, 170 may be inwardly offset from the plane of panels 140.

First panel connector component 160 and primary retainer connector component 120' each have an outer profile with a generally elliptical shape. Shapes such as the elliptical shape of connector components 160, 120' may provide an aerodynamic connection that reduces the drag associated with connections 125, 125', 165. Reducing drag may be important when, for example, formwork apparatus 100 is used in an aqueous environment and it is desirable to maintain appropriate flow conditions around connections 125, 125', 165. The elliptical shape of connector components 160, 120' also reduces the number of sharp corners in connections 125, 125', 165. This can reduce the potential negative impact on users and/or fauna that may interact with formwork apparatus 100.

Figure 10:
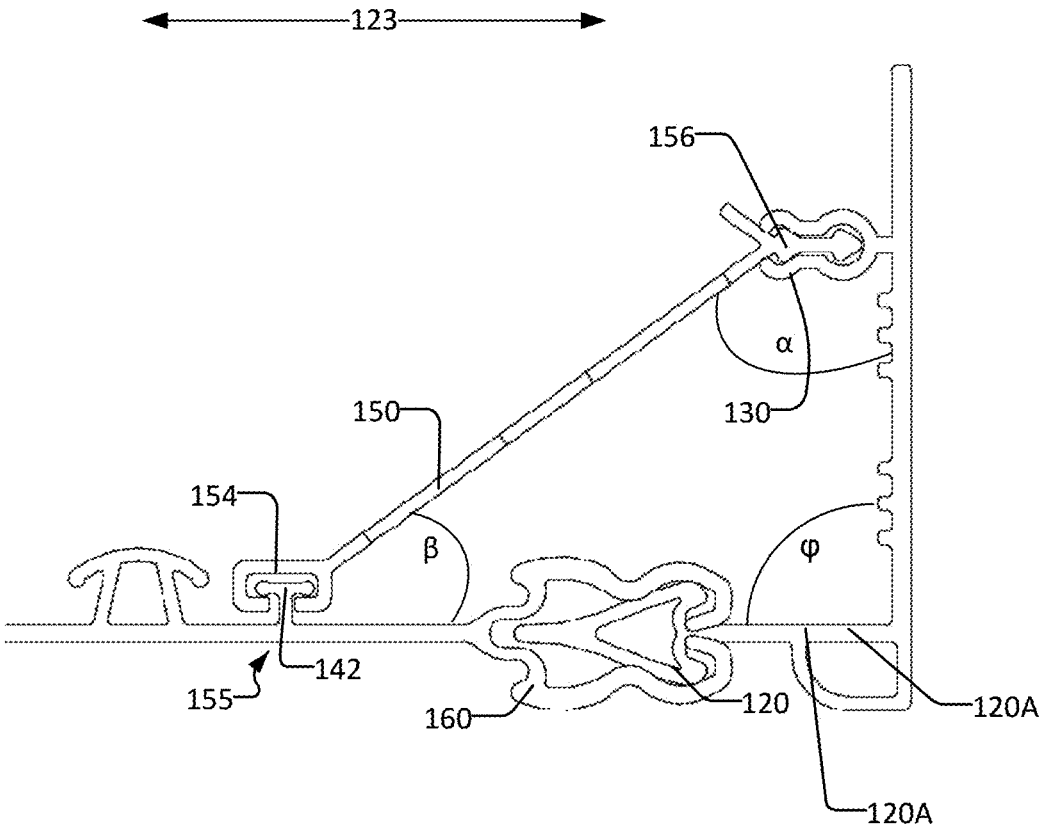
FIG. 10 depicts a top plan view of a connection between a retainer, a brace and a panel of the repair structure and formwork apparatus of FIG. 2.

In some embodiments, a brace 150 may be connected to retainer 110 and panel 140 as shown in FIG. 10. Brace 150 may be provided to reinforce connection 125 (and/or connection 125'), reduce movement of panel 140 in transverse direction 121 (e.g. due to the weight of curable material such as concrete) and/or reduce pillowing of panel 140.

In some embodiments, brace 150 is configured to extend from base 112 of retainer at approximately 45° and from panel 140 at approximately 45°. This is not necessary. For example, brace 150 could be configured to extend from base 112 of retainer at approximately 20° and from panel 140 at approximately 70°. In general, brace may be configured to extend from base 112 of retainer at an angle $\alpha$ and from panel 140 at an angle $\beta$, where the sum of $\alpha$ and $\beta$ is approximately equal to the angle $\varphi$ between panel 140 and corner connector component 110.

Brace 150 is elongated in longitudinal direction 119, has a flat portion 152, a first brace connector component 154 and a second brace connector component 156. First brace connector component 154 may extend from flat portion 152 at angle $\lambda$ (e.g. 135°) and second brace connector component 156 may extend from flat portion 152 at angle $\delta$ (e.g.) 135°). Angles $\lambda$ and $\delta$ allow brace 150 to be connected to base 112 of retainer at an angle $\alpha$ and to panel 140 at an angle $\beta$, as shown in FIG. 10.

Second brace connector component 156 of brace 150 may be connectable to panel 140 using any suitable method or connector components. In some embodiments, panel 140 comprises a connector component 142 in the form of a T-connector component sized and shaped to cooperate with a C or channel shaped second brace connector component 156 of brace 150. In some embodiments, a connection 155 is formed between second brace connector component 156 of brace 150 and connector component 142 by sliding second brace connector component 156 relative to connector component 142. In some embodiments, sliding second brace connector component 156 relative to connector component 142 comprises sliding T-connector component 142 in longitudinal direction 119 into a channel 156A defined by second brace connector component 156 of brace 150. In some embodiments, second brace connector component 156 may be connected to connector component 142 by forcing them toward one another in transverse direction 121 and/or inward-outward direction 123 or by pivoting second brace connector component 156 of brace 150 relative to connector component 142. Connection 155 may comprise a snap-together connection, a friction fit connection, a displacement fit connection or the like.

In practice, brace 150 may be connected to panel 140 prior to connecting panel 140 to retainer 110. After brace 150 is connected to panel 140, the combination of panel 140 and brace 150 may together be attached to retainer 110 by forcing the combination of panel 140 and brace 150 in inward-outward direction toward retainer 110 to form connections 125 and 135. In some embodiments, connections 125 and 135 are formed simultaneously as the combination of panel 140 and brace 150 is forced in inward-outward direction toward retainer 110. In other embodiments, connection 125 is formed prior to connection 135 or connection 135 is formed prior to connection 125, as desired.

Since space 104 may be relatively limited (e.g. between surface 14 of existing structure 10/multi-sided structure 12B and panels 140), it may be difficult to access first brace connector component 154 to form connection 135. For this reason, it may be beneficial to employ a first brace connector component 154 that is capable of being connected to secondary retainer connector component 130 by applying force in inward-outward direction 123 without having to access first brace connector component 154 itself. In some embodiments, first brace connector component 154 comprises a shoulder or surface 154G for receiving a tool (e.g. a screwdriver, hammer, block of wood, crowbar etc.) to apply force in inward-outward direction 123 to first brace connector component 154 as needed. In some embodiments, one or more surfaces 154H may be shaped and/or oriented (e.g. beveled or tapered) toward surface 154G to facilitate aligning a tool with surface 154G.

Figure 8:
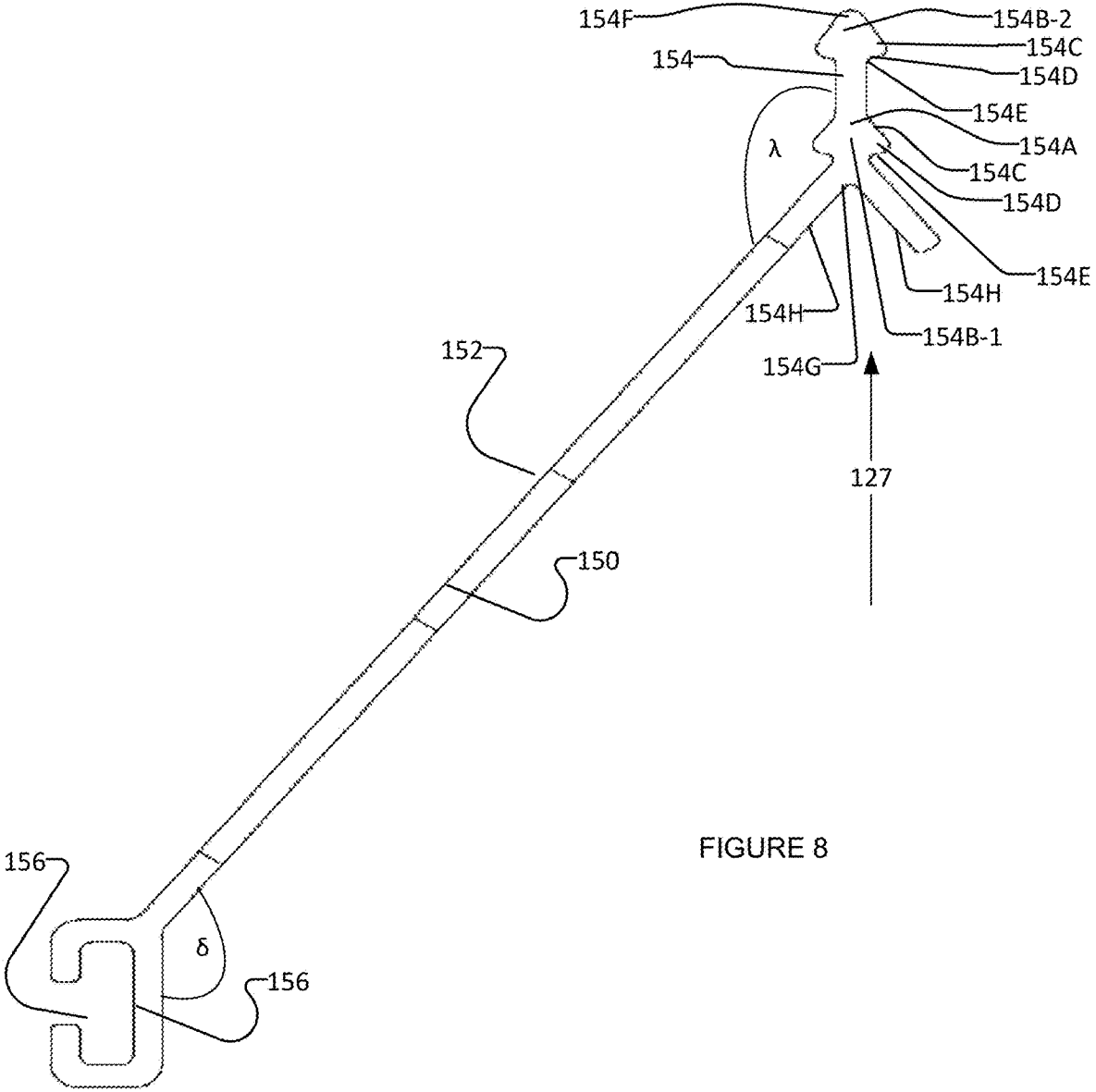
FIG. 8 depicts a top plan view of a brace for the repair structure and formwork apparatus of FIG. 2.
Figure 9:
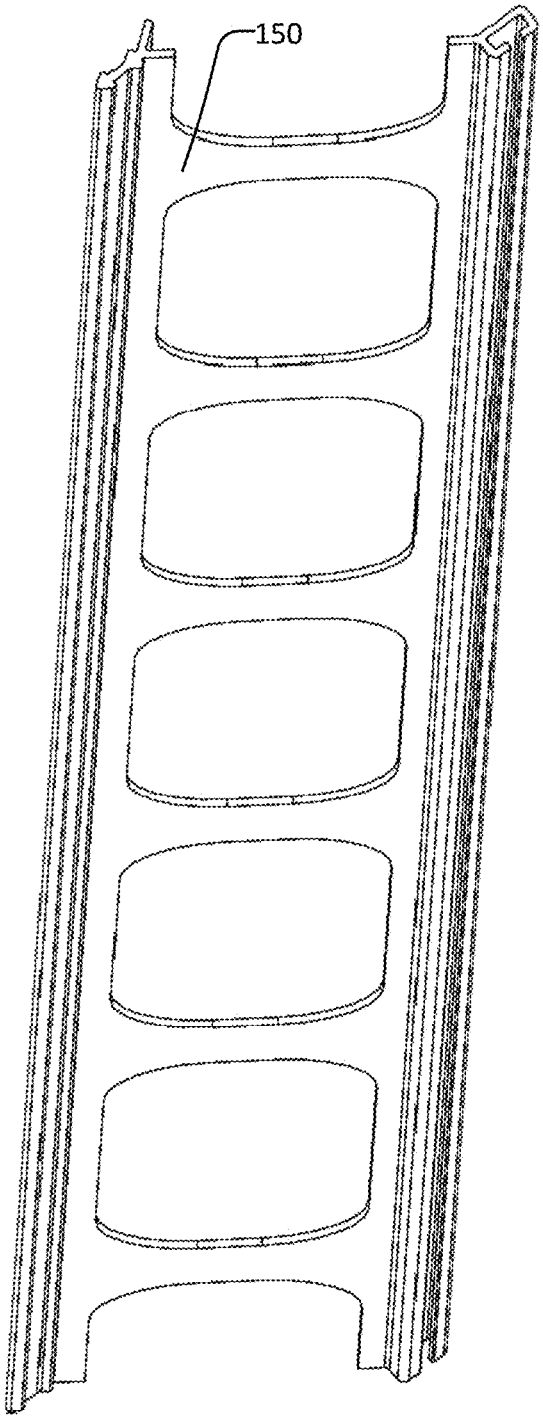
FIG. 9 depicts a perspective view of a brace for the repair structure and formwork apparatus of FIG. 2.

FIGS. 8 and 9 depict a first brace connector component 154 of brace 150 according to one embodiment. First brace connector component 154 of brace 150 comprises a spine 154A protruding at angle A from brace 150. Spine 154A may extend longitudinally across brace 150. In some embodiments, spine 154A extends across the entire longitudinal dimension of brace 150 while in other embodiments spine 154A only extends across a portion of the brace 150. In further embodiments, multiple spines 154A may be spaced apart along the longitudinal dimension of brace 150.

First brace connector component 154 may comprise one or more arrowheads 154B, each having a transverse cross-sections shaped like an arrowhead, at locations on spine 154A, spaced apart from brace 150. For example, in FIG. 8, first brace connector component 154 comprises a first arrowhead 154B-1 on spine 154A at a first location spaced apart from brace 150 and a second arrowhead 154B-2 on spine 154A at a second location space relatively further apart from brace 150 in inward-outward direction 123.

First arrowhead 154B-1 may comprise any suitable transverse cross-sectional shape such as a circle, a triangle, a rhombus or an arrowhead as described below. In the illustrated embodiment, a transverse cross-section of arrowhead 154B-1 comprises lobes projecting transversely in opposing directions from spine 154A. The transversely projecting lobes taper in direction 127 away from brace 150. As can be seen from FIG. 8, the tapered faces 154C of first arrowhead 154B-1 are relatively planar. This is not mandatory. Tapered faces 154C may be arcuate, stepped or the like. Tapered face 154C terminates at a corner 154D. In some embodiments, corner 154D is rounded or beveled, as illustrated. This is not mandatory, corner 154D could be a sharp corner (e.g. an acute angled corner). The intersection of corner 154D and spine 154A defines a concavity 154E. Concavity 154E may comprise a locking feature for lockingly receiving a corresponding convexity of secondary retainer connector component 130.

Second arrowhead 154B-2 may comprise any suitable transverse cross-sectional shape and may or may not be the same transverse cross-sectional shape as first arrowhead 154B-1. In the illustrated embodiment, arrowhead 154B-2 comprises lobes projecting transversely in opposing directions from spine 154A. The transversely projecting lobes taper in direction 127 away from brace 150. As can be seen from FIG. 8, the tapered faces 154C of second arrowhead 154B-2 are relatively planar. This is not mandatory. Tapered faces 154C may be arcuate, stepped or the like. Tapered face 154C terminates at a corner 154D. In some embodiments, corner 154D is rounded or beveled, as illustrated. This is not mandatory, corner 154D could be a sharp corner (e.g. an acute angled corner). The intersection of corner 154D and spine 154A defines a concavity 154E. Concavity 154E may comprise a locking feature for lockingly receiving a corresponding convexity of secondary retainer connector component 130. Opposing tapered faces 154C of second arrowhead 154B-2 meet to define a tip 154F. Tip 154F may be rounded, as illustrated, or may be a sharp corner (e.g. an acute angled corner).

Returning back to FIGS. 4A and 4B, secondary retainer connector component 130 comprises a receptacle comprising a first cavity 130A and a second cavity 130B all defined by a wall 132. In particular, first cavity 130A is defined by a first portion 132A of wall 132 and second cavity 130B is defined by a second portion 132B of wall 132. First cavity 130A is connected to second cavity 130B by a neck cavity 130D and first portion 132A is connected to second portion 132B by a neck 132D. An opening 130E in first cavity 130A is defined by first convexities 130F of first portion 132A. Second convexities 130G are defined by the intersection of second part 132B and neck 132D.

In some embodiments, a beveled guide portion 1301 may protrude from or near each of first convexities 130F, as depicted in FIGS. 4C and 4D. Beveled guide portions 1301 may serve to guide tip 154F into opening 130E during the formation of connection 135.

First cavity 130A may correspond in shape to arrowhead 154B. This is not mandatory. Alternatively, first cavity 130A may comprise a different shape that is complementary to the shape of one or both of arrowheads 154B such as the circular shape of second cavity 130B. Similarly, second cavity 130B may be substantially circular in shape as depicted or may comprise a different shape that is complementary to one or both of arrowheads 154B.

Convexities 130F of first portion 132A of wall 132 define opening 130E. Opening 130E may be relatively smaller that a maximum transverse dimension of arrowheads 154B. Opening 130E may also be relatively larger than a minimum transverse dimension of arrowheads 154B, such as the transverse dimension at tip 154F, to allow tip 154F to be inserted into opening 130E. Similarly, neck cavity 130D may be relatively smaller than a maximum transverse dimension of arrowheads 154B and relatively larger than a minimum transverse dimension of arrowheads 154B, such as the transverse dimension at tip 154F, to allow tip 154F to be inserted into neck 130D.

FIGS. 11A-11G are partial top plan views of the formation of an example connection 135 between secondary retainer connector component 130 and first brace connector component 154 of brace 150. To form a connection 135 therebetween, first brace connector component 154 of brace 150 is forced in inward-outward direction 123 into secondary retainer connector component 130 of retainer 110. Such force could be applied to surface 154G by a tool or the like.

Figure 11A:
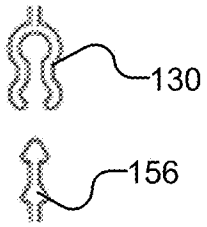
FIGS. 11A-11G depict top plan views of the formation of a connection between a retainer and a brace of the repair structure and formwork apparatus of FIG. 2.

FIG. 11A shows first brace connector component 154 and secondary retainer connector component 130 prior to the formation of connection 135. In the illustrated embodiment, tip 154F of male connector component is aligned in transverse direction 121 with opening 130E of secondary retainer connector component 130 in preparation for forming connection 135.

Figure 11B:
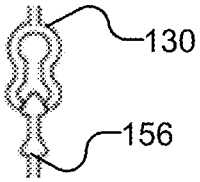

FIGS. 11B to 11G show various further stages in the process of forming connection 135 between first brace connector component 154 and secondary retainer connector component 130. FIG. 11B shows first brace connector component 154 as it begins to engage secondary retainer connector component 130. The narrow end of arrowhead 154B-2 (i.e. tip 154F) enters into opening 130E of first cavity 130A between first wall portions 132A. As a result, first wall portions 132A begin to resiliently deform substantially outwardly in transverse direction 121 due to the force applied by arrowhead 154B-2. This deformation results in opening 130E being widened. In the illustrated embodiment convexities 130F are shaped to complement similarly beveled surfaces 154C of arrowhead 154B-2, thereby facilitating the insertion of arrowhead 154B-2 into opening 130E of secondary retainer connector component 130 and the corresponding widening of opening 130E due to the deformation of first wall portions 132 A.

Figure 11C:
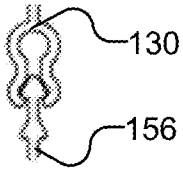

FIG. 11C shows first brace connector component 154 further inserted into secondary retainer connector component 130 such that arrowhead 154B-2 is completely inserted into first cavity 130A. To achieve this, opening 130E is widened to allow the largest transverse portion of arrowhead 154B-2 to pass by convexities 130F. After the largest transverse portion of arrowhead 154B-2 passes through opening 130E, first wall portions 132 A begin to resiliently snap back around arrowhead 154B-2 into a first locked position (due to restorative deformation) once arrowhead 154B-2 passes convexities 130F. As first wall portions 132A snap back (i.e.

restoratively deform), convexities 130F engage concavities 154E of second arrowhead 154B-2 to achieve the first locked position.

In the first locked position of the illustrated embodiment, the extension of convexities 130F into concavities 154E secures or locks connection 135 by providing an obstacle that hinders first wall portions 132A from being moved away from one another and releasing second arrowhead 154B-2 and hinders first brace connector component 154 from being withdrawn from secondary retainer connector component 130 (e.g. in inward-outward direction 123).

Figure 11D:
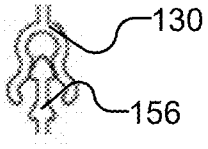

FIG. 11D shows first brace connector component 154 further inserted into secondary retainer connector component 130 such that arrowhead 154B-2 is beginning to enter neck cavity 130D. To achieve this, neck cavity 130D is widened to allow the largest transverse portion of arrowhead 154B-2 to pass into neck cavity 130D. As a result, neck 132D begins to resiliently deform substantially outwardly in transverse direction 121 due to the force applied by arrowhead 154B-2. This deformation results in neck cavity 130D being widened. This deformation also results in the widening of opening 130E which thereby eases the insertion of first arrowhead 154B-1 into first cavity 130A.

Figure 11E:
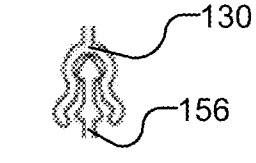

FIG. 11E shows first brace connector component 154 even further inserted into secondary retainer connector component 130 such that arrowhead 154B-2 has passed through neck cavity 130D and has completely entered second cavity 130B. After the largest transverse portion of arrowhead 154B-2 passes through neck cavity 130D, neck portion 132D begins to resiliently snap back (i.e. restoratively deform) around arrowhead 154B-2 into a second locked position once arrowhead 154B-2 passes convexities 130G. As neck 132D snaps back, convexities 130G engage concavities 154E of second arrowhead 154B-2 to partly achieve a second locked position.

At this point, first arrowhead 154B-1 has partially passed opening 130E and neck 132D is not able to completely snap back due to the force exerted by first arrowhead 154B-1 on opening 130E. Similar to with second arrowhead 154B-2, convexities 130F are shaped to complement similarly beveled surfaces 154C of first arrowhead 154B-1, thereby facilitating the insertion of first arrowhead 154B-1 into opening 130E of secondary retainer connector component 130 and the corresponding widening of opening 130E due to the deformation of first wall portions 132A.

As can be seen in FIG. 11E, second cavity 130B has a slightly larger inward-outward direction 123 dimension than does second arrowhead 154B-2. To allow first arrowhead 154B-1 to completely enter first cavity 130A, first brace connector component 154 is inserted deeper into secondary retainer connector component 130 such that second arrowhead 154B-2 reaches or nearly reaches the end 130H of second cavity 130B.

Figure 11F:
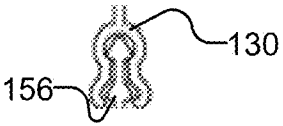

FIG. 11F shows second arrowhead 154B-2 in contact with end 130H of second cavity 130B which thereby allows first arrowhead 154B-1 to pass convexities 130F and completely enter first cavity 130A. After the largest transverse portion of first arrowhead 154B-1 passes through opening 130E, first wall portions 132A are able to resiliently snap back around first arrowhead 154B-1. As second arrowhead 154B-2 remains forced into contact with end 130H of second cavity 130B, tapered surfaces 154C of first arrowhead 154B-1 engage neck 132D. In this way, first arrowhead 154B-1 may force neck 132D to widen slightly.

Figure 11G:
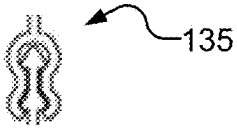

As the force pushing second arrowhead 154B-2 into contact with end 130H of second cavity 130B is removed, neck 132D and leg 154G may snap back (due to the resilient deformation), thereby forcing tapered surfaces 154C out of neck cavity 130D and thereby forcing first brace connector component 154 into a second locked position, as illustrated in FIG. 11G. As first wall portions 132A snap back, convexities 130F engage concavities 154E of first arrowhead 154B-1 to achieve a second locked position.

In the second locked position of the illustrated embodiment, convexities 130G, 130F engage concavities 154E. The extension of convexities 130F, 130G into concavities 154E secures or locks connection 135 by providing multiple obstacles that hinder first wall portions 132A, neck 132D and second wall portions 132B from being moved away from one another and releasing arrowheads 154 and thereby hinder first brace connector component 154 from being withdrawn from secondary retainer connector component 130 (e.g. in inward-outward direction 123). The second locked configuration is supplemented by restorative deformation forces applied to tapered surfaces 154C of first arrowhead 154B-1 by neck 132D Referring back to FIG. 2, once a first retainer 110-1 is mounted to surface 14A of existing structure 10 and connection 125 (and optionally connection 135) is formed between first retainer 110-1 and a first panel 140-1 (and optionally a brace 150), additional panels 140 may be connected to first panel 140-1 by forming connections 165. As discussed above, connections 165 may formed in a substantially similar manner to connection 125.

In the illustrated embodiment, first panel 140-1 is connected to a second panel 140-2 by a connection 165. In the illustrated embodiment, second panel 140-2 comprises a corner panel 140'. This is not mandatory. Second panel 140-2 may comprise a straight panel 140 or a corner panel 140' as desired or based on the shape of multi-sided structure 12B. Second panel 140-2 is in turn connected to a third panel 140-3 which is in turn connected to a fourth panel 140-4—also a corner panel 140'—which is in turn connected to a fifth panel 140-5, each connected by connections 165. Fifth panel 140-5 is connected to a second retainer 110-2 (and optionally a brace 150), which is in turn mounted to existing structure 10 such that formwork apparatus 100 substantially surrounds surfaces 14B-1, 14B-2 and 14B-3 of three-sided structure 12B to form space 104 for receiving curable material such as concrete to form repair structure 102.

Corner panel 140' is substantially similar to panel 140 except in that first panel connector component 160 of corner panel 140' is arranged at an angle $\phi$ with respect to second panel connector component 170 or corner panel 140' where angle $\phi$ is not zero or substantially equal to zero. For example, in the case of the illustrated embodiment, angle $\phi$ is equal to approximately 90°. This is not mandatory. Angle $\phi$ may be chosen based on a shape of multi-sided structure 12B. Moreover, any combination of panels 140 and corner panels 140' may be employed to define a space 104 of a desired shape around multi-sided structure 12B. While panel 140' is depicted as having a beveled corner 140A, this is not mandatory. Corner 140A may be square or rounded or shaped as desired.

Second retainer 110-2 is substantially like first retainer 110-1 except in that primary retainer connector component 120' of second retainer 110-2 comprises a receptacle 122' similar to receptacle 162, as discussed herein. In this way, panels 140 may be connected to first retainer 110-1 and second retainer 110-2 to form formwork apparatus 100 without adapters between retainer 110-1 (or retainer 110-2) and panels 140.

Figure 12A:
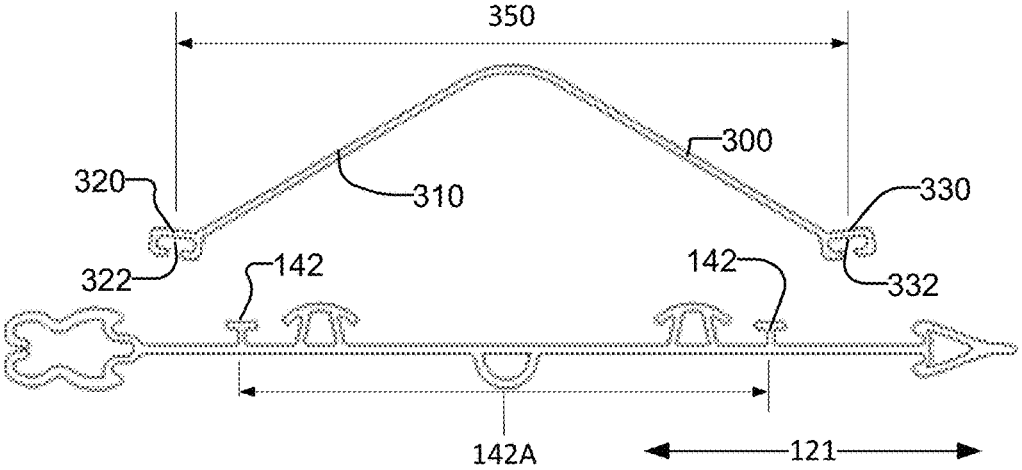
FIGS. 12A and 12B depict top plan views of the attachment of a standoff to a panel of a repair structure and formwork apparatus according to a particular embodiment of the invention.
Figure 12B:
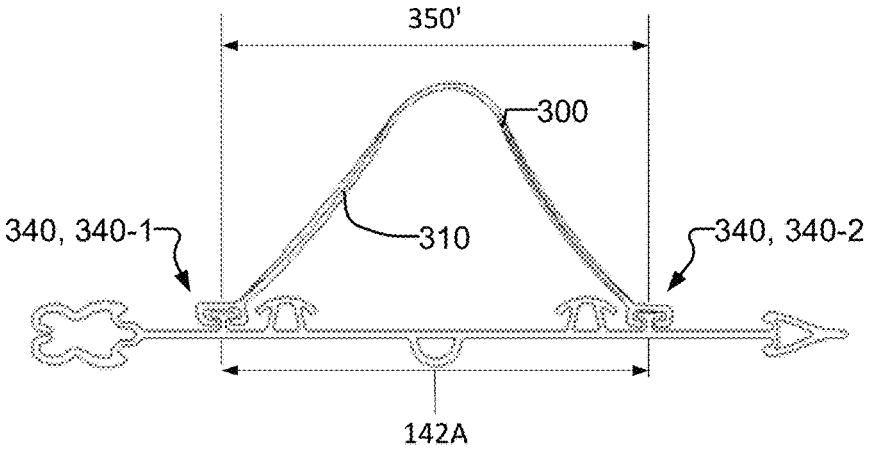
Figure 12C:
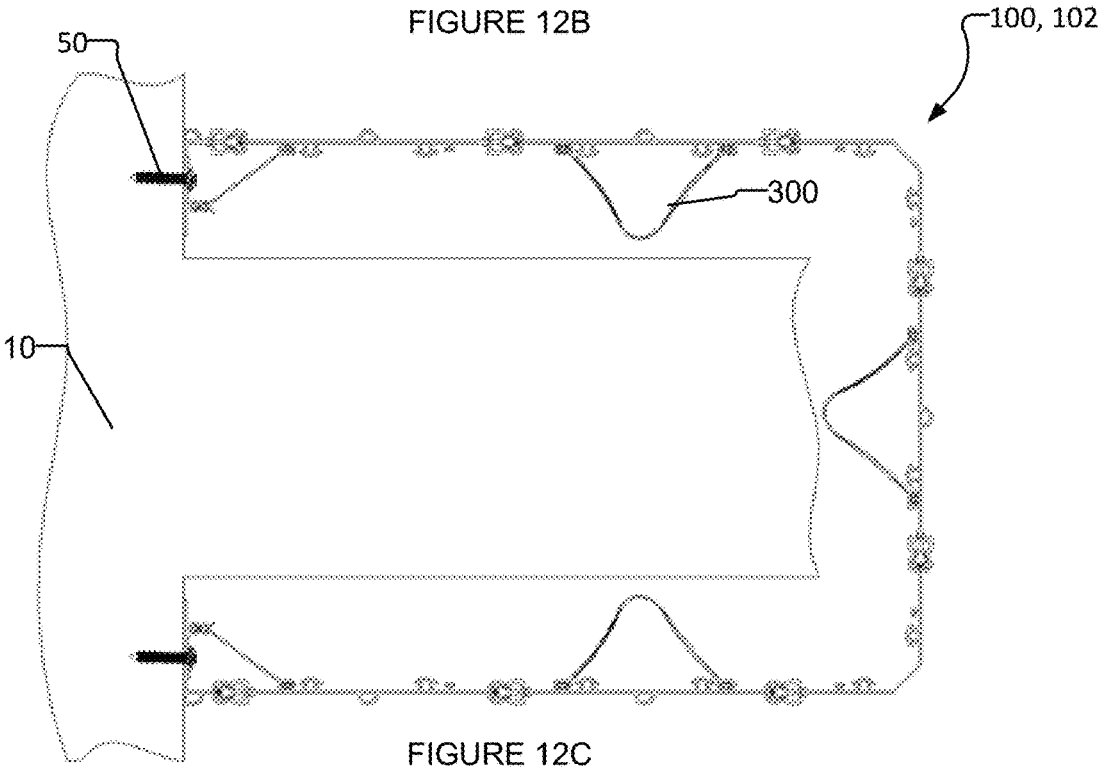
FIG. 12C depicts the repair structure and formwork apparatus of FIGS. 12A and 12B.

In some embodiments, it may be desirable to employ one or more standoffs to maintain alignment of panels 140 with respect to existing structure 10 and/or multi-sided structure 12B. In some embodiments, standoffs may be attached directly to existing structure 10 and/or multi-sided structure 12B and panels 140. In other embodiments, it is not practical and/or desirable to attach standoffs to existing structure 10 and/or multi-sided structure 12B. FIGS. 12A to 12C depict a standoff 300 couplable to panels 140 for maintaining a desired alignment between panels 140 and existing structure 10 and/or multi-sided structure 12B.

Standoff 300 may comprise a longitudinally extending deformable section 310 which extends transversely between a first standoff connector component 320 and a second standoff connector component 330. In some embodiments, a longitudinal dimension of standoff 300 is approximately equal to the longitudinal dimension of panels 140. This is not mandatory. For example, in some embodiments, the longitudinal dimension of standoff 300 is smaller than the longitudinal dimension of panels 140. As shown in FIG. 12A, deformable section 310 of standoff 300 is not necessarily straight and may exhibit some curvature along its transverse dimension. Such curvature may facilitate installation of standoff 300, as discussed further herein.

First and second standoff connectors 320, 330 may be shaped to connect to component 142 of panel 140. In some embodiments, panel 140 comprises a connector component 142 in the form of a T-connector component sized and shaped to cooperate with a C or channel shaped standoff connector component 320, 330 of standoff 300. In some embodiments, a connection 340 is formed between first or second standoff connector component 320, 330 of standoff 300 and connector component 142 by sliding first or second standoff connector component 320, 330 in longitudinal direction 119 relative to connector component 142. In some embodiments, sliding first or second standoff connector component 320, 330 relative to connector component 142 comprises sliding T-connector component 142 into a channel 322 or channel 332 defined by first standoff connector component 320 or second standoff connector component 330 respectively. In some embodiments, first or second standoff connector component 320, 330 may be connected to connector component 142 by forcing them toward one another in transverse direction 121 and/or inward-outward direction 123 or by pivoting first or second standoff connector component 320, 330 relative to connector component 142. Connection 340 may comprise a snap-together connection, a friction fit connection, a displacement fit connection or the like.

As can be seen by comparing FIG. 12A and FIG. 12B, a transverse dimension 350 of standoff 300 in an undeformed state is wider than transverse spacing 142A between connectors 142 of panel 140 (see FIG. 12A). As such, after a first connection 340-1 between first standoff connector component 320 and a first panel connector component 142 of panel 140 is formed, standoff 300 may be deformed such that transverse dimension 350 substantially matches transverse spacing 142A and second standoff connector component 330 is aligned with a second panel connector component 142 of panel 140 to allow for the formation of a second connection 340-2 (see FIG. 12B).

When first and second connections 340-1, 340-2 are both formed, standoff 300 may retain at least some of the deformation caused during the formation of first and second connections 340-1, 340-2. In some embodiments, restorative deformation forces associated with restoring standoff 300 to its undeformed state (e.g. due to the resiliency or elastic nature of standoff 300) may cause at least some restorative deformation of standoff 300 to its undeformed state (e.g. to increase transverse dimension 350). Such restorative deformation forces may cause first and second standoff connectors 320, 330 to push against connectors 142 of panel 140 in positive and negative transverse directions 121 thereby increasing friction between first and second standoff connectors 320, 330 and connectors 142 of panel 140. Such increased friction may prevent or impede relative movement of standoff 300 and panel 140 in longitudinal direction 119. In some embodiments, such increased friction may be employed to locate standoff 300 at a desired position in longitudinal direction 119 relative to panel 140 without standoff 300 moving under, for example, the force of gravity or forces associated with curable material poured into space 104.

Once installed, standoff 300 may function to maintain a desired spacing between existing structure 10 and/or multi-sided structure 12B and panels 140 (e.g. standoff 300 may function to maintain space 104). Any number of standoffs 300 may be employed, as desired. In some embodiments, first standoff connector component 320 may be connected to a first panel 140-1 and a second standoff connector component 330 may be connected to a second panel 140-2 (not depicted). In some embodiments, standoff 300 may be connected to one or more panels 140 without substantial deformation of standoff 300.

In some embodiments, it may be desirable to provide an exterior surface of panels 140 and retainers 110 with a flush appearance. Consequently, connections and connector components may be inwardly offset from the plane of panels 140. FIGS. 13A to 13D depict components of a formwork apparatus that provide an exterior surface of panels and retainers. The formwork apparatus of FIGS. 13A to 13D is substantially similar to formwork apparatus 100 except as follows.

Figure 13A:
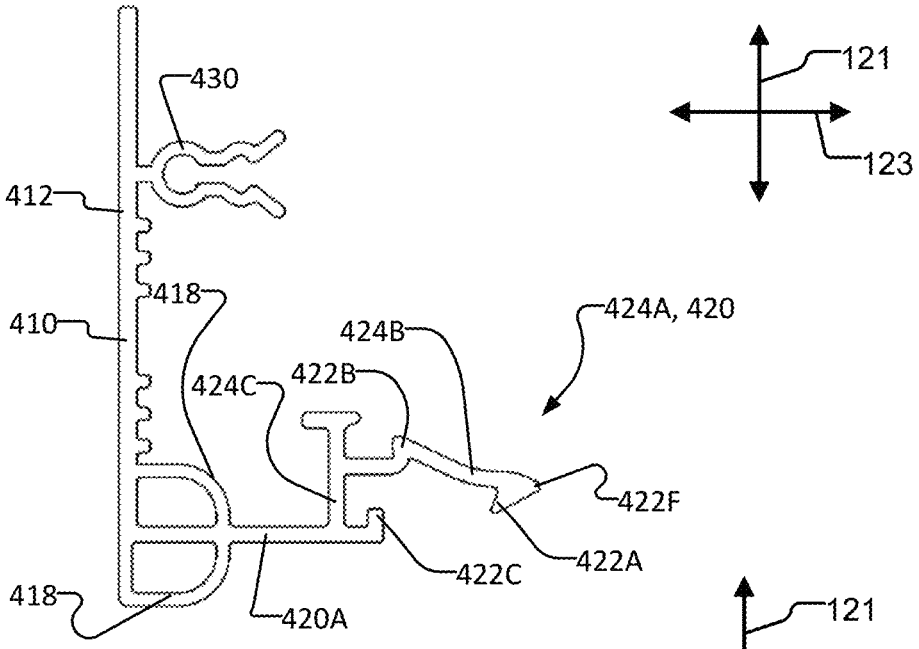
FIG. 13A depicts a top plan view of a retainer of a formwork apparatus according to a particular embodiment of the invention.
Figure 13B:
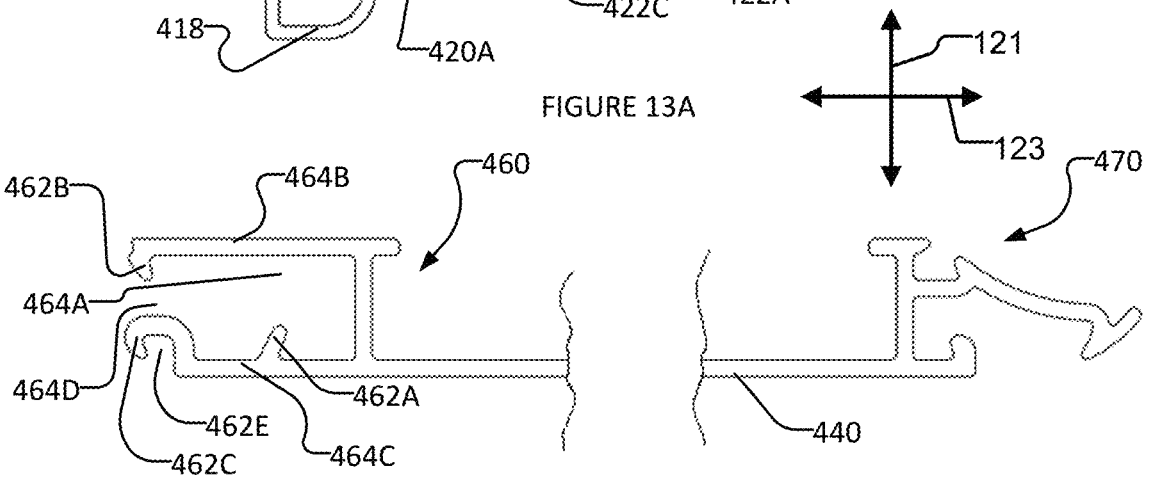
FIG. 13B depicts a top plan view of a truncated portion of a panel of a formwork apparatus according to a particular embodiment of the invention.
Figure 13C:
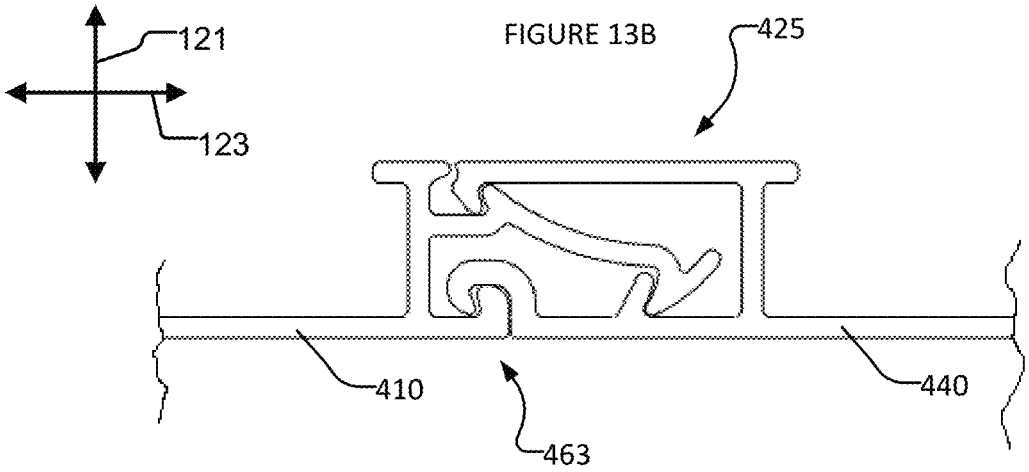
FIG. 13C depicts a top plan view of a connection between the FIG. 13A retainer and the FIG. 13B panel.

FIGS. 13A, 13B and 13C are partial top plan views of the connection process of an example connection 425 between a primary connector component 420 of a retainer 410 and a first panel connector component 460 of a panel 440. In the illustrated embodiment, connection 425 is inwardly offset from the plane of panels 440 (e.g. in a direction toward existing structure 10), allowing for a relatively even exterior panel surface when connection 425 is formed. Such offset is not necessary. To form connection 425, primary connector component 420 of a retainer 410 is forced in direction 123 into panel connector component 460 of a panel 440. It should be understood that a similar connection may be formed between adjacent panels 440 by a connecting first panel connector component 460 of a first panel and a second panel connector 470 of a second panel.

FIGS. 13A and 13B show primary connector component 420 of retainer 410 and first panel connector component 460 of panel 440 prior to edge-to-edge connection 425 being formed. In the illustrated embodiment, primary connector component 420 comprises a protrusion 424A having a stem 424B and barbs 422A, 422B. Barbs 422A, 422B extend from stem 424B at spaced apart locations on stem 424B and stem 424B extends away from a base 424C. It can be seen from FIG. 13A that barbs 422A, 422B extend toward base 424C as they extend away from stem 424B and that barbs 422A, 422B extend inwardly and outwardly (positive and negative direction 121) from stem 424B (i.e. from opposing sides of stem 424B) In some embodiments, different numbers of barbs 422A, 422B may extend from stem 424B and such barbs 422A, 422B may extend inwardly and outwardly from stem 424B at spaced apart locations.

Stem 420A may be supported by one or more reinforcements 418. In some embodiments, reinforcements 418 may be located on an outer side of stem 420A and on an inner side of stem 420A, such as is depicted in FIG. 13A. In some embodiments, reinforcements 418 may be located on only one of the inner and outer sides of stem 420A. Reinforcements 418 may serve to reduce deformation of stem 420A and thereby to improve alignment of panels 440 relative to existing structure 10 and/or multi-sided structure 12B and prevent deformation of the formwork apparatus due to, for example, gravity and/or forces associated with curable material.

First panel connector component 460 comprises a receptacle 464A shaped to complement and receive protrusion 424A. Receptacle 464A comprises walls 464B, 464C each having a catch 462A, 462B extending into receptacle 464A at spaced apart locations to engage spaced apart barbs 422A, 422B of primary connector component 420. Receptacle 464A forms an opening 464D between catch 462B and a finger 462C. As barb 422A and catch 462A and barb 422B and catch 462B extend in similar orientations to one another, barbs 422A, 422B are able to slide past catches 462A, 462B as panel 440 moves relative to retainer 410 in direction 123. Once connection 425 is formed, barbs 422A, 422B extend into concavities behind catches 462A, 462B and catches extend into concavities behind barbs 422A, 422B, such that panel 440 is hindered from moving relative to retainer 410 in transverse direction 123. In some embodiments, barbs 422A, 422B and catches 462A, 462B have an angle of between 30 and 60 degrees relative to the plane of panel 440 and stem 420A of retainer 410.

As primary connector component 420 begins to engage first panel connector component 460, a tip 422F of protrusion 424A may first engage catch 462B of receptacle 464A. In the illustrated embodiment, tip 422F is slightly beveled in a direction similar to the extension of catch 462B to facilitate tip 422F sliding past catch 462B into 464D between catch 462B and finger 462C of receptacle 464A. In some embodiments, tip 422F may have an angle of between 0 and 45 degrees relative to stem 424B. In some embodiments, tip 422F may have an angle of between 5 and 20 degrees relative to stem 424B.

Catch 462B is displaced in direction 121 by tip 422F as barb 422A engages finger 462C of receptacle 464A. This displacement results in resilient deformation of wall 464B and expansion of opening 464D. The sliding of barb 422A over finger 462C is facilitated by barb 422A extending toward base 368 of protrusion 424A and away from tip 422F (i.e. in transverse direction 123) as barb 422A extends away from stem 424B. In some embodiments, the sliding of tip 422F and/or barb 422A past catch 462B and finger 462C may cause some resilient deformation of wall 464C and corresponding displacement of finger 462C in direction 121.

As the connection process moves past this intermediate stage, tip 422F and barb 422A contact catch 462A and barb 422B contacts catch 462B. The interaction between barb 422B and catch 462B and barb 422A and catch 462A may cause resilient deformation of both wall 464B and stem 424B in direction 121 and/or wall 464C in direction 121. This allows each of barbs 422A, 422B to move past catches 462A, 462B into receptacle 464A to form connection 425.

At about the same time, finger 462C of first panel connector component 460 begins to contact finger 422C of primary connector component 420 causing wall 464C to deform in direction 121 and/or finger 422C to deform until finger 422C enters concavity 462E first panel connector component 460. Together, finger 462C and concavity 462E provide a finger lock 463 between primary connector component 420 and first panel connector component 460. Finger lock 463 provides a relatively even external surface between panel 440 and retainer 410. An even surface between panel 440 and retainer 410 of connection 425 may provide a suitable surface for additional coverings such as paint, wallpaper, sealant and/or the like.

FIG. 13C shows completed connection 425. Barb 422B has passed catch 462B, barb 422A has passed catch 462A. In some embodiments, catch 462B applies restorative deformation forces to protrusion 424A. This may be because stem 424B prevents wall 464B (and catch 462B) from returning to their original, undeformed, shapes.

When connection 425 is completed, the interaction between barbs 422A, 422BA and catches 462A, 462B prevent primary connector component 420 from moving relative to first panel connector component 460 in transverse direction 123 and thereby disengaging from first panel connector component 460.

FIG. 13C also shows completed finger lock 463 with finger 462C fully engaged in concavity 462E. As shown, finger 462C is offset from the exterior plane of retainer 410. In addition to providing an even or smooth surface between panels 440 and 302B, finger lock 463 may strengthen connection 425 by providing additional contact surfaces and constraints between primary connector component 420 and first panel connector component 460. Finger lock 463 may also reduce the formation of gaps when forces are applied to connection 425.

The particular elements and shape of the elements of primary connector component 420 and first panel connector component 460 may be varied in numerous ways. For example, the angle of barbs 422A, 422B and catches 462A, 462B may vary from 5 degrees to 85 degrees. Also, in some embodiments, barbs 422A, 422B and/or catches 462A, 462B may comprise surfaces that are rough, jagged, adhesive or the like to strengthen the engagement between barbs 422A, 422B and catches 462A, 462B. In some embodiments, barbs 422A, 422B and/or catches 462A, 462B may comprise hooks shaped to engage the corresponding barbs 422A, 422B and/or catches 462A, 462B. In some embodiments, finger lock 463 may comprise hooks, jagged surfaces, or other connection mechanisms. In some embodiments, finger lock 463 is not necessary.

Figure 13D:
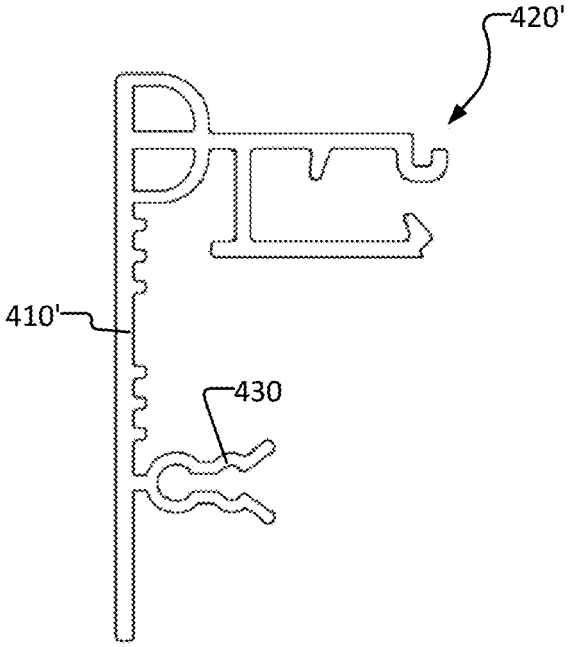
FIG. 13D depicts a top plan view of a retainer of a formwork apparatus according to a particular embodiment of the invention.

While primary retainer connector component 420 is described as comprising a protrusion 424A, this is not mandatory. Instead, a primary retainer connector component 420' of a retainer 410' may, for example, comprise a receptacle similar to receptacle 464A of first panel connector component 460 as shown in FIG. 13D. In that case, a second panel connector component 470 of panel 440, which comprises a protrusion, may connect to connector component 420' to form a connection 425' (not shown).

Figure 14A:
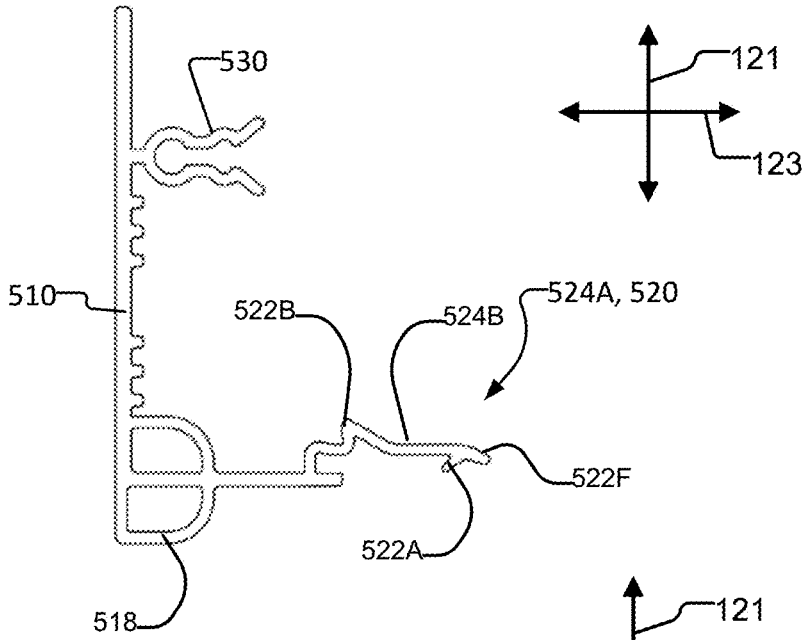
FIG. 14A depicts a top plan view of a retainer of a formwork apparatus according to a particular embodiment of the invention.
Figure 14B:
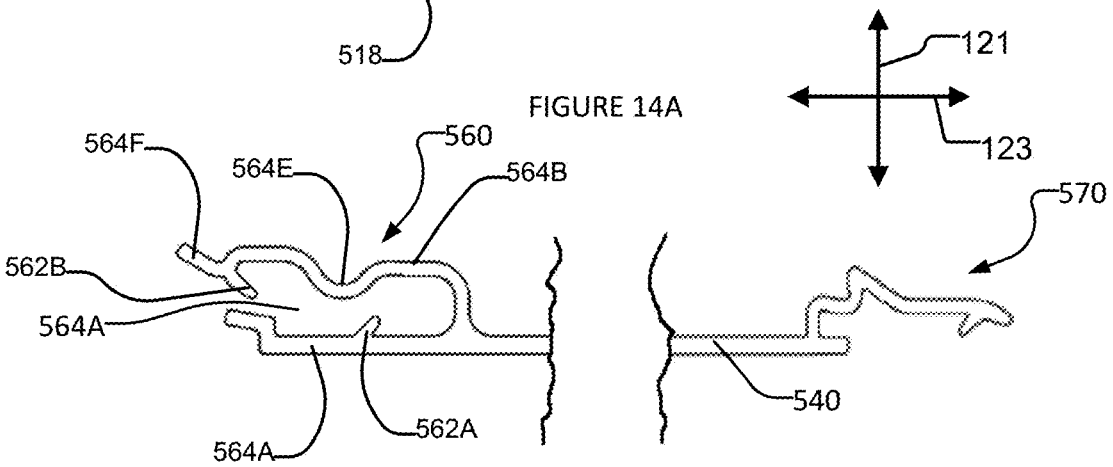
FIG. 14B depicts a top plan view of a truncated portion of a panel of a formwork apparatus according to a particular embodiment of the invention.
Figure 14C:
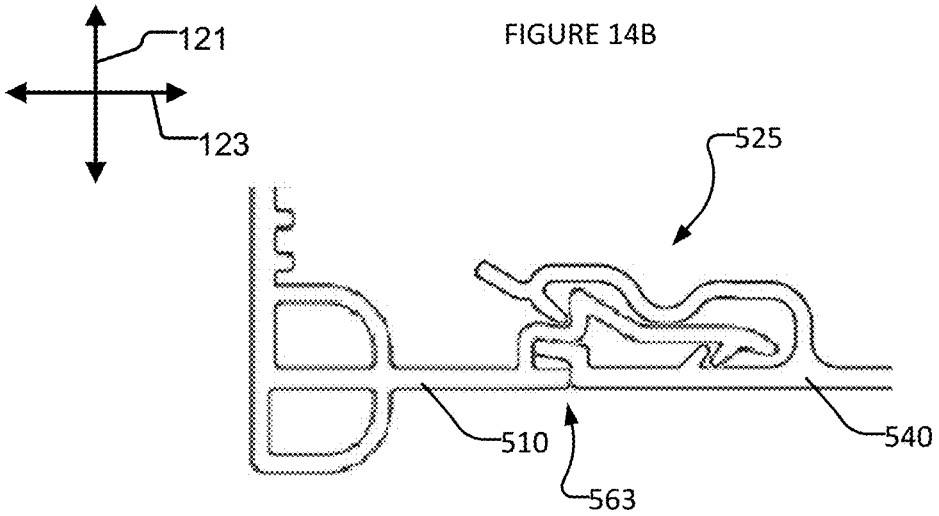
FIG. 14C depicts a top plan view of a connection between the FIG. 13D retainer and the FIG. 134 panel.
Figure 14D:
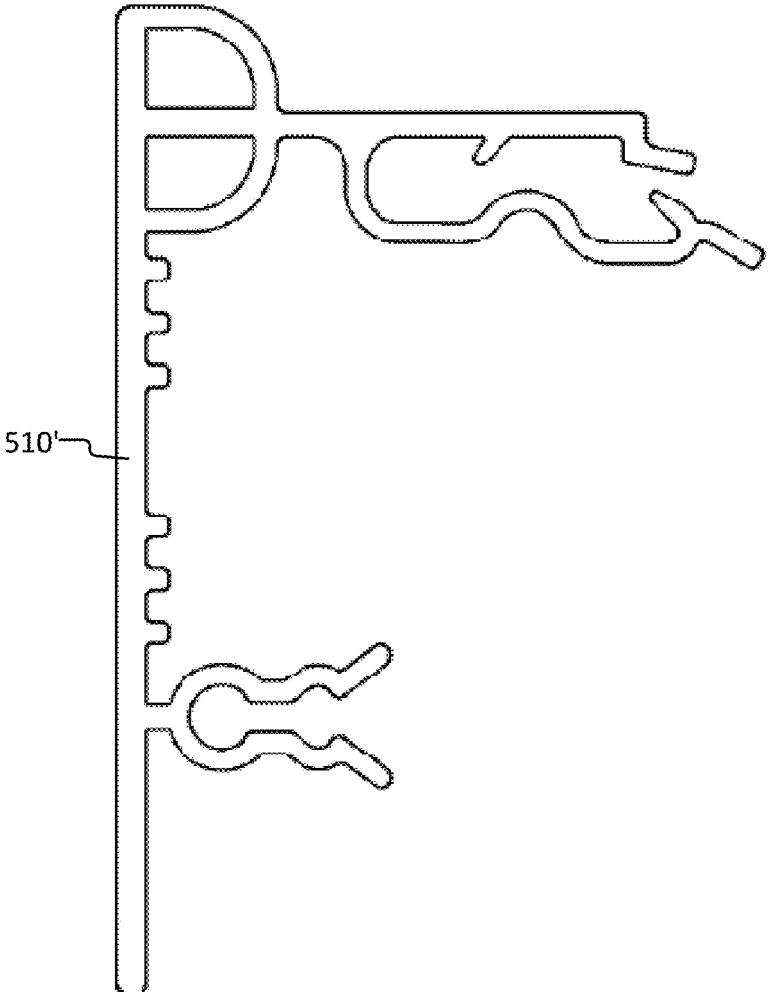
FIG. 14D depicts a top plan view of a retainer of a formwork apparatus according to a particular embodiment of the invention.

FIGS. 14A, 14B and 14C are partial top plan views of the connection process of an example connection 525 between a primary connector component 520 of a retainer 510 and a first panel connector component 560 of a panel 540. In the illustrated embodiment, connection 525 is inwardly offset from the plane of panels 540 (e.g. in a direction toward existing structure 10), allowing for a relatively even exterior panel surface when connection 525 is formed. Such offset is not necessary. To form connection 525, primary connector component 520 of a retainer 510 is forced in direction 123 into panel connector component 560 of a panel 540. It should be understood that a similar connection may be formed between adjacent panels 540 by a connecting first panel connector component 560 of a first panel and a second panel connector 570 of a second panel.

Retainers 510, 510' and panel 540 are substantially similar to retainers 410, 410' and panel 440, except as described below. For example, primary connector component 520 of retainer 510 may comprise a securing protrusion 564E and a tab 564F. Similarly, second panel connector component 570 of panel 540 may also comprise a securing protrusion and tab similar to securing protrusion 564E and tab 564F. Connection 525 and connections between first and second panel connector components 560, 570 are formed in substantially the same way as connection 425 described above, except as follows.

During the formation of connection 525 and as protrusion 524A is extended further into receptacle 564A, tip 522F engages securing protrusion 564E. In the illustrated embodiment, securing protrusion 564E is shaped as an indentation in wall 564B, which may facilitate the resilient deformation of wall 564B by providing an area more susceptible to bending (i.e. resilient deformation). Also, securing protrusion 564E may force stem 524B in direction 121 to help catch 562B engage barb 522B when connection 525 is made. In other embodiments, securing protrusion 564E may be provided by a thickening of wall 564B and a corresponding protrusion which extends into receptacle 564A.

FIG. 14C shows completed connection 525. Barb 522B has passed catch 562A, barb 522A has passed catch 562B and securing protrusion 564E engages stem 524B. In some embodiments, catch 562A and securing protrusion 564E apply restorative deformation forces to protrusion 524A. This may be because stem 524B prevents wall 564A (and catch 562A and securing protrusion 564E) from returning to their original, undeformed, shapes.

When connection 525 is completed, the interaction between barbs 522B, 522A and catches 562A, 562B prevent first connector panel component 560 from moving relative to primary connector component 520 in transverse direction 123 and thereby disengaging primary connector component 520. Also, securing protrusion 564E may prevent barb 522A from slipping over catch 562B if, for example, retainer 510 and panel 540 are bent relative to one another. As mentioned, securing protrusion 564E applies a restorative deformation force in direction 121 to stem 524B, thereby hindering disengagement of barb 522A and catch 562B.

In some embodiments, securing protrusion 564E may extend from wall 564B (as opposed to being an indentation thereof as shown in, for example, FIG. 14C). In some embodiments, a securing protrusion may additionally or alternatively be provided on wall 564A. In some embodiments, protrusion 524A may comprise a complementary connector for engaging securing protrusion 564E such as an indentation, hook, protrusion or the like.

Tab 564F may be located proximate catch 562A at an end of wall 564B. Tab 564F allows for connection 525 to be disengaged by permitting a user to apply a force in direction 121 to tab 564F, causing resilient deformation of wall 564B and allowing barbs 522A, 522B to be disengaged from catches 562A, 562B. Once barbs 522A, 522B are disengaged from catches 562A, 562B, protrusion 542A may be removed from receptacle 564A, finger lock 563 may be disengaged and primary connector component 520 may be disengaged from first panel connector component 560.

In some embodiments, it may not be possible or desirable to mount a retainer to surface 14A of wall 12A, as discussed herein. For example, where wall 12A and multi-sided structure 12B are co-terminal, as shown in FIG. 15, it may be desirable to mount a retainer to an edge surface 14C of multi-sided structure 12B or wall 12A.

Figure 15:
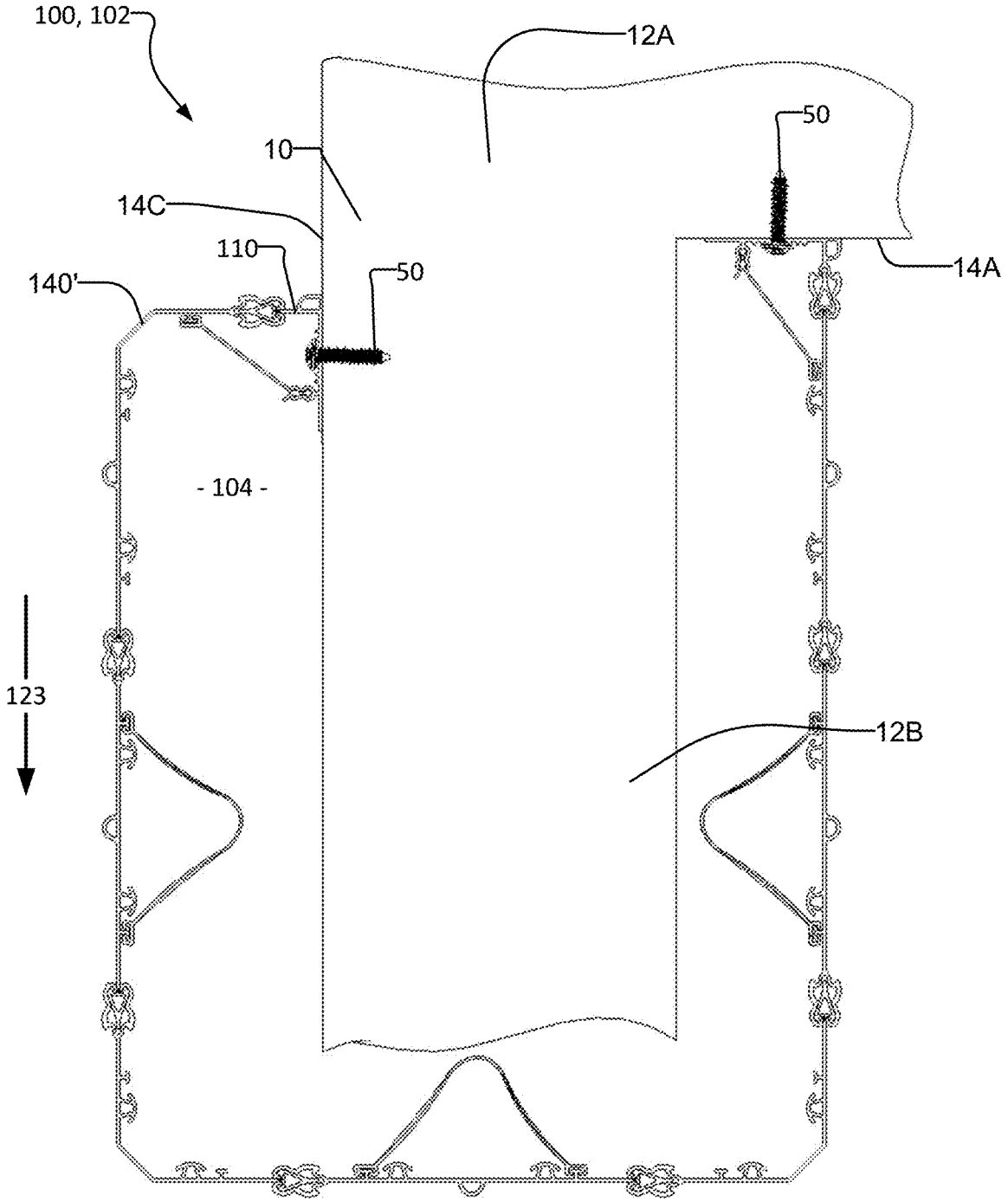
FIG. 15 depicts a repair structure and formwork apparatus according to a particular embodiment of the invention.

FIG. 15 shows a structure 10' and a formwork apparatus 100 adapted to attach a retainer 110 to edge surface 14C. As can be seen from FIG. 15, by providing an extra corner panel 140' retainer 110, retainer 110 may be mounted to edge surface 14C.

While retainer 110 (and other retainers described herein such as retainer 410, 410', 510, 510', etc.) may be suitable to be attached to edge surface 14C, in a manner similar to that shown in FIG. 15, it may be desirable to provide a modified retainer for attaching to edge surface 14C. For example, it may be desirable to provide reinforcements to such a retainer. This may be the case, for example, where wall 12A is a ceiling and multi-sided structure protrudes downward from ceiling 12A. In such a case, it may be desirable to reinforce a retainer attached to edge surface 14C to withstand the force of gravity without undesired bending or disengagement from edge surface 14C.

Any of the retainers described herein may be reinforced by extending the base (e.g. base 112, 412, etc.) past the primary retainer connector component (e.g. primary retainer connector component 120, 420, 520, etc.) and past any reinforcements (e.g. reinforcement 418, 518, etc.). The extension of the base may allow for additional fasteners and/or for additional braces 150 to be employed. Such additional fasteners and/or additional braces may be located outside of space 104.

Figure 16B:
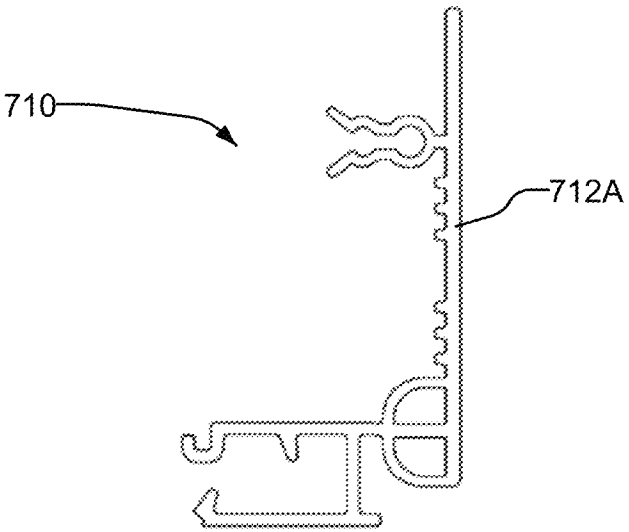
FIG. 16B depicts a top plan view of a retainer of a formwork apparatus according to a particular embodiment of the invention.
Figure 16A:
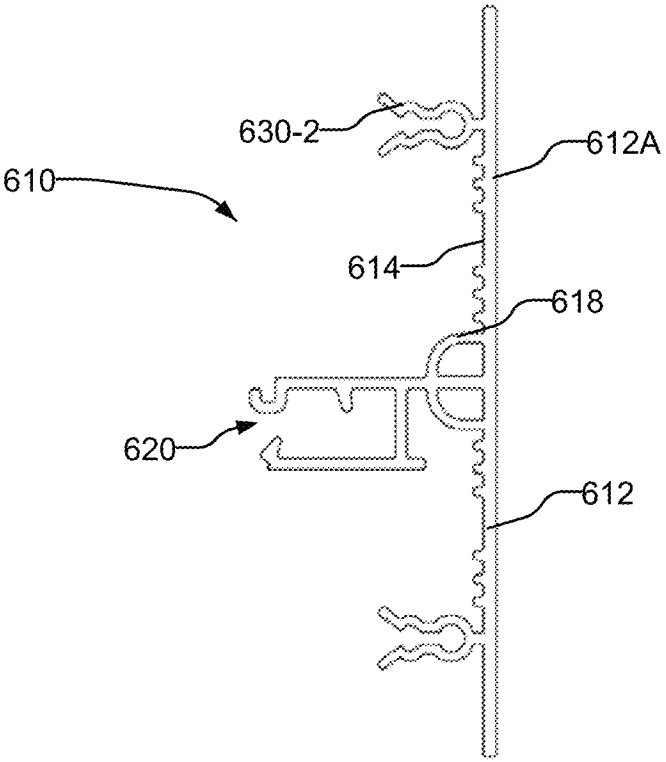
FIG. 16A depicts a top plan view of a retainer of a formwork apparatus according to a particular embodiment of the invention.

FIG. 16A depicts a retainer 610 for attaching to edge surface 14C (or surface 14A). Retainer 610 is substantially similar to retainer 410 except as follows. Base 612 of retainer is extended past primary retainer connector component 620 and reinforcement 618 to provide a base extension 612A. Primary retainer connector component 620 and reinforcement 618 may be substantially similar to primary retainer connector component 420 and reinforcement 418. However, it should be understood that primary retainer could be replaced with any of the connector components described herein (e.g. primary retainer connector components, 120, 120, 420, 420', 520, 520', etc.) and reinforcement 618 is optional.

Figure 17:
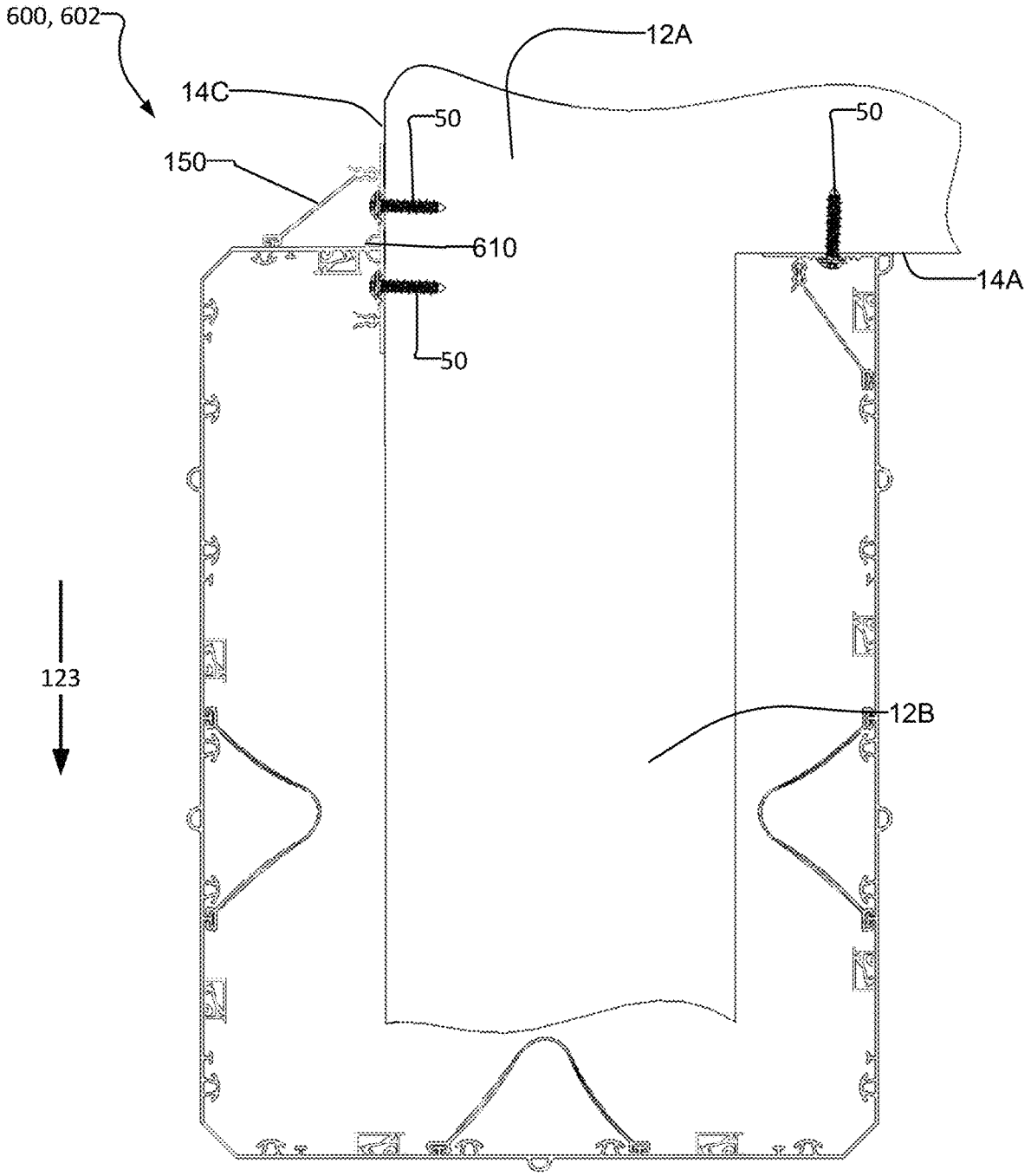
FIG. 17 depicts a repair structure and formwork apparatus according to a particular embodiment of the invention.

An outside secondary retainer connector component 630-2 may be provided on base extension 612A. Outside secondary retainer connector component 630-2 may be substantially similar to secondary retainer connector component 130 except that it is located outside of space 104. By attaching a brace 150 from outside secondary retainer connector component 630-2 to a panel (e.g. panel 140, 440, etc.) or a corner panel (e.g. corner panel 140') as shown in FIG. 17, retainer 610 may be less susceptible to bending under the force of gravity and the resulting formwork 602 may be more rigid.

Additional apertures 614 may be defined by base extension 612A to allow additional fasteners 50 to attach retainer 610 to edge surface 14C. Such additional fasteners 50 may prevent retainer 610 from detaching from edge surface 14C due to, for example, gravity when wall 12A is a ceiling and multi-sided structure 12B protrudes downward from wall 12A.

FIG. 16B depicts a retainer 710 for attaching to edge surface 14C (or wall 12A). Retainer 710 is substantially similar to retainer 610 except that base 612 has been removed and only base extension 712A is provided for attaching retainer 710 to structures 10, 10'.

Figure 18B:
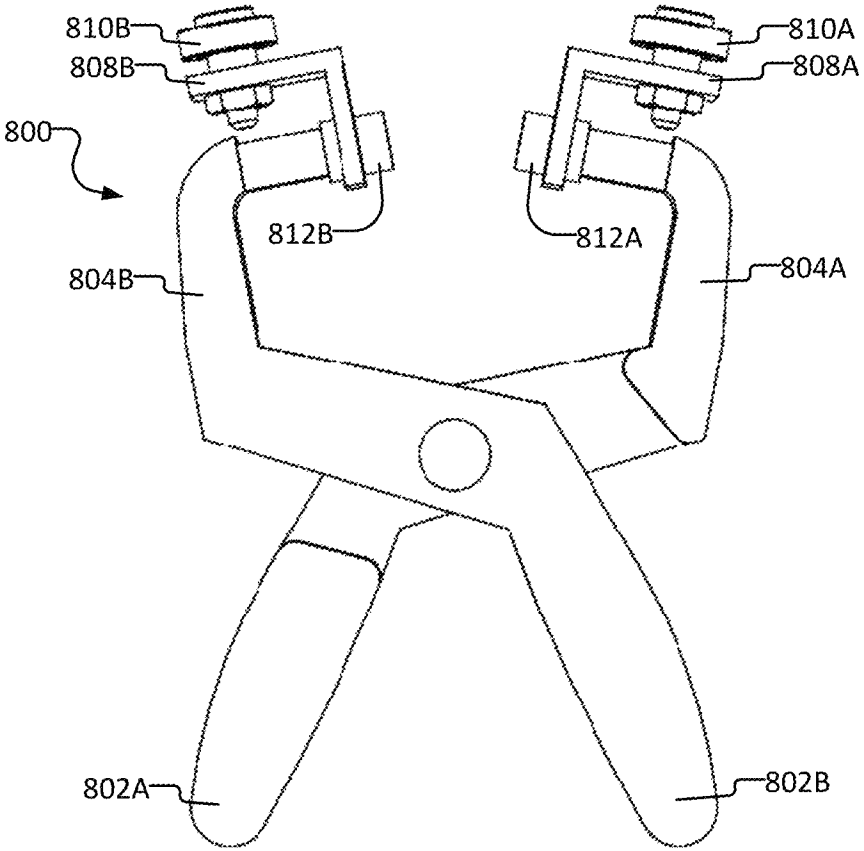
FIG. 18B depicts another top plan view of the tool of FIG. 18A.
Figure 18A:
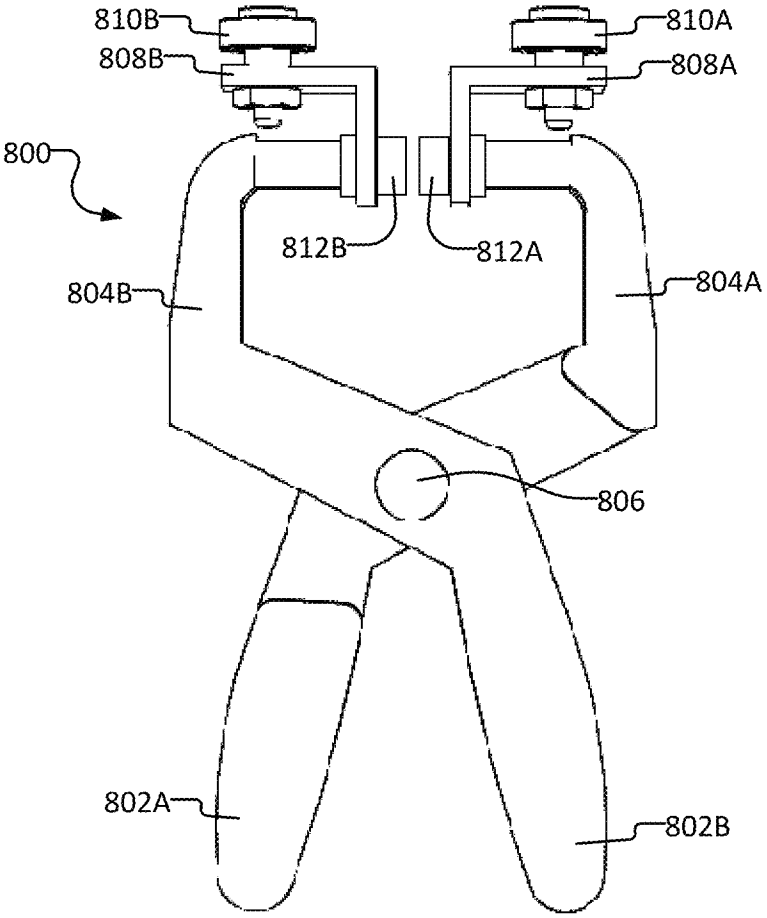
FIG. 18A depicts a top plan view of an exemplary tool which may be used to form, for example, the connection of FIG. 13C.

FIGS. 18A and 18B show a tool 800 which may be used to insert second panel connector component 470 into first panel connector component 460 to thereby make connection 465 between two panels 440 (see FIG. 19) or a similar connection 425 between a retainer 410 and a panel 440 (see FIG. 13C). Similar tools may be used with other types of connector components and other panels described herein.

In the illustrated embodiment, tool 800 comprises handles 802A, 802B which are connected to arms 804A, 804B, respectively. Arms 804A, 804B are pivotally coupled to each other by pivot joint 806. Arm 804A is connected to tool head 808A. Arm 804B is connected to tool head 808B. Tool head 808A has a roller 810A and tool head 808B has a roller 810B. Rollers 810A, 810B may be attached to tool heads 808A, 808B respectively by suitable bearings, bushings or the like to allow rotation of rollers 810A, 810B. The pivoting action of tool 800 about pivot joint 806 is not necessary. In some embodiments, tool 800 may comprise some other mechanism of forcing tool heads 808A, 808B toward one another.

Figure 19:
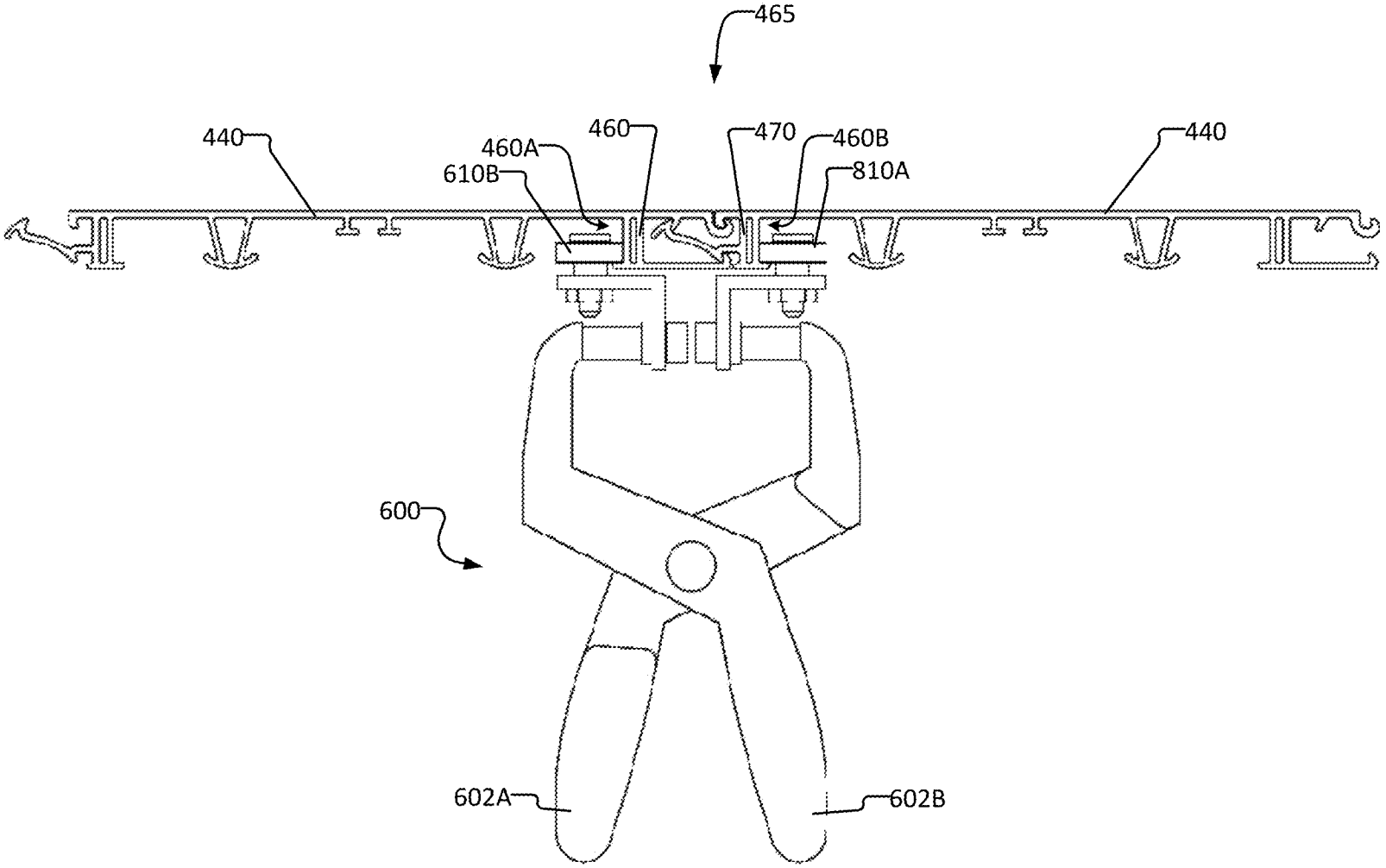
FIG. 19 depicts a top plan view of the tool of FIG. 19A being used to form a panel to panel connection.

Referring to FIG. 19, roller 810B is shaped and/or dimensioned to be able to exert force on (e.g. to form a complementary fit with or to otherwise engage) a portion of first panel connector component 460. In the illustrated embodiment, roller 810B extends into concavity 460A of first panel connector component 460. Similarly, roller 810A is shaped and/or dimensioned to be able to exert force on (e.g. to form a complementary fit with or to otherwise engage) a portion of second panel connector component 470. In the illustrated embodiment, roller 810A extends into concavity 470A of second panel connector component 470.

Figure 20B:
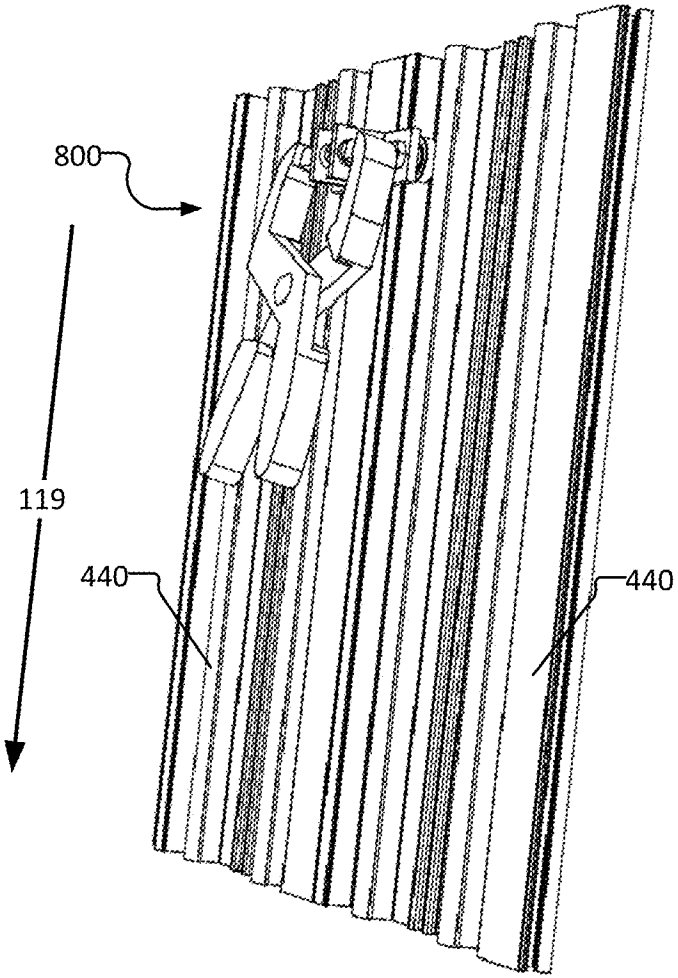
FIG. 20B depicts another perspective view of the tool of FIG. 18A being used to form a panel-to-panel connection.
Figure 20A:
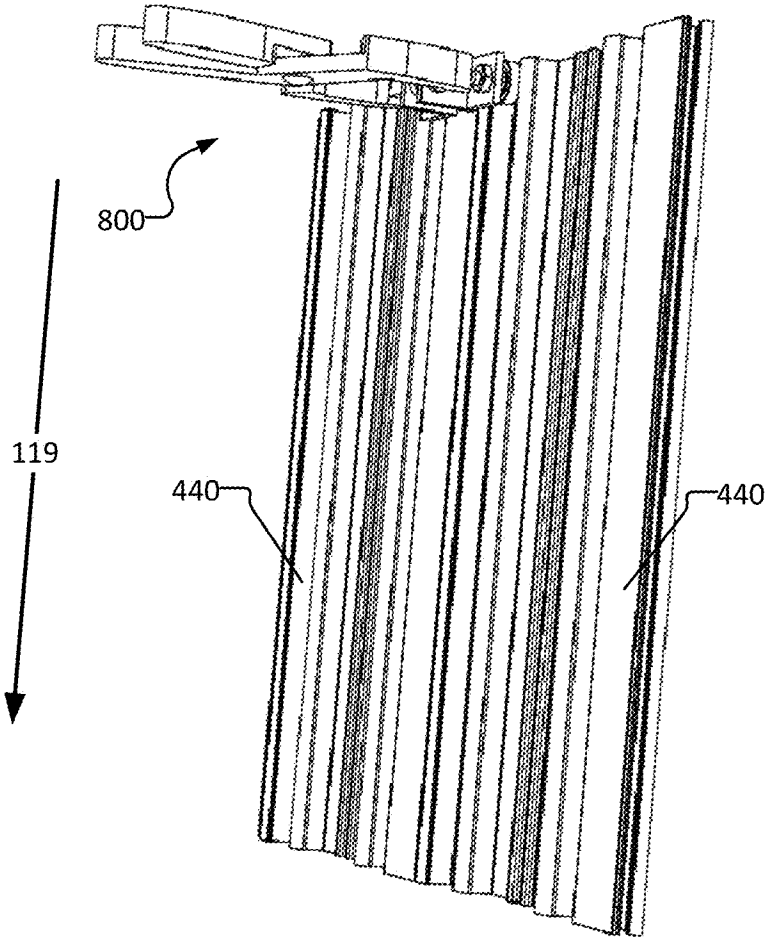
FIG. 20A depicts a perspective view of the tool of FIG. 18A being used to form a panel-to-panel connection.

Tool 800 may be used to form connection 465 (or connection 425) by carrying out the following steps: (1) move a pair of panels 440 (or retainer 410 and panel 440) into proximity with one another such that first panel connector component 460 is adjacent to and aligned with second panel connector component 470; (2) position tool 800 such that roller 810B engages a portion of first panel connector component 460 and roller 810A engages a portion of second panel connector component 470; (3) squeeze or otherwise move handles 802A, 802B, toward one another so that roller 810A moves closer to roller 810B, thereby pushing second panel connector component 470 into first panel connector component 470 (see, for example, FIG. 20A); (4) slide (e.g. push or pull) tool 800 along the longitudinal direction 119. As tool 800 moves in longitudinal direction 119, rollers 810A, 810B may roll along and exert force on first and second panel connector components 460, 470 thereby acting as a zipper to form edge-to-edge connection 465 (see, for example, FIG. 20B).

In some embodiments, tool head 808A may be pivotal about pivot 812A to allow pivoting of tool head 808A relative to arm 804A, and tool head 808B may be pivotal about pivot 812B to allow pivoting of tool head 808B relative to arm 804B to aid in allowing a user to slide tool 800 in longitudinal direction 119 by providing more ergonomic access to handles 802A, 802B—especially when handles 802A, 802B are above a user's shoulders or below a user's waist. Such optional pivoting motion of tool heads 808A, 808B is best seen by comparing FIG. 20A to FIG. 20B.

In some embodiments, the tool heads (i.e. tool heads, 808A, 808B) are attached to a pre-existing set of pliers. In some embodiments, the arms of tool 800 are attached by a bias mechanism (such as, for example, a spring) to bias the tool heads toward a spaced apart relationship. In some embodiments, a locking mechanism is provided that may overcome the bias mechanism when the tool heads abut (e.g. similar to a locking pliers tool). Tools 800 are not restricted to being used with the panels discussed therewith but may be used with other types of connector components and other panels described herein.

Processes, methods, lists and the like are presented in a given order. Alternative examples may be performed in a different order, and some elements may be deleted, moved, added, subdivided, combined, and/or modified to provide additional, alternative or sub-combinations. Each of these elements may be implemented in a variety of different ways. Also, while elements are at times shown as being performed in series, they may instead be performed in parallel, or may be performed at different times. Some elements may be of a conditional nature, which is not shown for simplicity.

Where a component (e.g. a connector component, etc.) is referred to above, unless otherwise indicated, reference to that component (including a reference to a "means") should be interpreted as including as equivalents of that component any component which performs the function of the described component (i.e. that is functionally equivalent), including components which are not structurally equivalent to the disclosed structure which performs the function in the illustrated exemplary embodiments of the invention.

Those skilled in the art will appreciate that directional conventions such as "vertical", "transverse", "horizontal", "upward", "downward", "forward", "backward", "inward", "outward", "vertical", "transverse" and the like, used in this description and any accompanying claims (where present) depend on the specific orientation of the apparatus described. Accordingly, these directional terms are not strictly defined and should not be interpreted narrowly.

Unless the context clearly requires otherwise, throughout the description and any claims (where present), the words "comprise," "comprising," and the like are to be construed in an inclusive sense, that is, in the sense of "including, but not limited to." As used herein, the terms "connected," "coupled," or any variant thereof, means any connection or coupling, either direct or indirect, between two or more elements; the coupling or connection between the elements can be physical, logical, or a combination thereof. Additionally, the words "herein," "above," "below," and words of similar import, shall refer to this document as a whole and not to any particular portions. Where the context permits, words using the singular or plural number may also include the plural or singular number respectively. The word "or," in reference to a list of two or more items, covers all of the following interpretations of the word: any of the items in the list, all of the items in the list, and any combination of the items in the list.

While a number of exemplary aspects and embodiments have been discussed above, those of skill in the art will recognize certain modifications, permutations, additions and sub-combinations thereof. For example:

- In the embodiments described herein, the structural material used to fabricate repair structures is concrete. This is not necessary. In some applications, it may be desirable to use other curable materials (e.g. curable foam insulation, curable protective material or the like) instead of, or in addition to, concrete which may be initially be introduced into the spaces between lining systems and existing structures (or other spaces defined in part by lining systems) and allowed to cure. The systems described herein are not limited to repairing existing concrete structures. By way of non-limiting example, apparatus described herein may be used to repair existing structures comprising concrete, brick, masonry material, wood, metal, steel, other structural materials or the like.
- In the embodiments described herein, the surfaces of panels (e.g. panels 140) are substantially flat or are generally uniformly curved. In other embodiments, panels may be provided with inward/outward corrugations. Such corrugations may extend longitudinally and/or transversely. Such corrugations may help to further prevent or minimize pillowing of panels under the weight of liquid concrete.

The lining systems described above are used to fabricate repair structures by introducing concrete or other curable material into the space between the lining system and an existing structure. The lining systems described herein may be used to fabricate repair structures that go all the way (i.e. form a closed loop) around an existing structure. This is not necessary, however, and in some embodiments, lining systems and resultant repair structures may be used to repair a portion of an existing structure.

In some embodiments, the lining systems described herein may be used as a formwork (or a portion of a formwork) to retain concrete or other curable material as it cures in the space between the lining system and the existing structure 10. In some embodiments, the lining systems described herein may be used with an external formwork (or external bracing (not shown)) which supports the lining systems while concrete or other curable material cures in the space between the lining system and the existing structure. The external formwork may be removed and optionally re-used after the curable material cures.

In some embodiments, formwork apparatus 100 may be used (with or without external formwork or bracing) to fabricate independent structures (i.e. structures that do not line existing structures and are otherwise independent of existing structures). Non-limiting examples of independent structures which may be formed with the lining systems described herein include: walls, ceilings or floors of buildings or similar structures; transportation structures (e.g. bridge supports and freeway supports); beams; foundations; sidewalks; pipes; tanks; structures; and/or the like.

Lining systems according to various embodiments may line the interior of a structure. For example, an outer formwork (comprising a lining system like any of the lining systems described herein and/or some other type of formwork) may be fabricated and an inner formwork comprising a lining system like any of the lining systems described herein may be assembled within the outer formwork. In such embodiments, the lining system may face towards the outer formwork such that the standoffs are directed towards the outer formwork. Concrete or other curable material may be introduced into the space between the inner lining system and the outer formwork and allowed to cure to complete the structure.

Structures fabricated according to various embodiments of the invention may have any appropriate shape. For example, panels of lining systems according to the invention may be curved, may be straight, may have outside corners, may have inside corners and/or the like.

In the embodiments described herein, the shape of the repair structures conform generally to the shape of the existing structures. This is not necessary. In general, the repair structure may have any desired shape by constructing suitable panels and, optionally, suitable removable bracing or formwork. For example, the cross-section of an existing structure may be generally round in shape, but a lining system having a rectangular-shaped cross-section may be used to repair such an existing structure. Similarly, the cross-section of an existing structure may be generally rectangular in shape, but a system having a circular (or curved) shaped cross-section may be used to repair such an existing structure.

Portions of connector components may be coated with or may otherwise incorporate antibacterial, antiviral and/or antifungal agents. By way of non-limiting example, Microban™ manufactured by Microban International, Ltd. of New York, N.Y. may be coated onto and/or incorporated into connector components during manufacture thereof. Portions of connector component may also be coated with elastomeric sealing materials. Such sealing materials may be co-extruded with their corresponding components.

Standoffs 300 are merely examples of possible standoff designs. Standoffs 300 may comprise any appropriate standoff configuration to space the panels of the lining system from the existing structure. In some embodiments, standoffs 300 may be integrally formed with panels or be separate components. In some embodiments, standoffs are not necessary. Surfaces of existing structures may be uneven (e.g. due to damage or to the manner of fabrication and/or the like). In some embodiments, suitable spacers, shims or the like may be used to space standoffs apart from the uneven surfaces of existing structures. Such spacers, shims or the like, which are well known in the art, may be fabricated from any suitable material including metal alloys, suitable plastics, other polymers, wood composite materials or the like.

Methods and apparatus described herein are disclosed to involve the use of concrete to repair various structures. It should be understood by those skilled in the art that in other embodiments, other curable materials could be used in addition to or as an alternative to concrete. By way of non-limiting example, a stay-in-place formwork apparatus 100 could be used to contain a structural curable material similar to concrete or some other curable material (e.g. curable foam insulation, curable protective material or the like), which may be introduced into space 104 between panels 140 and existing structure when the material was in liquid form and then allowed to cure and to thereby repair existing structure 30.

The longitudinal dimensions of panels (e.g. panels 140) may be fabricated to have desired lengths or may be cut to desired lengths. Panels may be fabricated to be have modularly dimensioned transverse width dimensions to fit various existing structures and for use in various applications.

The apparatus described herein are not limited to repairing existing concrete structures. By way of non-limiting example, apparatus described herein may be used to repair existing structures comprising concrete, brick, masonry material, wood, metal, steel, other structural materials or the like. One particular and non-limiting example of a metal or steel object that may be repaired in accordance various embodiments described herein is a street lamp post, which may degrade because of exposure to salts and/or other chemicals used to melt ice and snow in cold winter climates.

In some applications, corrosion (e.g. corrosion of rebar) is a factor in the degradation of the existing structure. In such applications, apparatus according to various embodiments of the invention may incorporate corrosion control components such as those manufactured and provided by Vector Corrosion Technologies, Inc. of Winnipeg, Manitoba, Canada and described at www.vector-corrosion.com. As a non-limiting example, such corrosion control components may comprise anodic units which may comprise zinc and which may be mounted to (or otherwise connected to) existing rebar in the existing structure and/or to new rebar introduced by the repair, reinforcement, restoration and/or protection apparatus of the invention. Such anodic corrosion control components are marketed by Vector Corrosion Technologies, Inc. under the brand name Galvanode®. Other corrosion control systems, such as impressed current cathodic protection (ICCP) systems, electrochemical chloride extraction systems and/or electrochemical re-alkalization systems could also be used in conjunction with the apparatus of this invention. Additionally or alternatively, anti-corrosion additives may be added to concrete or other curable materials used to fabricate repair structures in accordance with particular embodiments of the invention.

As discussed above, the illustrated embodiment described herein is applied to provide a repair structure for an existing structure having a particular shape. In general, however, the shape of the existing structures described herein are meant to be exemplary in nature and methods and apparatus of various embodiments may be used with existing structures having virtually any shape. In particular applications, apparatus according to various embodiments may be used to repair (e.g. to cover) an entirety of an existing structure and/or any subset of the surfaces or portions of the surfaces of an existing structure. Such surfaces or portions of surfaces may include longitudinally extending surfaces or portions thereof, transversely extending surfaces or portions thereof, side surfaces or portions thereof, upper surfaces or portions thereof, lower surfaces or portions thereof and any corners, curves and/or edges in between such surfaces or surface portions.

The invention disclosed herein has a number of aspects that include, without limitation, the following aspects.

1. A method for repairing a multi-sided structure protruding from a first surface to cover at least a portion of the multi-sided structure with a repair structure, the method comprising:
   mounting a retainer to the first surface;
   coupling a first brace connector component of a first brace to a first panel, the first brace extending non-parallel and non-orthogonal to the first panel;
   coupling the first panel to a primary retainer connector component of the retainer, the first panel extending generally non-parallel to the first surface such that a tangential plane of the first panel is facing, and spaced apart from, a second surface of the multi-sided structure to provide a space between the first panel and the multi-sided structure;
   coupling a second brace connector component of the first brace to a secondary retainer connector component of the retainer, the first brace extending non-parallel and non-orthogonal to the retainer;
   introducing a curable material into the space between the first panel and the multi-sided structure, the first panel acting as at least a portion of a framework for containing the curable material until the curable material cures to provide a repair structure cladded, at least in part, by the first panel.
2. A method according to aspect 1 or any other aspect herein comprising coupling the first brace connector component of the first brace to the first panel before coupling the first panel to the retainer.
3. A method according to any one of aspects 1 and 2 or any other aspect herein comprising coupling the first panel to the retainer and concurrently coupling the second brace connector component of the first brace to the retainer.
4. A method according to any one of aspects 1 and 2 or any other aspect herein comprising coupling the first panel to the retainer after coupling the second brace connector component of the first brace to the retainer.
5. A method according to any one of aspects 1 and 2 or any other aspect herein comprising coupling the first panel to the retainer before coupling the second brace connector component of the first brace to the retainer.
6. A method according to any one of aspects 1 to 5 or any other aspect herein wherein coupling the first panel to the retainer comprises forcing the first panel in an inward direction toward the primary retainer connector of the retainer to form a panel-retainer connection.
7. A method according to aspect 6 or any other aspect herein wherein forming the panel-retainer connection comprises extending a protrusion of the primary retainer connector component of the retainer into a receptacle of a first panel connector component of the first panel, the receptacle shaped to prevent removal of the protrusion from the receptacle and the receptacle resiliently deformed by the extension of the protrusion into the receptacle to thereby apply a restorative force to the protrusion to maintain the panel-retainer connection.
8. A method according to aspect 6 or any other aspect herein wherein forming the panel-retainer connection comprises extending a protrusion of a first panel connector component of the first panel into a receptacle of the primary retainer connector component of the retainer, the receptacle shaped to prevent removal of the protrusion from the receptacle and the receptacle resiliently deformed by the extension of the protrusion into the receptacle to thereby apply a restorative force to the protrusion to maintain the panel-retainer connection.
9. A method according to any one of aspects 1 to 8 or any other aspect herein wherein coupling the first brace to the retainer comprises forcing the first brace in an inward direction toward the secondary retainer connector of the retainer to form a brace-retainer connection.
10. A method according to aspect 9 or any other aspect herein wherein forming the brace-retainer connection comprises extending a protrusion of the second brace connector component of the first brace into a receptacle of the secondary retainer connector component of the retainer, the receptacle shaped to prevent removal of the protrusion from the receptacle and the receptacle resiliently deformed by the extension of the protrusion into the receptacle to thereby apply a restorative force to the protrusion to maintain the brace-retainer connection.
11. A method according to aspect 9 or any other aspect herein wherein forming the panel-retainer connection comprises extending a protrusion of the secondary retainer connector component of the retainer into a receptacle of the second brace connector component of the first brace, the receptacle shaped to prevent removal of the protrusion from the receptacle and the receptacle resiliently deformed by the extension of the protrusion into the receptacle to thereby apply a restorative force to the protrusion to maintain the brace-retainer connection.

12. A method according to any one of aspects 9 to 11 or any other aspect herein wherein forcing the first brace in the inward direction toward the secondary retainer connector of the retainer to form the brace-retainer connection comprises applying force to a shoulder or surface of the second retainer connector component with a tool (e.g. a crowbar, hammer, block of wood, etc.) and wherein the second retainer connector component comprises one or more sidewalls for aligning the tool with the shoulder or surface.
13. A method according to any one of aspects 1 to 12 or any other aspect herein wherein coupling the first brace connector component of the first brace to the first panel comprises sliding the first brace connector in a longitudinal direction relative to a third panel connector component to form a panel-brace connection.
14. A method according to aspect 13 or any other aspect herein wherein forming the panel-brace connection comprises sliding a projection of the third panel connector component into a channel of the first brace connector in the longitudinal direction.
15. A method according to aspect 13 or any other aspect herein wherein forming the panel-brace connection comprises sliding a projection of the first brace connector into a channel of the third panel connector component in the longitudinal direction.
16. A method according to any one of aspects 1 to 15 or any other aspect herein wherein the retainer comprises a base and the primary and secondary retainer connector components each extend in an outward direction, opposite the inward direction, from the base.
17. A method according to aspect 16 or any other aspect herein wherein the primary retainer connector component is separated from the secondary retainer connector component in a transverse direction by a spacing.
18. A method according to any one of aspects 16 to 17 or any other aspect herein wherein the primary and secondary retainer connector components are integral to the base.
19. A method according to any one of aspects 17 and 18 or any other aspect herein wherein the base of the retainer comprises one or more mounting features located in the spacing and mounting the retainer to the first surface comprises mounting the retainer to the first surface of using the one or more mounting features.
20. A method according to aspect 19 or any other aspect herein wherein the one or more mounting features comprises one or more apertures and mounting the retainer to the first surface comprises passing one or more fasteners through the one or more apertures and into the first surface.
21. A method according to any one of aspects 1 to 20 or any other aspect herein wherein the first brace extends from the first panel at an angle between 20° and 70°.
22. A method according to any one of aspects 1 to 21 or any other aspect herein wherein the first brace extends from the first panel at an angle between 40° and 50°.
23. A method according to any one of aspects 1 to 22 or any other aspect herein wherein the first brace extends from the first panel at an angle of approximately 45°.
24. A method according to any one of aspects 1 to 23 or any other aspect herein wherein the first brace extends from the retainer at an angle between 20° and 70°.
25. A method according to any one of aspects 1 to 24 or any other aspect herein wherein the first brace extends from the retainer at an angle between 40° and 50°.
26. A method according to any one of aspects 1 to 25 or any other aspect herein wherein the first brace extends from the retainer at an angle of approximately 45°.
27. A method according to any one of aspects 1 to 26 or any other aspect herein wherein the first panel extending generally non-parallel to the first surface such that the tangential plane of the first panel is facing, and spaced apart from, the second surface of the multi-sided structure comprises the first panel extending generally normal to the first surface such that the tangential plane of the first panel is generally parallel to, and spaced apart from, the second surface of the multi-sided structure.
28. A method according to any one of aspects 1 to 27 or any other aspect herein wherein the space between the first panel and the multi-sided structure comprises a space between the first panel and the second surface of the multi-sided structure.
29. A method according to any one of aspects 1 to 28 or any other aspect herein wherein the first panel extending generally non-parallel to the first surface comprises the first panel extending generally normal to the first surface.
30. A method according to any one of aspects 1 to 29 or any other aspect herein wherein the multi-sided structure comprises a pilaster.
31. A method according to any one of aspects 1 to 29 or any other aspect herein wherein the multi-sided structure comprises a column.
32. A method according to any one of aspects 1 to 29 or any other aspect herein wherein the multi-sided structure is ornamental.
33. A method according to any one of aspects 1 to 32 or any other aspects herein comprising connecting a second panel to the first panel by forcing a first panel connector component of the second panel in an inward direction toward a second panel connector of the first panel to form a panel-panel connection.
34. A method according to any one of aspects 1 to 32 or any other aspects herein comprising connecting a number, n, of panels to the first panel by forcing a first panel connector component of an $i^{th}$ panel in an inward direction toward a second panel connector of an $(i-1)^{th}$ panel to form a panel-panel connection, where n is any positive integer and i is a count from two to n+1.
35. A method according to aspect 34 or any other aspect herein comprising connecting a second retainer to a second panel connector of the $n+1^{th}$ panel.
36. A method according to aspect 35 or any other aspect herein wherein connecting the $n+1^{th}$ panel to the second retainer comprises forcing the $n+1^{th}$ panel in an inward direction toward a primary retainer connector of the second retainer to form a second panel-retainer connection.
37. A method according to aspect 36 or any other aspect herein wherein forming the second panel-retainer connection comprises extending a protrusion of the second panel connector component of the $n+1^{th}$ panel into a receptacle of the primary retainer connector component of the second retainer, the receptacle shaped to prevent removal of the protrusion from the receptacle and the receptacle resiliently deformed by the extension of the protrusion into the receptacle to thereby apply a restorative force to the protrusion to maintain the second panel-retainer connection.

38. A method according to aspect 36 or any other aspect herein wherein forming the panel-retainer connection comprises extending a protrusion of the primary retainer connector component of the second retainer into a receptacle of the second panel connector component of the $n+1^{th}$ panel, the receptacle shaped to prevent removal of the protrusion from the receptacle and the receptacle resiliently deformed by the extension of the protrusion into the receptacle to thereby apply a restorative force to the protrusion to maintain the second panel-retainer connection.

39. A method according to any one of aspects 35 to 38 or any other aspect herein comprising mounting the second retainer to the first surface.

40. A method according to any one of aspects 35 to 39 or any other aspect herein comprising coupling a first brace connector component of a second brace to the $n+1^{th}$ panel, the second brace extending non-parallel and non-orthogonal to the $n+1^{th}$ panel and coupling a second brace connector component of the second brace to a secondary connector component of the second retainer, the second brace extending non-parallel and non-orthogonal to the second retainer.

41. A method according to any one of aspects 34 to 40 or any other aspect herein comprising connecting a standoff to the $i^{th}$ panel by:

connecting a first standoff connector component to a third connector of the P panel;

deforming the standoff such that a transverse spacing between the first standoff connector component of the standoff and a second standoff connector component of the standoff is approximately equal to a transverse spacing between the third connector of the $i^{th}$ panel and a fourth connector of the $i^{th}$ panel;

connecting the second standoff connector component to the fourth connector of the $i^{th}$ panel.

42. A method according to aspect 41 or any other aspect herein wherein coupling the first standoff connector component to the third connector component of the $i^{th}$ panel comprises sliding the first standoff connector component in a longitudinal direction relative to the third panel connector component of the $i^{th}$ panel to form a first panel-standoff connection.

43. A method according to aspect 42 or any other aspect herein wherein forming the first panel-standoff connection comprises sliding a projection of the third panel connector component of the $i^{th}$ panel into a channel of the first standoff connector component in the longitudinal direction.

44. A method according to aspect 42 or any other aspect herein wherein forming the first panel-standoff connection comprises sliding a projection of the first standoff connector component into a channel of the third panel connector component of the $i^{th}$ panel in the longitudinal direction.

45. A method according to any one of aspects 41 to 44 or any other aspect herein wherein coupling the second standoff connector component to the fourth connector component of the $i^{th}$ panel comprises sliding the second standoff connector component in a longitudinal direction relative to the fourth panel connector component of the $i^{th}$ panel to form a second panel-standoff connection.

46. A method according to aspect 45 or any other aspect herein wherein forming the second panel-standoff connection comprises sliding a projection of the fourth panel connector component of the $i^{th}$ panel into a channel of the second standoff connector component in the longitudinal direction.

47. A method according to aspect 45 or any other aspect herein wherein forming the second panel-standoff connection comprises sliding a projection of the second standoff connector component into a channel of the fourth panel connector component of the $i^{th}$ panel in the longitudinal direction.

48. A method according to any one of aspects 1 to 47 wherein when the panel-retainer connection is formed, the primary retainer connector of the retainer and the first and second panel connectors of the first panel are each offset from the tangential plane of the first panel.

49. An apparatus for repairing a multi-sided structure protruding from a first surface to cover at least a portion of a surface of the multi-sided structure with a repair structure, the apparatus comprising:

a retainer mounted to the first surface;

a first brace connector component of a first brace coupled to a first panel, the first brace extending non-parallel and non-orthogonal to the first panel;

the first panel coupled to a primary retainer connector component of the retainer, the first panel extending generally non-parallel to the first surface such that a tangential plane of the first panel is generally facing, and spaced apart from, a second surface of the multi-sided structure to provide a space between the first panel and the multi-sided structure;

a second brace connector component of the first brace coupled to a secondary retainer connector component of the retainer, the first brace extending non-parallel and non-orthogonal to the retainer;

a curable material in the space between the first panel and the multi-sided structure, the first panel acting as at least a portion of a framework for containing the curable material until the curable material cures to provide a repair structure cladded, at least in part, by the first panel.

50. An apparatus according to aspect 49 or any other aspect herein wherein the first brace connector component of the first brace is coupled to the first panel before coupling the first panel to the retainer.

51. An apparatus according to any one of aspects 49 and 50 or any other aspect herein wherein the first panel is concurrently coupled to the retainer and the second brace connector component of the first brace.

52. An apparatus according to any one of aspects 49 and 50 or any other aspect herein wherein the first panel is coupled to the retainer after the second brace connector component of the first brace is coupled to the retainer.

53. An apparatus according to any one of aspects 49 and 50 or any other aspect herein wherein the first panel is coupled to the retainer before the second brace connector component of the first brace is coupled to the retainer.

54. An apparatus according to any one of aspects 49 to 53 or any other aspect herein wherein the first panel is coupled to the retainer by forcing the first panel in an upward direction toward the primary retainer connector of the retainer to form a panel-retainer connection.

55. An apparatus according to aspect 54 or any other aspect herein wherein the panel-retainer connection comprises a protrusion of the primary retainer connector component of the retainer extended into a receptacle of a first panel connector component of the first panel, the receptacle shaped to prevent removal of the protrusion from the receptacle and the receptacle resiliently deformed by the extension of the protrusion into the receptacle to thereby apply a restorative force to the protrusion to maintain the panel-retainer connection.

56. An apparatus according to aspect 54 or any other aspect herein wherein the panel-retainer connection comprises a protrusion of the primary retainer connector component of the first panel extended into a receptacle of the primary retainer connector component of the retainer, the receptacle shaped to prevent removal of the protrusion from the receptacle and the receptacle resiliently deformed by the extension of the protrusion into the receptacle to thereby apply a restorative force to the protrusion to maintain the panel-retainer connection.

57. An apparatus according to any one of aspects 49 to 56 or any other aspect herein wherein the first brace is coupled to the retainer by the first brace being forced in an inward direction toward the secondary retainer connector of the retainer to form a brace-retainer connection.

58. An apparatus according to aspect 57 or any other aspect herein wherein the brace-retainer connection comprises a protrusion of the second brace connector component of the first brace extended into a receptacle of the secondary retainer connector component of the retainer, the receptacle shaped to prevent removal of the protrusion from the receptacle and the receptacle resiliently deformed by the extension of the protrusion into the receptacle to thereby apply a restorative force to the protrusion to maintain the brace-retainer connection.

59. An apparatus according to aspect 57 or any other aspect herein wherein the panel-retainer connection comprises a protrusion of the secondary retainer connector component of the retainer extended into a receptacle of the second brace connector component of the first brace, the receptacle shaped to prevent removal of the protrusion from the receptacle and the receptacle resiliently deformed by the extension of the protrusion into the receptacle to thereby apply a restorative force to the protrusion to maintain the brace-retainer connection.

60. An apparatus according to any one of aspects 57 to 59 or any other aspect herein wherein the second retainer connector component comprises a shoulder or surface and one or more sidewalls for aligning a tool (e.g. a crowbar, hammer, block of wood, etc.) with the shoulder or surface, the first brace being forced in an inward direction toward the secondary retainer connector of the retainer to form a brace-retainer connection comprises applying force to the shoulder or surface of the second retainer connector component with the tool.

61. An apparatus to any one of aspects 49 to 60 or any other aspect herein wherein the first brace connector component of the first brace being coupled to a first panel comprises the first brace connector the first brace connector being slid in a longitudinal direction relative to a third panel connector component to form a panel-brace connection.

62. An apparatus according to aspect 61 or any other aspect herein wherein the panel-brace connection comprises a projection of the third panel connector component being slid into a channel of the first brace connector in the longitudinal direction.

63. An apparatus according to aspect 61 or any other aspect herein wherein the panel-brace connection comprises a projection of the first brace connect being slid into a channel of the third panel connector component in the longitudinal direction.

64. An apparatus according to any one of aspects 49 to 63 or any other aspect herein wherein the retainer comprises a base and the primary and secondary retainer connector components each extend in an outward direction, opposite the inward direction, from the base.

65. An apparatus according to aspect 64 or any other aspect herein wherein the primary retainer connector component is separated from the secondary retainer connector component in a transverse direction by a spacing.

66. An apparatus according to any one of aspects 64 and 65 or any other aspect herein wherein the primary and secondary retainer connector components are integral to the base.

67. An apparatus according to any one of aspects 65 and 66 or any other aspect herein wherein the base of the retainer comprises one or more mounting features located in the spacing and the retainer is mounted to the first surface through the one or more mounting features.

68. An apparatus according to aspect 67 or any other aspect herein wherein the one or more mounting features comprises one or more apertures and the retainer is mounted to the first surface by passing one or more fasteners through the one or more apertures and into the first surface.

69. An apparatus according to any one of aspects 49-68 or any other aspect herein wherein the first brace extends from the first panel at an angle between 20° and 70°.

70. An apparatus according to any one of aspects 49 to 69 or any other aspect herein wherein the first brace extends from the first panel at an angle between 40° and 50°.

71. An apparatus according to any one of aspects 49 to 70 or any other aspect herein wherein the first brace extends from the first panel at an angle of approximately 45°.

72. An apparatus according to any one of aspects 49 to 71 or any other aspect herein wherein the first brace extends from the retainer at an angle between 20° and 70°.

73. An apparatus according to any one of aspects 49 to 72 or any other aspect herein wherein the first brace extends from the retainer at an angle between 40° and 50°.

74. An apparatus according to any one of aspects 49 to 73 or any other aspect herein wherein the first brace extends from the retainer at an angle of approximately 45°.

75. An apparatus according to any one of aspects 49 to 74 or any other aspect herein wherein the first panel extending generally non-parallel to the first surface such that the tangential plane of the first panel is facing, and spaced apart from, the second surface of the multi-sided structure comprises the first panel extending generally normal to the first surface such that the tangential plane of the first panel is generally parallel to, and spaced apart from, the second surface of the multi-sided structure.

76. An apparatus according to any one of aspects 49 to 75 or any other aspect herein wherein the space between the first panel and the multi-sided structure comprises a space between the first panel and the second surface of the multi-sided structure.

77. An apparatus according to any one of aspects 49 to 76 or any other aspect herein wherein the first panel extending generally non-parallel to the first surface comprises the first panel extending generally normal to the first surface.

78. An apparatus according to any one of aspects 49 to 77 or any other aspect herein wherein the multi-sided structure comprises a pilaster.

79. An apparatus according to any one of aspects 49 to 77 or any other aspect herein wherein the multi-sided structure comprises a column.

80. An apparatus according to any one of aspects 49 to 77 or any other aspect herein wherein the multi-sided structure is ornamental.

81. An apparatus according to any one of aspects 49 to 80 or any other aspect herein comprising a second panel connected to the first panel by forcing a first panel connector component of the second panel in an inward direction toward a second panel connector of the first panel to form a panel-panel connection.

82. An apparatus according to any one of aspects 49 to 80 or any other aspects herein comprising a number, n, of panels connected to the first panel by forcing a first panel connector component of an $i^{th}$ panel in an inward direction toward a second panel connector of an (i−1)th panel to form a panel-panel connection, where n is any positive integer and i is a count from two to n+1.

83. An apparatus according to aspect 82 or any other aspect herein comprising a second retainer connected to a second panel connector of the $n+1^{th}$ panel.

84. An apparatus according to aspect 83 or any other aspect herein wherein the $n+1^{th}$ panel being connected to the second retainer comprises forcing the $n+1^{th}$ panel in an inward direction toward a primary retainer connector of the second retainer to form a second panel-retainer connection.

85. An apparatus according to aspect 84 or any other aspect herein wherein the second panel-retainer connection comprises a protrusion of the second panel connector component of the $n+1^{th}$ panel extended into a receptacle of the primary retainer connector component of the second retainer, the receptacle shaped to prevent removal of the protrusion from the receptacle and the receptacle resiliently deformed by the extension of the protrusion into the receptacle to thereby apply a restorative force to the protrusion to maintain the second panel-retainer connection.

86. An apparatus according to aspect 84 or any other aspect herein wherein the panel-retainer connection comprises a protrusion of the primary retainer connector component of the second retainer extended into a receptacle of the second panel connector component of the $n+1^{th}$ panel, the receptacle shaped to prevent removal of the protrusion from the receptacle and the receptacle resiliently deformed by the extension of the protrusion into the receptacle to thereby apply a restorative force to the protrusion to maintain the second panel-retainer connection.

87. An apparatus according to any one of aspects 83 to 86 or any other aspect herein wherein the second retainer is mounted to the first surface.

88. An apparatus according to any one of aspects 83 to 87 or any other aspect herein wherein a first brace connector component of a second brace is coupled to the $n+1^{th}$ panel, the second brace extending non-parallel and non-orthogonal to the $n+1^{th}$ panel and a second brace connector component of the second brace is coupled to a secondary connector component of the second retainer, the second brace extending non-parallel and non-orthogonal to the second retainer.

89. An apparatus according to any one of aspects 82 to 88 or any other aspect herein wherein a standoff is connected to the $i^{th}$ panel by:

connecting a first standoff connector component to a third connector of the $i^{th}$ panel;

deforming the standoff such that a transverse spacing between the first standoff connector component of the standoff and a second standoff connector component of the standoff is approximately equal to a transverse spacing between the third connector of the $i^{th}$ panel and a fourth connector of the $i^{th}$ panel;

connecting the second standoff connector component to the fourth connector of the $i^{th}$ panel.

90. An apparatus according to aspect 89 or any other aspect herein wherein the first standoff connector component being coupled to the third connector component of the $i^{th}$ panel comprises sliding the first standoff connector component in a longitudinal direction relative to the third panel connector component of the $i^{th}$ panel to form a first panel-standoff connection.

91. An apparatus according to aspect 90 or any other aspect herein wherein the first panel-standoff connection comprises a projection of the third panel connector component of the $i^{th}$ panel slid into a channel of the first standoff connector component in the longitudinal direction.

92. An apparatus according to aspect 90 or any other aspect herein wherein the first panel-standoff connection comprises a projection of the first standoff connector component slid into a channel of the third panel connector component of the $i^{th}$ panel in the longitudinal direction.

93. An apparatus according to any one of aspects 89 to 92 or any other aspect herein wherein coupling the second standoff connector component to the fourth connector component of the $i^{th}$ panel comprises sliding the second standoff connector component in a longitudinal direction relative to the fourth panel connector component of the $i^{th}$ panel to form a second panel-standoff connection.

94. An apparatus according to aspect 93 or any other aspect herein wherein the second panel-standoff connection comprises a projection of the fourth panel connector component of the $i^{th}$ panel slid into a channel of the second standoff connector component in the longitudinal direction.

95. An apparatus according to aspect 93 or any other aspect herein wherein the second panel-standoff connection comprises a projection of the second standoff connector component slid into a channel of the fourth panel connector component of the $i^{th}$ panel in the longitudinal direction.

96. An apparatus according to any one of aspects 49 to 95 wherein the primary retainer connector of the retainer and the first and second panel connectors of the first panel are each offset from the tangential plane of the first panel.

97. An apparatus for repairing a multi-sided structure protruding from a first surface to cover at least a portion of a surface of the multi-sided structure with a repair structure, the apparatus comprising:

a retainer mountable to the first surface;

a first brace connector component of a first brace coupleable to a first panel to extend non-parallel and non-orthogonal to the first panel;

the first panel coupleable to a primary retainer connector component of the retainer to extend generally non-parallel to the first surface such that a tangential plane of the first panel is generally facing, and spaced apart from, a second surface of the multi-sided structure to provide a space between the first panel and the multi-sided structure;

a second brace connector component of the first brace coupleable to a secondary retainer connector component of the retainer to extend non-parallel and non-orthogonal to the retainer;

wherein the first panel acts as at least a portion of a framework for containing a curable material in the space between the first panel and the multi-sided structure until the curable material cures to provide a repair structure cladded, at least in part, by the first panel.

98. A method for interconnecting edge-adjacent panels of an apparatus for repairing a multi-sided structure protruding from a first surface, the method comprising:

providing a retainer comprising a first edge component and a panel comprising a second edge component;

orienting the retainer and the panel in an edge-to-edge relationship and thereby aligning the first and second edge components with one another;

providing a tool comprising: a first arm having a first handle, the first arm terminating at a first tool head comprising a first roller; and a second arm having a second handle, the second arm terminating at a second tool head comprising a second roller, the second arm pivotally coupled to the first arm by a pivot joint;

positioning the tool at a first location relative to the retainer and the panel and configuring the first and second tool faces to respectively engage the first and second edge components;

moving the tool in a longitudinal direction to thereby cause the first roller to roll along the first edge component and the second roller to roll along the second edge component thereby forcing the first edge component into a locked configuration with the second edge component.

99. A method according to aspect 99 or any other aspect herein comprising moving the first and second handles toward each other by movement of the pivot joint to cause corresponding movement of the first and second tool faces toward one another other before moving the tool in the longitudinal direction.

100. A method according to any one of aspects 98 and 99 or any other aspect herein comprising pivoting the first and second arms relative to the first and second tool heads.

101. A method according to any one of aspects 98 to 100 or any other aspect herein comprising disengaging the tool from the first and second edge components and wherein the locked configuration of the first and second edge components is maintained after the tool is disengaged from the first and second edge components.

102. A tool for assembling at least a portion of an apparatus for repairing a multi-sided structure protruding from a first surface, the apparatus comprising a retainer and a panel having first and second edge components and connectable in an edge-to-edge relationship wherein the first and second edge components engage one another, the tool comprising:

a first arm having a first handle, the first arm terminating at a first tool head comprising a first roller, a portion of which is shaped to be complimentary to at least a portion of the first edge component for engaging the portion of the first edge component; and a second arm having a second handle, the second arm terminating at a second tool head comprising a second roller, a portion of which is shaped to be complimentary to at least a portion of the second edge component for engaging the second edge component, the second arm pivotally coupled to the first arm by a pivot joint;

wherein:

the first and second handles are moveable toward one another by movement of the pivot joint causing corresponding movement of the first and second rollers toward one another and thereby forcing the first and second edge components into a locked configuration.

103. A tool according to aspect 102 or any other aspect herein wherein the first and second tool heads are pivotally mounted to the first and second arms respectively.

104. A tool according to any one of aspects 102 and 103 or any other aspect herein comprising a bias mechanism between the first and second handles to bias the first and second tool heads into a spaced apart relationship.

105. A tool according to aspect 104 or any other aspect herein comprising a locking mechanism for overcoming the bias mechanism and securing the first and second tool faces in abutment with one another.

106. Apparatus comprising any feature(s), combination(s) of features and/or sub-combination(s) of features disclosed or claimed herein.

107. Methods comprising any feature(s), combination(s) of features and/or sub-combination(s) of features disclosed herein.

While a number of exemplary aspects and embodiments have been discussed above, those of skill in the art will recognize certain modifications, permutations, additions and sub-combinations thereof. It is therefore intended that the following appended aspects and aspects hereafter introduced are interpreted to include all such modifications, permutations, additions and sub-combinations and the scope of the aspects should not be limited by the preferred embodiments set forth in the examples, but should be given the broadest interpretation consistent with the description as a whole.

The invention claimed is:

1. A method for repairing a multi-sided structure protruding from a first surface to cover at least a portion of the multi-sided structure with a repair structure, the method comprising:

mounting a retainer to the first surface;

coupling a first brace connector component of a first brace to a first panel, the first brace extending non-parallel and non-orthogonal to the first panel;

coupling the first panel to a primary retainer connector component of the retainer, the first panel extending generally non-parallel to the first surface such that a tangential plane of the first panel is facing, and spaced apart from, a second surface of the multi-sided structure to provide a space between the first panel and the multi-sided structure;

coupling a second brace connector component of the first brace to a secondary retainer connector component of the retainer, the first brace extending non-parallel and non-orthogonal to the retainer; and introducing a curable material into the space between the first panel and the multi-sided structure, the first panel acting as at least a portion of a framework for containing the curable material until the curable material cures to provide a repair structure cladded, at least in part, by the first panel;

wherein:

the retainer comprises a base and the primary and secondary retainer connector components each extend in an outward direction, opposite an inward direction, from the base;

the primary retainer connector component is separated from the secondary retainer connector component in a transverse direction by a spacing; and the base of the retainer comprises one or more mounting features located in the spacing and mounting the retainer to the first surface comprises mounting the retainer to the first surface of using the one or more mounting features.

2. A method according to claim 1 comprising coupling the first brace connector component of the first brace to the first panel before coupling the first panel to the retainer.

3. A method according to claim 1 comprising coupling the first panel to the retainer and concurrently coupling the second brace connector component of the first brace to the retainer.

4. A method according to claim 1 comprising coupling the first panel to the retainer after coupling the second brace connector component of the first brace to the retainer.

5. A method according to claim 1 comprising coupling the first panel to the retainer before coupling the second brace connector component of the first brace to the retainer.

6. A method according to claim 1 wherein coupling the first panel to the retainer comprises forcing the first panel in the inward direction toward the primary retainer connector of the retainer to form a panel-retainer connection.

7. A method according to claim 6 wherein forming the panel-retainer connection comprises extending a protrusion of the primary retainer connector component of the retainer into a receptacle of a first panel connector component of the first panel, the receptacle shaped to prevent removal of the protrusion from the receptacle and the receptacle resiliently deformed by the extension of the protrusion into the receptacle to thereby apply a restorative force to the protrusion to maintain the panel-retainer connection.

8. A method according to claim 6 wherein forming the panel-retainer connection comprises extending a protrusion of a first panel connector component of the first panel into a receptacle of the primary retainer connector component of the retainer, the receptacle shaped to prevent removal of the protrusion from the receptacle and the receptacle resiliently deformed by the extension of the protrusion into the receptacle to thereby apply a restorative force to the protrusion to maintain the panel-retainer connection.

9. A method according to claim 1 wherein coupling the first brace to the retainer comprises forcing the first brace in the inward direction toward the secondary retainer connector of the retainer to form a brace-retainer connection.

10. A method according to claim 9 wherein forming the brace-retainer connection comprises extending a protrusion of the second brace connector component of the first brace into a receptacle of the secondary retainer connector component of the retainer, the receptacle shaped to prevent removal of the protrusion from the receptacle and the receptacle resiliently deformed by the extension of the protrusion into the receptacle to thereby apply a restorative force to the protrusion to maintain the brace-retainer connection.

11. A method according to claim 9 wherein forming the brace-retainer connection comprises extending a protrusion of the secondary retainer connector component of the retainer into a receptacle of the second brace connector component of the first brace, the receptacle shaped to prevent removal of the protrusion from the receptacle and the receptacle resiliently deformed by the extension of the protrusion into the receptacle to thereby apply a restorative force to the protrusion to maintain the brace-retainer connection.

12. A method according to claim 9 wherein forcing the first brace in the inward direction toward the secondary retainer connector of the retainer to form the brace-retainer connection comprises applying force to a shoulder or surface of the second brace connector component with a tool and wherein the second brace connector component comprises one or more sidewalls for aligning the tool with the shoulder or surface.

13. A method according to claim 1 wherein coupling the first brace connector component of the first brace to the first panel comprises sliding the first brace connector in a longitudinal direction relative to a second panel connector component to form a panel-brace connection.

14. A method according to claim 13 wherein forming the panel-brace connection comprises sliding a projection of the second panel connector component into a channel of the first brace connector in the longitudinal direction.

15. A method according to claim 13 wherein forming the panel-brace connection comprises sliding a projection of the first brace connector into a channel of the second panel connector component in the longitudinal direction.

16. A method according to claim 1 wherein the primary and secondary retainer connector components are integral to the base.

17. A method according to claim 1 wherein the one or more mounting features comprises one or more apertures and mounting the retainer to the first surface comprises passing one or more fasteners through the one or more apertures and into the first surface.

* * * * *